US008104118B2

(12) United States Patent
Derenne et al.

(10) Patent No.: US 8,104,118 B2
(45) Date of Patent: Jan. 31, 2012

(54) HOSPITAL BED

(75) Inventors: Richard A. Derenne, Portage, MI (US); Cory P. Herbst, Shelbyville, MI (US); Stanley T. Palmatier, Paw Paw, MI (US); Chris Siler, Lawton, MI (US)

(73) Assignee: Stryker Corporation, Kalamazoo, MI (US)

( * ) Notice: Subject to any disclaimer, the term of this patent is extended or adjusted under 35 U.S.C. 154(b) by 326 days.

(21) Appl. No.: 12/356,704

(22) Filed: Jan. 21, 2009

(65) Prior Publication Data

US 2009/0188042 A1 Jul. 30, 2009

Related U.S. Application Data

(60) Provisional application No. 61/046,704, filed on Apr. 21, 2008, provisional application No. 61/022,472, filed on Jan. 21, 2008.

(51) Int. Cl.
*A47C 21/08* (2006.01)

(52) U.S. Cl. ..... 5/430; 5/428; 5/425

(58) Field of Classification Search ..... 5/430, 425, 5/428

See application file for complete search history.

(56) References Cited

U.S. PATENT DOCUMENTS

| | | | | |
|---|---|---|---|---|
| 3,012,255 | A | 12/1961 | Diehl | |
| 3,234,570 | A * | 2/1966 | Hutt | 5/430 |
| 3,336,609 | A | 8/1967 | Taylor | |
| 3,585,659 | A | 6/1971 | Burst et al. | |
| 3,840,917 | A | 10/1974 | Taylor | |
| 3,930,273 | A | 1/1976 | Stern | |
| 3,932,903 | A | 1/1976 | Adams et al. | |
| 3,971,083 | A | 7/1976 | Peterson | |
| 4,509,217 | A | 4/1985 | Therrien | |
| 4,612,679 | A | 9/1986 | Mitchell | |
| 4,985,946 | A * | 1/1991 | Foster et al. | 5/601 |
| 4,987,623 | A | 1/1991 | Stryker et al. | |

(Continued)

FOREIGN PATENT DOCUMENTS

WO 2005092153 A1 10/2005

OTHER PUBLICATIONS

Medical Electrical Equipment, Part 2: Particular requirements for the safety of electrically operated hospital beds, International Electrotechnical Commission, CEI IEC 601-2-38, First Edition 1996 (pp. 1-69).

(Continued)

*Primary Examiner* — Robert G Santos
(74) *Attorney, Agent, or Firm* — Warner Norcross & Judd LLP

(57) ABSTRACT

A patient support incorporates a lying surface and at least one siderail on at least one side of the support. The siderails are operable between a raised position, an intermediate position, and a lowered position. When unlocked and urged from the raised position to the intermediate position, a latching mechanism automatically locks the siderails in the intermediate position. When urged from the lowered position to the raised position, the locking mechanism permits the siderails to pass through the intermediate position without locking, and to subsequently lock at the raised position. In the intermediate position, the siderails may define a gap through which a patient can ingress or egress the bed. In the raised and intermediate positions, the siderails may define gaps between each other and/or between the siderails and a headboard and footboard, that are sufficiently small to prevent accidental egress, and sufficiently large to prevent pinching and entrapment.

21 Claims, 50 Drawing Sheets

U.S. PATENT DOCUMENTS

| | | | | |
|---|---|---|---|---|
| 4,993,089 | A | 2/1991 | Solomon et al. | |
| 5,173,975 | A | 12/1992 | Peterson | |
| 5,187,824 | A | 2/1993 | Stryker | |
| 5,216,768 | A | 6/1993 | Bodine et al. | |
| 5,279,010 | A | 1/1994 | Ferrand et al. | |
| 5,394,580 | A | 3/1995 | Foster et al. | |
| 5,604,942 | A | 2/1997 | Allevato et al. | |
| 5,678,267 | A | 10/1997 | Kinder | |
| 5,689,839 | A | 11/1997 | Laganiere et al. | |
| 5,715,548 | A | 2/1998 | Weismiller et al. | |
| 5,742,959 | A | 4/1998 | Froelich | |
| 5,781,945 | A | 7/1998 | Scherer et al. | |
| 6,058,531 | A | 5/2000 | Carroll | |
| 6,253,397 | B1 | 7/2001 | Bartow et al. | |
| 6,360,385 | B1 | 3/2002 | Lewandowski | |
| 6,363,552 | B1 | 4/2002 | Hornbach et al. | |
| 6,389,622 | B1 | 5/2002 | Her et al. | |
| 6,401,277 | B1 | 6/2002 | Savage et al. | |
| 6,564,404 | B1 | 5/2003 | Nanahara | |
| 6,640,360 | B2 | 11/2003 | Hornbach et al. | |
| 6,658,680 | B2 | 12/2003 | Osborne et al. | |
| 6,691,345 | B2 | 2/2004 | Nanahara | |
| D488,941 | S | 4/2004 | Lemire et al. | |
| D488,942 | S | 4/2004 | Lemire et al. | |
| 6,721,975 | B1 | 4/2004 | Lemire | |
| 6,829,793 | B2 | 12/2004 | Brooke et al. | |
| 6,938,289 | B2 | 9/2005 | Morin | |
| 6,951,036 | B2 | 10/2005 | Lemire | |
| 7,028,352 | B2 | 4/2006 | Kramer et al. | |
| 7,073,219 | B2 | 7/2006 | Simmonds et al. | |
| 7,073,220 | B2 | 7/2006 | Simmonds et al. | |
| 7,082,630 | B2 | 8/2006 | Castonguay et al. | |
| 7,107,637 | B2 | 9/2006 | Kuek et al. | |
| 7,237,284 | B2 | 7/2007 | Hensley et al. | |
| 7,237,288 | B2 | 7/2007 | Lemire et al. | |
| 7,296,312 | B2 | 11/2007 | Menkedick et al. | |
| 7,412,734 | B2 | 8/2008 | Stryker et al. | |
| 7,472,439 | B2 | 1/2009 | Lemire et al. | |
| 7,500,280 | B2 | 3/2009 | Dixon et al. | |
| 7,559,101 | B2 | 7/2009 | Vrzalik et al. | |
| 7,793,369 | B2 * | 9/2010 | Guguin et al. | 5/425 |
| 7,805,782 | B2 * | 10/2010 | Hakamiun et al. | 5/430 |
| 2003/0167568 | A1 | 9/2003 | Brooke | |
| 2004/0040092 | A1 | 3/2004 | Hensley et al. | |
| 2004/0158923 | A1 | 8/2004 | Perez et al. | |
| 2005/0166322 | A1 | 8/2005 | Kramer et al. | |
| 2006/0053555 | A1 | 3/2006 | Poulos et al. | |
| 2006/0059621 | A1 | 3/2006 | Poulos et al. | |
| 2006/0059624 | A1 | 3/2006 | Poulos et al. | |
| 2006/0085912 | A1 * | 4/2006 | Kuek et al. | 5/430 |
| 2006/0090260 | A1 | 5/2006 | Stryker et al. | |
| 2006/0117481 | A1 | 6/2006 | Stryker et al. | |
| 2006/0137092 | A1 | 6/2006 | Reinke et al. | |
| 2006/0168730 | A1 | 8/2006 | Menkedick et al. | |
| 2006/0168731 | A1 | 8/2006 | Menkedick et al. | |
| 2006/0195984 | A1 | 9/2006 | Hakamiun et al. | |
| 2008/0010745 | A1 * | 1/2008 | Giesser | 5/430 |
| 2008/0127415 | A1 | 6/2008 | Ruschke et al. | |
| 2009/0007334 | A1 | 1/2009 | Stryker et al. | |
| 2009/0119839 | A1 * | 5/2009 | Guguin et al. | 5/430 |
| 2009/0139028 | A1 | 6/2009 | Morin et al. | |
| 2009/0188042 | A1 * | 7/2009 | Derenne et al. | 5/430 |

OTHER PUBLICATIONS

Draft Guidance for Industry and FDA Staff, Hospital Bed System Dimensional Guidance to Reduce Entrapment, U.S. Department of Health and Human Services, Aug. 30, 2004 (pp. 1-32).

Amendment 1, Medical electrical equipment, Part 2-38: Particular requirements for the safety of electrically operated hospital beds, International Standard, IEC 60601-2-38, 1999 (pp. 1-15).

Official Action dated Oct. 29, 2009, in U.S. Appl. No. 12/063,970, filed Sep. 19, 2008, for Movable Siderail Apparatus for Use with a Patient Support Apparatus.

Response dated Mar. 1, 2010 to Official Action dated Oct. 29, 2009, in U.S. Appl. No. 12/063,970, filed Sep. 19, 2008, for Movable Siderail Apparatus for Use with a Patient Support Apparatus.

Notice of Allowance with Examiner's Amendment dated Apr. 5, 2010 in U.S. Appl. No. 12/063,970, filed Sep. 19, 2008, for Movable Siderail Apparatus for Use With a Patient Support Apparatus.

* cited by examiner

HOSPITAL BED

CROSS REFERENCE TO RELATED APPLICATIONS

The present application claims the benefit of U.S. provisional applications, Ser. No. 61/022,472, filed Jan. 21, 2008, and Ser. No. 61/046,704, filed Apr. 21, 2008, which are hereby incorporated herein by reference in their entireties.

FIELD OF THE INVENTION

The present invention relates in general to patient supports used in the healthcare industry. In particular, the invention relates to siderails for a patient supports.

BACKGROUND OF THE INVENTION

Headboards, footboards, and siderails are typically added to hospital beds to reduce the likelihood of a patient falling off a bed. However, patients lying upon hospital beds are occasionally entrapped by a portion of a bed, or slip though a gap in the bed, or are pinched or otherwise caught by the bed. In an effort to reduce the likelihood that a medical patient will be injured or entrapped by a hospital bed, the Food and Drug Administration released a document of nonbinding recommendations entitled "Guidance for Industry and Staff—Hospital Bed System Dimensional and Assessment Guidance to Reduce Entrapment," FDA document number 1537 (hereinafter "the FDA document"), which issued on Mar. 10, 2006. The FDA document lists recommended minimum and maximum gaps or spacing between various portions of a hospital bed to reduce the likelihood of injury.

Movable siderails are desirable for protecting a patient from inadvertent bed egress, for example, while providing one or more alternate configurations for improving a caregiver's access to the patient and/or facilitating the patient's ingress and egress from the bed. However, movable siderails may increase the likelihood of patient entrapment and/or other situations in which a patient may be caught or pinched because the gaps or spacings are changeable between various portions of a bed so equipped.

Additionally, it is an aim of healthcare equipment providers to offer patient support devices that are easy to manipulate and which minimize required exertion by the operator. For patient support surfaces, siderails are ideally adjusted, with a minimum of effort, between positions facilitating intentional patient ingress and egress and positions offering security against unintentional egress. Although some known siderail mechanisms have been adapted to facilitate ingress, egress, and security, typically these have been positionable between lowered positions, locked raised positions, and lockable intermediate positions, where locking the siderails in the intermediate positions requires first moving the siderails to their locked raised positions, or beyond their locked raised positions, before lowering them back to the intermediate positions. However, when a patient is positioned (e.g. sitting) at the edge of a bed between, for example a lowered foot end siderail and a lowered head end siderail, the patient may block the motion of the siderail to its raised position and thus inhibit a caregiver's ability to move the siderail to the intermediate locked position.

SUMMARY OF THE INVENTION

Accordingly, the present invention provides a patient support, such as a bed, stretcher, cot, chair or the like, with movable siderails that can be moved to a position to limit egress from the patient support and to another position to allow egress from the patient support while maintaining sufficient spacing between the siderails themselves and also with respect to the footboard and headboard of the patient support to minimize the risk of entrapment or pinching of the patient's limbs or body. Each siderail may be movable between a raised position and a lowered position, and releasably lockable in an intermediate position between the raised and lowered positions, using a single hand. In addition, the siderail may be selectively releasably lockable in the intermediate position without limiting the ability of an attendant or caregiver to move the siderail quickly from its lowered position to its raised position. Further, the siderail may also incorporate one or more assist devices that reduce the force needed to move the siderail body over one or more ranges of motion.

In one form of the invention, a siderail for a patient support includes a siderail body that is movable between a first position and a second position, and is releasably lockable in a third position between the first and second positions. One of the first position and the second position is a raised locked position, and the other of the first and second position is a lowered position. The siderail also includes a latching mechanism for releasably locking the siderail body in the third position but which bypasses the third locked position when the siderail body is moved in a first direction from the first position to the second position. The latching mechanism releasably locks the siderail body in the third position when the siderail is moved in a second direction toward the first position from the second position after the siderail moves past the third position but before reaching the second position.

For example, such bypassing may be achieved by providing two structures in the latching mechanism that engage to couple with one another to lock the siderail body, and providing a third structure to prevent such engagement when the siderail body is moved in one direction only, i.e. from the first position toward the second position.

In one aspect, the latching mechanism includes a cam, for example a cam disk, which may define a lowered stop configuration. In addition, the cam may further define a raised stop configuration.

Another aspect of the latching mechanism may also include a latch that cooperates with the cam disk to define the intermediate configuration. When the cam disk rotates to a position corresponding with the third position, the latch engages or couples with the cam disk to lock the siderail body in the third position. This may be accomplished by the latch having an engagement structure, such as one or more locking protrusions. For example, the cam disk may include a void, with the locking protrusion releasably meshing with the void, which is arranged on the cam disk to correspond with the third position. Such meshing causes the latch to prevent the cam disk from rotating about its rotational axis, thereby locking the siderail in the third position. The locking protrusion can be released from its meshed position, thereby allowing the siderail to move away from the third position, by a handle or other release mechanism as described herein.

For example, the cam disk may include a rotational axis, about which the cam disk rotates when the siderail body is moved between the first position and the second position, and a cam disk face, which lies in a plane generally perpendicular to the rotational axis. Further, the engagement structure may couple to the cam disk at the cam disk face, with the engagement structure being adapted to releasably couple with the cam disk face when the siderail body is moved to the third position to thereby releasably rotatably lock the cam disk and thereby lock the siderail body in the third position. For example, as noted above the latch may have a locking protrusion, and the cam disk may include a void in the cam disk face, with the locking protrusion engaging the cam disk face at the void.

According to yet further aspects, the latching mechanism includes a latch biasing element, which is adapted to urge the latch into engagement with the cam disk. For example, the latch biasing element may be adapted to urge the locking protrusion towards the void when the void is substantially aligned with the locking protrusion. For redundancy of the latch biasing function, two latch biasing elements may be used, so that failure of one latch biasing elements will leave one latch biasing element operational. Similarly, more than two latch biasing elements may be used.

Yet another aspect of the latching mechanism includes a bypass arm for restraining the latch from locking the siderail body in the third position when the siderail body is moved from the first position to the second position. Such restraint, for example, may be accomplished by preventing the locking protrusion from meshing or cooperating with the void in that range of rotation of the cam disk corresponding to the third position. By preventing such meshing, the cam disk may rotate past the third position without allowing the latch biasing element to urge the locking protrusion in to the void, thereby allowing the latching mechanism to bypass the intermediate locked configuration. For example, the bypass arm may include a stepped portion that is adapted to block the latch such that the latch is prevented from cooperating with the cam disk when the latch is blocked by the stepped portion. Further, the stepped portion may block the latch at that portion of rotation of the cam disk substantially corresponding to the third position when the siderail body is moved in a direction from the first position through the third position to the second position.

In another aspect, the bypass arm may form a cam follower for following the cam when the siderail body is moved from the second position through the third position to the first position. The cam follower may disengage from following the cam for that portion of movement substantially corresponding with the third position when the siderail body is moved in the direction from the first position through the third position to the second position. For example, the cam disk may include a profile at its perimeter, which is adapted to manipulate the follower as the cam disk rotates. The locking feature and follower may combine to control the operation of the latching mechanism to achieve desired operational characteristics.

One way to achieve such disengagement of the cam follower from the cam is to position a portion of the bypass arm between the latch and the cam disk face so as to prevent the latch protrusion from moving into the void in the cam face. For example, the bypass arm may include a stepped portion. When the siderail body is moved or second in direction from the first position to the second position, the stepped portion moves between the latch and the cam disk face so that the stepped portion prevents the latch from cooperating with the cam disk. In addition, the bypass arm is further configured to allow the stepped portion to move in between the latch and the cam disk face at that portion of rotation of the cam disk substantially corresponding to the third position of the siderail. To bypass the locking of the third position when the siderail is moved in a direction from the first position to the second position, such movement of the stepped portion is arranged to occur only when the siderail body is moved in the direction from the first position through the third position to the second position.

According to another aspect, the cam disk further includes a cam lobe for engagement by the latch. For example, the latch may be provided with another protrusion. This protrusion may engage the cam lobe at a position between the third position and the first position to situate the latch so that the stepped portion may move between the cam disk face and the latch. The protrusion may serve to ensure that the latch is rotated sufficiently far from the adjacent face of the cam disk to allow the stepped portion of the bypass arm to move between the latch and the cam disk face, as described above. Thus, if the latch is pulled sufficiently far away from the cam disk to allow the locking protrusion to vacate the void but not sufficiently far away to allow the stepped portion to move between the latch and the cam disk face, the protrusion may act to move the latch farther from the cam disk to ensure proper configuring of the bypass arm.

In another form of the invention, a siderail for a patient support may include a siderail body, which is movable between lowered and second positions, and one or more siderail arms, which include a first portion for pivotally connecting to a patient support and a second portion for pivotally connecting to the siderail body. Thus, the siderail arms pivotally connect the siderail body to the patient support. The siderail further includes a latching mechanism with a cam disk fixedly attached to the siderail arm, which is configured to releasably lock the siderail body in the third position.

In another aspect, the cam disk is optionally attached to the siderail arm at the pivotal connection between the siderail and the siderail arm.

Another aspect of the latching mechanism further includes a bypass arm for restraining the cam disk from locking the siderail body in the third position when the siderail body is moved from the first position to the second position. Such restraint, for example, may be accomplished by preventing the cam disk from locking the siderail body in the intermediate locked position.

In a further aspect, the bypass arm includes a cam follower for following the perimeter of the cam disk when the siderail body is moved from the first position through the third position to the second position. The cam follower may disengage from following the cam disk for that portion of movement substantially corresponding with the third position when the siderail body is moved from the second position through the third position to the first position.

In yet a further aspect, the latching mechanism also includes a latch that cooperates with the cam disk to define the intermediate configuration. When the cam disk rotates to a position corresponding with the intermediate configuration, the latch may engage or couple with the cam disk to lock the siderail body in the third position. This is accomplished by the latch having, for example, a locking protrusion, which may releasably couple to the cam disk, for example mesh with a void provided in the cam disk, which is configured to correspond with the third position. Such meshing causes the latch to prevent the cam disk from rotating about its rotational axis, thereby locking the siderail in the third position. The locking protrusion is released from its meshed position, thereby allowing the siderail to move away from the third position, for example by a handle or other release mechanism as described herein.

According to yet further aspects, the latching mechanism may further include a latch biasing element for urging the locking protrusion towards the void when the void is substantially aligned with the locking protrusion. Generally, the latch biasing element may urge the latch in the direction of the cam disk face, thereby urging the locking protrusion into the void when the void is aligned with the locking protrusion.

One way to achieve such disengagement of the cam follower from the cam disk is to configure a portion of the bypass arm between the latch and the cam disk face. For example, the bypass arm may include a stepped portion. The stepped portion blocks the latch from moving toward the cam disk thereby preventing the latch from cooperating with the cam disk. Accordingly, the bypass arm is configured to move the stepped portion between the latch and the cam disk at that portion of rotation of the cam disk substantially corresponding to the third position of the siderail. To bypass the locking of the third position when the siderail is moved from the first position to the second position, such movement of the bypass into the blocking position occurs when the siderail body is moved in a direction from the first position through the third position but not when lowered in a direction from the second position to the third position. Further, once the siderail is moved passed the third position, the bypass arm is released from the blocking position so that the siderail can be lowered and automatically locked in the third position once it has been moved past the third position.

In yet another form of the invention, a siderail for a patient support includes a siderail body movable between a first position, a second position, and a third position located between the lowered and second positions. The siderail also includes a latching mechanism with a locking configuration that is adapted to releasably lock the siderail body in the second position and in an intermediate locked position at the third position but which has a bypass configuration adapted to allow the siderail body to bypass the intermediate locked position when the siderail body is moved in a direction from the first position to the second position. Once passed the third position, the latching mechanism is reconfigured from its bypass configuration to its locking configuration. In addition, the latching mechanism is adapted to provide perceptible feedback when the siderail body is moved passed the third position and when the latch mechanism is reconfigured between its bypass configuration to its locked configuration. Such feedback may take the form of an audible noise, such as a "click," or may be tactile feedback or visual feedback.

In still another form of the invention, a siderail for a patient support includes a siderail body movable between a first position, a second position, and a third position located between the lowered and second positions. The siderail also includes a latching mechanism configured to releasably lock the siderail body in the third position but which bypasses the intermediate locked position when the siderail body is moved in a direction from the first position to the second position. The siderail also includes a handle connected to the siderail body wherein the siderail body and the handle move together. The handle is adapted to release the latching mechanism from the locked configuration, thus allowing one-handed operation of the siderail body.

For example, the siderail body has an outer perimeter, with the handle located within the outer perimeter of the siderail body.

In a further form of the invention, a siderail for a patient support includes a siderail body movable between a first position, a second position, and a third position located between the lowered and second positions. The siderail also includes a latching mechanism for releasably locking the siderail body in the third position but which bypasses the intermediate locked position when the siderail body is moved in a direction from the first position to the second position. The latching mechanism is contained within the siderail body. Such containment of the latching mechanism keeps the latching mechanism protected from dirt and dust and other environmental conditions, which may adversely affect any moving parts while also protecting users of the siderail from the moving components of the latching mechanism.

In a still further form of the invention, a siderail for a patient support includes a siderail body movable between a first position, a second position, and a third position located between the lowered and second positions. The siderail also includes a latching mechanism configured to releasably lock the siderail body in the third position but which is configured to bypass the intermediate locked position when the siderail body is moved in a direction from the first position to the second position. The latching mechanism includes a first latch member and a second latch member. The first latch member is movable between a locking position wherein the siderail body is locked in position and an unlocked position wherein the siderail body is no longer locked in position. The second latch member is movable to form a physical barrier to the first latch member when the siderail body is moved in the direction from the first position to the third position to prevent the first latch member from moving to its locking position.

In another form of the invention, a siderail for a patient support includes a siderail body movable between a first position, a second position, and a third position located between the lowered and second positions. The siderail also includes a latching mechanism configured to releasably lock the siderail body in the third position but which has a bypass configuration wherein the siderail bypasses the intermediate locked position when the siderail body is moved in a direction from the first position to the second position. The latching mechanism includes a latch that defines the locked position, the first position, and the second position.

In yet another form of the invention, a siderail for a patient support may include a siderail body movable between a first position, a second position, and a third position located between the lowered and second positions. The siderail further includes a first biasing element that urges the siderail body in a first direction of movement of the siderail body and a second biasing element that urges the siderail body in a second direction of movement of the siderail body.

For example, the first biasing element may urge the siderail body from the second position toward the third position with a first biasing force, and the second biasing element may urge the siderail body from the first position toward the third position with a second biasing force. Thus, the biasing elements may reduce the required amount of operator-provided force to move the siderail body within its range of motion, thereby minimizing the physical impact of operating the siderail on the user.

Such first biasing element may include a proximal portion that is pivotally connectable to a patient support and a distal portion that is pivotally connected to the siderail body. Similarly, the second biasing element may also include a proximal portion pivotally connectable to a patient support and a distal portion pivotally connected to the siderail body.

In another aspect of the siderail, the first biasing element may be a gas spring, or an extension spring, or the like. Similarly, the second biasing element may be a gas spring, or a compression spring, or the like.

Another aspect of the siderail includes a pivot arm with a first pivot that is pivotally attached to the first biasing element and a second pivot that is fixedly attached to the siderail body. The pivot arm couples the biasing force of the first biasing element with the siderail body when the siderail body is between the second position and the third position, and decouples the biasing force of the first biasing element when the siderail body is between the first position and the third position.

In yet another aspect of the siderail, the pivot arm may perform such coupling/decoupling by including an arcuate slot located substantially about the second pivot. The arcuate slot may engage a protrusion configured to engage an end of the arcuate slot between the second position and the third position, and traverse the arcuate slot between the first position and the third position. When the protrusion is engaged with such end, it acts to rotate the pivot arm about the second pivot, extending the first biasing element as the first pivot (i.e. the connection between the pivot arm and the first biasing element) moves.

Thus, the pivot arm may decouple the biasing force of the first biasing element from the siderail body between the first position and the third position as the protrusion traverses the arcuate slot. This may allow the first biasing element to achieve a relaxed state at a position corresponding to a siderail position between the lowered and second positions, and to retain such relaxed state even though the siderail body continues to move through its range of motion.

In still another form of the invention, a siderail for a patient support includes a siderail body movable between a first position, a second position, and a third position located between the lowered and second positions. The siderail further includes a latching mechanism adapted to releasably lock the siderail body in one or more of the positions. The latching mechanism includes a latch pivotally about a latch pivot axis, which is adapted to lock the siderail body in one or more of the positions. The siderail body further includes a handle for disengaging the latch to thereby unlock the siderail body, which is pivotal about a handle pivot axis that is either substantially coaxial with or substantially parallel to the latch pivot axis, and wherein rotation of the handle about its pivot axis induces rotation of the latch about its pivot axis.

In one aspect, the handle may further include a feature that limits its rotational motion, providing a firm stop for the user and preventing rotation of the latch beyond a predetermined point. The handle may include a handle protrusion that engages a corresponding protrusion provided or formed on the latch to convert the rotational motion of the handle to rotational motion of the latch.

In a further aspect, the latching mechanism is configured to releasably lock the siderail body in the third position. In addition, the latching mechanism may be configured to releasably lock the siderail body in the third position when the siderail body is being moved from the second position to the first position but to bypass the third position when the siderail body is being moved from the first position to the second position.

Any of the foregoing forms of the siderail may include two siderail arms that are pivotally connected to a patient support and are pivotally connected to the siderail body, forming a four-bar linkage between a patient support and the siderail.

According to another aspect of the invention, any of the foregoing forms of the latching mechanism may be adapted to releasably lock the siderail body in the second position. Such locking may be accomplished using substantially the same or similar structures and methods that are used for locking the siderail body in the third position.

In any of the foregoing forms of the siderail, a cam disk may operate to delineate a raised stop position or a lowered stop position or both. The raised stop position is the position beyond which the siderail cannot travel when it is in the second position. Similarly, the lowered stop position is the position beyond which the siderail cannot travel in the first position. Accordingly, the raised and lowered stop positions may be operable to define the overall range of motion for the siderail.

The cam disk may define such stop positions by having a raised step and/or a lower step at the perimeter of the disk which may engage a pin or protrusion or other protuberance to arrest rotation of the cam disk at defined positions. For example, the raised step of the cam disk may correspond with the raised stop position of the latching mechanism, and the lower step of the cam disk may correspond with the lowered stop position of the latching mechanism.

In another aspect, the siderails may include more than one latching mechanism. For example, the siderail may have a latching mechanism associated with each siderail arm. Further, the latching mechanisms may be coupled by a timing link. The timing link may keep the latching mechanisms synchronized, thereby ensuring that a configuration of each latching mechanism corresponds with the configuration of the other latching mechanism for a given position of the siderail body.

In yet a further aspect, the timing link may be pivotally attached to siderail arms, which in turn are pivotally attached to the latching mechanisms as discussed above. In this configuration, the timing link may make the four-bar linkage formed by the siderail arm, a patient support, and the siderail arms in to a parallelogram by ensuring that each of the two siderail arms move in unison with the other.

Accordingly, the present invention provides a patient support siderail with a siderail body that is movable between a second position and a first position and further is releasably lockable in a third position between the raised and first positions. In addition, the siderail body is selectively releasably lockable in the third position but without limiting the ability of an attendant or caregiver to move the siderail body quickly from its first position to its second position. Further, the siderail may also be configured to reduce the force needed to move the siderail body.

In another form of the invention, a hospital bed includes a lying surface, a pair of siderails on at least one side of the bed, a headboard, and a footboard. The siderails are operable between a second position, a third position, and a first position. In the second position, the siderails form a barrier that limits a patient on the lying surface from exiting or egressing the bed. In the third position, the siderails define a gap therebetween through which a patient can ingress or egress the bed, while optionally using one or both siderails as handholds. In the first position, the siderails are below the patient lying surface to provide a caregiver with improved access to a patient on the lying surface. In addition, the siderails define a gap therebetween. Further, each siderail defines a gap either with the headboard or the footboard. Each of these gaps is either less than about 60 millimeters or greater than about 235 millimeters when the siderails are in the intermediate and second positions.

According to another form of the present invention, a hospital bed includes a patient lying surface, a headboard, a footboard, a head end siderail, and a foot end siderail. The headboard is coupled to the bed at a head end of the lying surface, and the footboard is coupled to the bed at a foot end of the lying surface. The head end siderail is movably coupled to the bed along a first side of the patient lying surface and disposed generally toward the head end of the lying surface. The foot end siderail is movably coupled to the bed along the first side of the patient lying surface and disposed generally toward the foot end of the lying surface. The head end siderail and the foot end siderail are movable from second positions to third positions. In the second positions, a first gap defined between the headboard and the head end siderail is greater than about 235 millimeters, a second gap defined between the siderails is less than about 60 millimeters, and a third gap defined between the footboard and the foot end siderail is greater than about 235 millimeters. In the third positions, the first gap is less than about 60 millimeters, the second gap is greater than about 235 millimeters, and the third gap is less than about 60 millimeters.

In one aspect, the head end siderail and the foot end siderail are movable from the third positions to first positions such that top portions of the siderails are approximately at or below a plane defined by a top surface of the patient lying surface. In another aspect, one or both of the head end siderail and the foot end siderail include hand-holds or grab-bars.

According to yet another form of the present invention, a hospital bed includes a patient lying surface, a head end siderail, and a foot end siderail. The head end siderail is movably coupled at the bed along a first side of the patient lying surface and disposed generally toward a head end of the lying surface. The foot end siderail is movably coupled at the bed along the first side of the patient lying surface and disposed generally toward a foot end of the lying surface. The head end siderail and the foot end siderail are releasably lockable in respective second positions and are movable away from one another and toward the head end and foot end, respectively, of the lying surface along generally arcuate paths to respective automatically-locked third positions. The head end siderail and the foot end siderail are also movable from the third positions along generally arcuate paths to respective first positions. Similarly, the head end siderail and the foot end siderail are movable from the first positions, through the third positions without automatically locking at the third positions, to the second positions.

According to still another form of the present invention, a hospital bed includes a patient lying surface, a left foot end siderail, a right foot end siderail, and a footboard. The patient lying surface is supported at the bed. The left foot end siderail is movably coupled at the bed along a left side of the patient lying surface and disposed generally toward a foot end of the lying surface. The right foot end siderail is movably coupled at the bed along a right side of the patient lying surface and disposed generally toward the foot end of the lying surface. The footboard is coupled at the bed at the foot end of the lying surface. The left foot end siderail and the right foot end siderail are movable toward the foot end of the lying surface to abut or substantially overlap with the footboard. The abutment and/or overlap creates a substantially continuous fence about the foot end of the lying surface from a head end of the left foot end siderail to a head end of the right foot end siderail and inclusive of the footboard.

Accordingly, the present invention provides a bed with a pair of movable siderails at either side, the siderails protecting a patient from inadvertently exiting the bed. The siderails provide intermediate and lowered configurations for improving a caregiver's access to the patient and/or facilitating the patient's ingress and egress from the bed or using the bed for therapy or exercise. In addition, the siderails reduce the likelihood of patient entrapment and/or pinching or the like by meeting or exceeding minimum and maximum thresholds for gap sizes when the siderails are their respective positions.

These and other objects, advantages, purposes, and features of the present invention will become apparent upon review of the following specification in conjunction with the drawings.

DESCRIPTION OF THE PREFERRED EMBODIMENTS

The present invention is directed to a patient support apparatus, and more specifically, to a patient bed, such as a hospital bed. As will be more fully described below, the bed is provided with a pair of movable siderails at either side, which form a fence when in their raised positions to protect a patient from inadvertently exiting the bed. The siderails provide intermediate and lowered configurations for improving a caregiver's access to the patient and/or facilitating the patient's ingress and egress from the bed or using the bed for therapy or exercise. In addition, the siderails are configured to reduce the likelihood of patient entrapment and/or other situations.

Referring now specifically to the drawings and the illustrative embodiments depicted therein, a siderail 10 for a patient support, such as a bed, chair, stretcher, cot, or the like, includes a siderail body 12 that is movable between a first position (such as a lowered position) and a second position (such as a raised position), and is selectively lockable in a third position (such as an intermediate position) between the first and second positions. As will be more fully described below, siderail 10 includes a latching mechanism 14 for locking siderail body 12 in its raised and intermediate positions, and which is also configured to facilitate raising siderail body 12 quickly by bypassing the intermediate locked position when siderail body 12 is moved in a direction from the lowered position to the raised position, but allow the siderail to be locked in the intermediate position once the siderail has been moved just past the intermediate position. In addition, siderail 10 may incorporate one or more assist devices, such as biasing elements to reduce the force needed to move siderail body 12.

Figure 1:
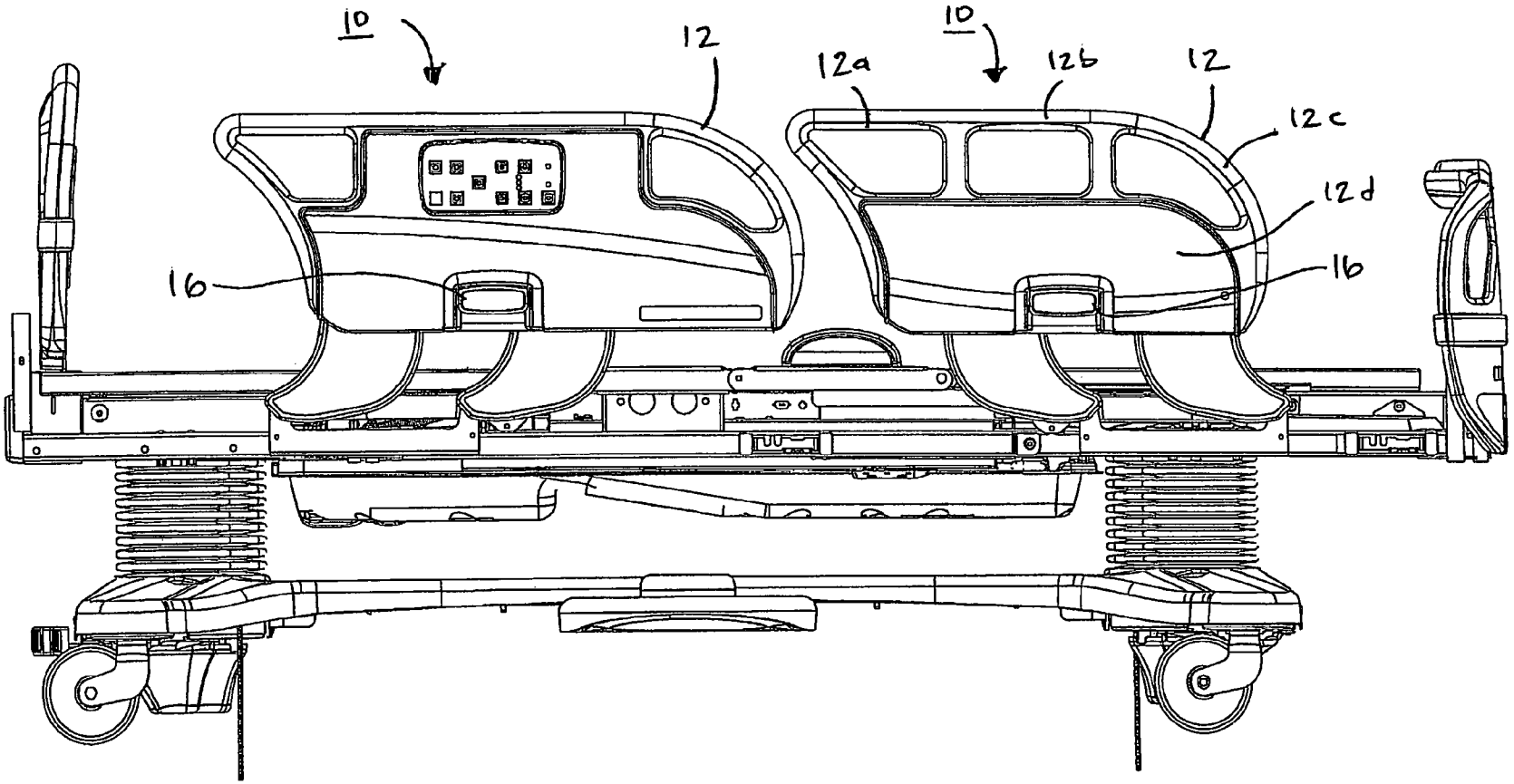
FIG. 1 is a side elevation of a patient support with a first embodiment of the present invention.

Referring now to FIG. 1, siderail body 12 comprises a tubular frame of substantially rigid material, such as a metal, including for example steel or aluminum, molded over with a polymeric material, such as plastic, including a reinforced plastic, which forms a plurality of openings 12*a*, 12*b*, 12*c*, at an upper portion of siderail body 12, which may be used by operators of siderail 10 or patients as hand-holds. A lower portion of the siderail body 12 forms an enclosure 12*d* that houses one or more latching mechanisms 14, the details of which are discussed in detail below. The enclosure 12*d* may be provided with a plurality of reinforcing ribs and structures, as well as mounting structures for mounting the various components of the latching mechanism 14.

Figure 2:
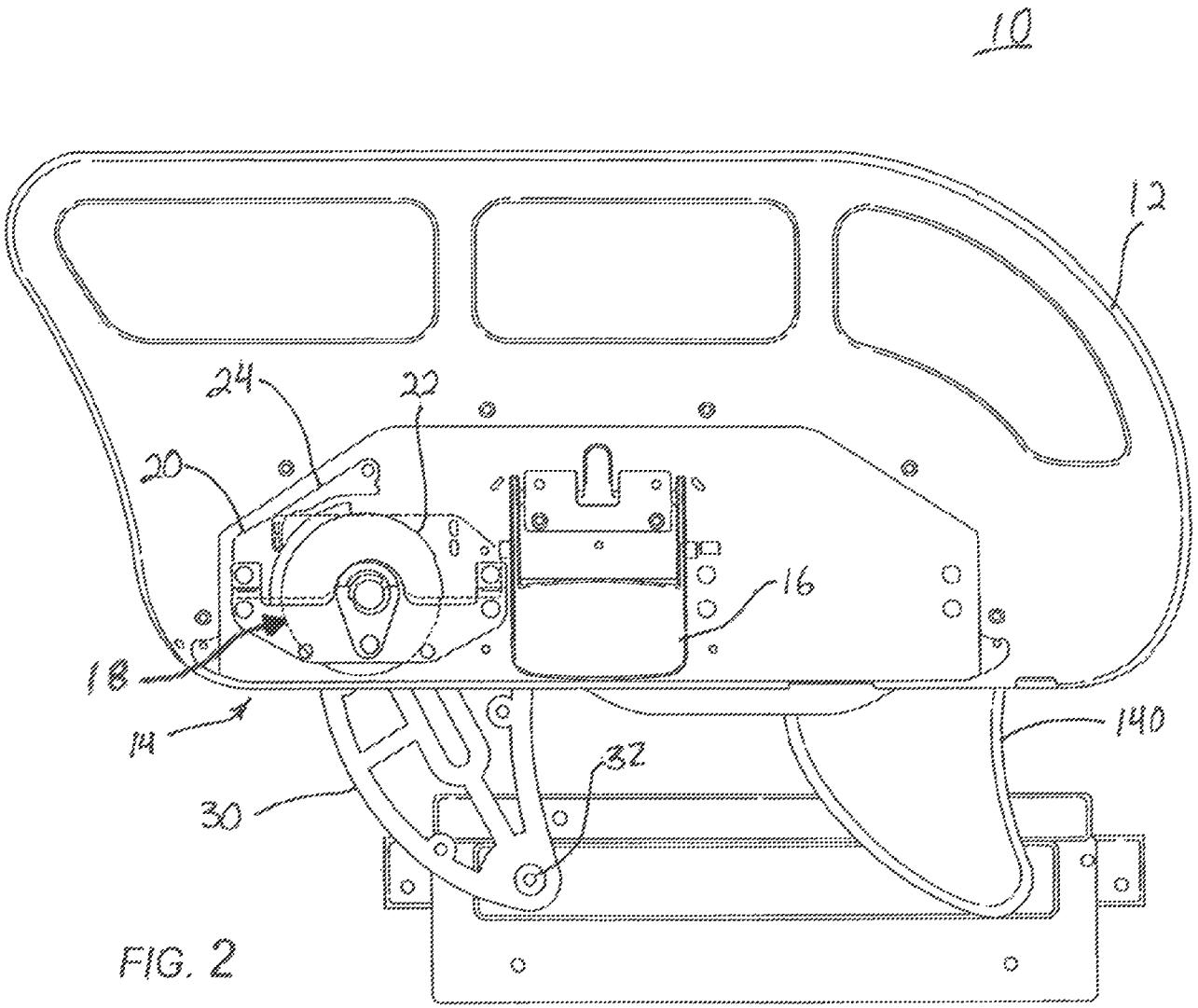
FIG. 2 is a side elevation of a siderail illustrating internal components thereof.

Referring now to FIG. 2, latching mechanism 14, which as noted is configured to lock the siderail body in at least two positions, namely the raised position and an intermediate position, and is unlocked by a handle 16, which is mounted in siderail body 12 and releases siderail body 12 from its locked positions when pivoted to a releasing position. As will be more fully described below, handle 16 allows for one-handed operation of the siderail body. When released and siderail body 12 is moved in a direction from the raised position to the lowered position, latching mechanism 14 is configured to automatically lock siderail body 12 in the intermediate position unless the releasing position of handle 16 is manually maintained. In addition, latching mechanism 14 is configured to bypass the intermediate locked position when the siderail is raised or moved in a direction from the lowered position toward the raised position, but is configured to lock the siderail in the intermediate position.

As best seen in FIGS. 1 and 2, latching mechanism 14 includes two latches or latch members in the form of a cam 18 and a latch plate 20 (FIG. 2), which are adapted to releasably lock siderail body 12 in its raised and intermediate positions. In the illustrated embodiment, cam 18 comprises a cam disk 22, which is adapted to cooperate with latch plate 20 to define at least one intermediate locked position and the raised locked position. Further, latching mechanism 14 includes a bypass arm 24, which is adapted to restrain or block latch plate 20 from cooperating with cam disk 22 to lock siderail body 12 in the intermediate position when siderail body 12 is moved in a direction from the lowered position to the raised position.

Latching mechanism 14 and other components of siderail 10 (as discussed herein) mount to siderail body 12 via a mounting plate 26 (FIG. 6) that is fixedly attached to siderail body 12 by fasteners that extend into corresponding mounting posts formed in enclosure 12*d*. Latching mechanism 14 couples with mounting plate 26 via a retainer 28 that fixedly attaches to mounting plate 26 with threaded connectors. Additionally, in the illustrated embodiment mounting plate 26 attaches to siderail body 12 in enclosure 12*d*, so that latching mechanism 14 is sub-flush or flush with an outside plane defined by siderail body 12. Mounting plate 26 may be made of a rigid material, such as metal, including aluminum or steel, to facilitate film threaded engagement of fasteners and to impart structural rigidity to siderail body 12.

Figure 3A:
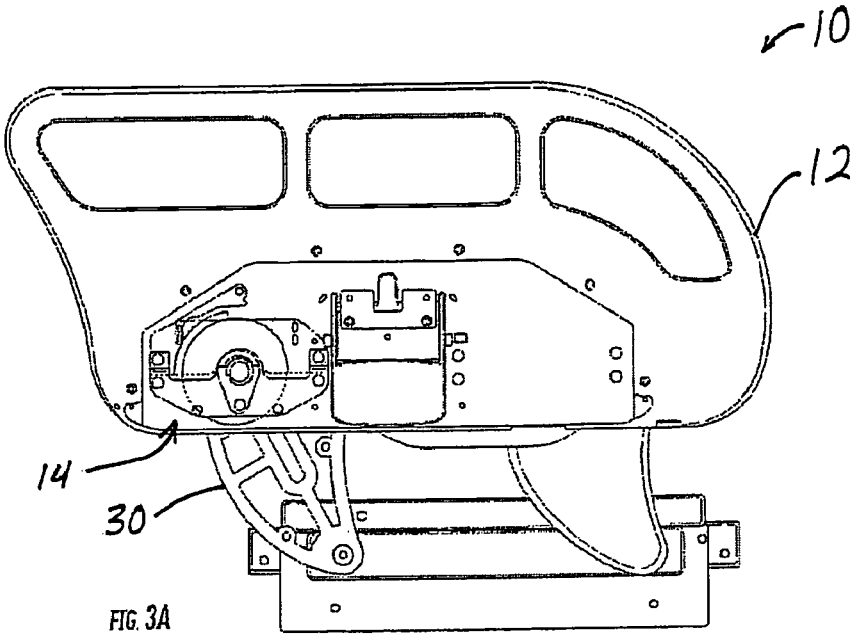
FIG. 3*a* is a similar view to FIG. 2 illustrating the siderail in the raised position.
Figure 3B:
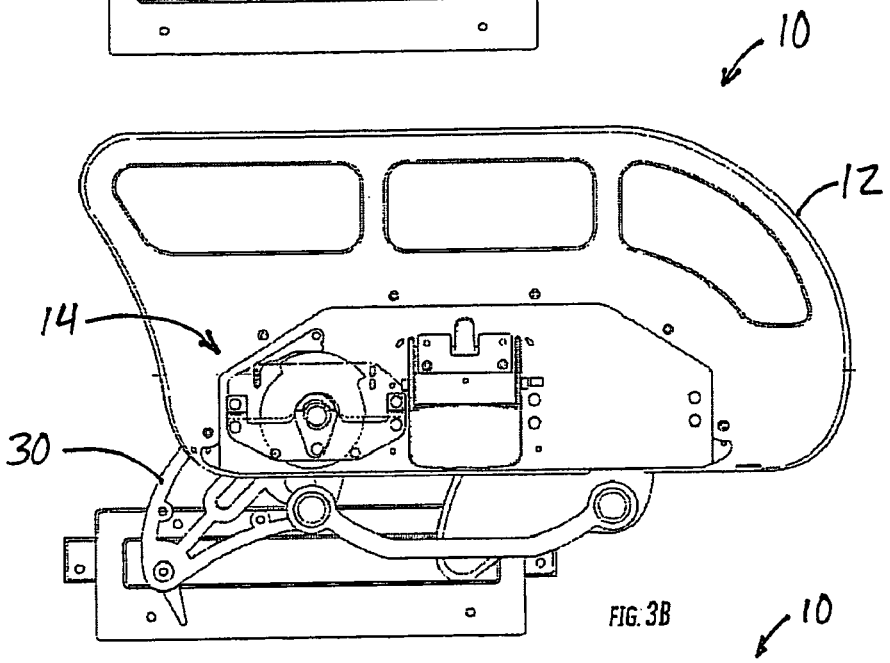
FIG. 3*b* is a similar view to FIG. 2 illustrating the siderail in the intermediate position.
Figure 3C:
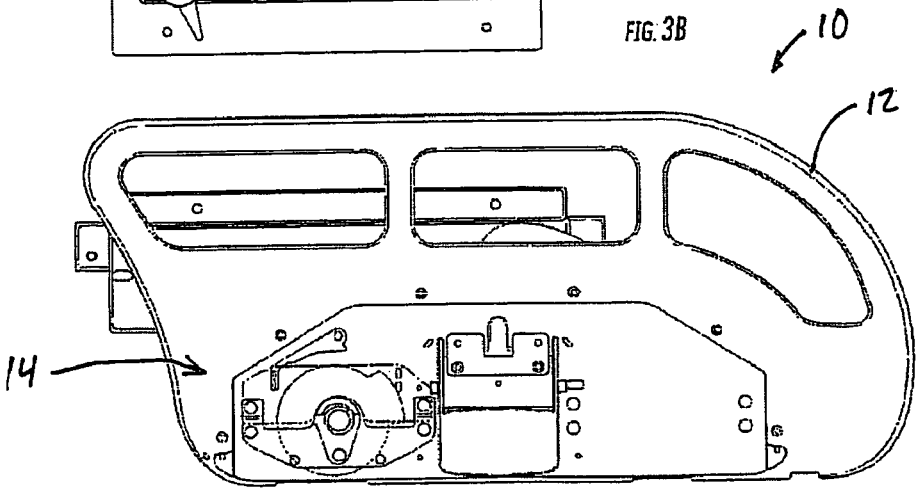
FIG. 3*c* is a similar view to FIG. 2 illustrating the siderail in the lowered position.

As noted above, and as best seen in FIGS. 3*a*-3*c*, siderail body 12 is moved from a raised position (FIG. 3*a*) through an intermediate position (FIG. 3*b*) to a lowered position (FIG. 3*c*) by a pair of siderail arms 30, which are pivotally mounted to the patient support at a first portion 32 and pivotally mounted to siderail body 12 at a second portion 34. The raised position provides for maximum patient restraint, blocking ingress and egress from a patient support surface. The intermediate position, which is between the raised and lowered position may be located to allow user ingress and/or egress while also remaining above a patient support surface to provide, for example, a hand hold for a patient or clinician. Additionally, the intermediate position may provide a gap between siderail body 12 and an adjacent siderail, as disclosed in more detail below. The lowered position allows maximum access to a patient support surface or lying surface by placing siderail body 12 substantially or completely below the patient support surface. As best understood from FIG. 6, each arm 30 includes a pivot shaft 36 that projects through openings provided in siderail body 12 and openings provided in mounting plate 26.

Referring now to FIGS. 4-25, siderail 10 and several of its constituent components are shown in a variety of positions. As best seen in FIG. 8 and as noted above, latch mechanism 14 includes a pair of latches or latch members in the form of cam disk 22 and latch plate 20. Referring to FIG. 8*a*, cam disk 22 is mounted about one of the pivot shafts 36 and further fixed to shaft 36 so that when shaft 36 rotates about its rotational axis, cam disk 22 similarly rotates about its central rotational axis 38. In the illustrated embodiment, only one latch mechanism is illustrated and, further, mounted relative to the left pivot shaft as seen in FIG. 6; however, it should be understood and, further as described, that more than one latch mechanism may be used or the latch mechanism may be mounted to the right pivot shaft.

Latch plate 20, which is also mounted to siderail body 12, is positioned to extend over cam disk 22 and further configured to engage and releasably couple to the cam disk to thereby stop the rotation of pivot shaft 36 about its rotational axis and thereby lock the position of siderail body 12. To couple latch plate 20 to cam disk 22 to limit and/or lock the movement of siderail body 12 relative to a patient support, each cam disk 22 and latch plate 20 includes a cooperating structure. The cooperating structures on cam disk 22 and latch plate 20 are operable to arrest rotation of cam disk 22, therefore halting movement of siderail body 12. Such structures engage each other at predetermined points corresponding with desired locking positions of siderail body 12, such as at the intermediate and raised positions. Further, as will be described below, handle 16 cooperates with latch plate 20 to release the cooperating structures to allow cam disk 22 to resume rotation. In addition, handle 16 is configured so that it may be maintained in such a released state to prevent any arresting of rotation of cam disk 22, thereby retaining such cooperating structures in a disengaged state and allowing siderail body 12 to move freely through its range of motion. Further, handle 16 is optionally located on siderail body 12 within the perimeter, sometimes referred to as "hoop", of the siderail body so that an operator may use handle 16 to raise or lower the siderail body and also unlock the latching mechanism to provide one-handed operation of siderail 10.

Figure 7:
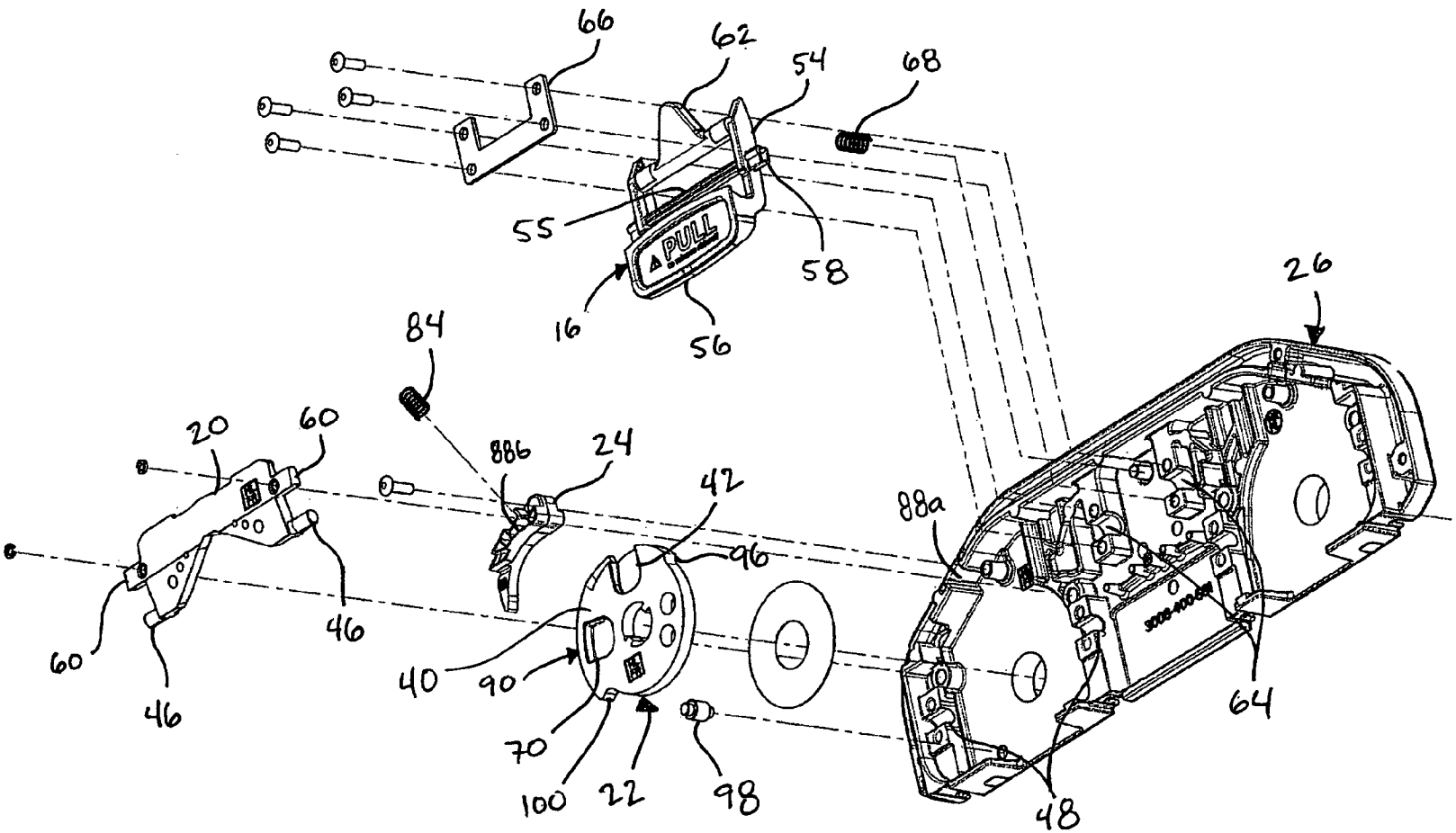
FIG. 7 is an exploded view of a portion of the siderail of FIG. 1, illustrating internal components of a latching mechanism.
Figure 8A:
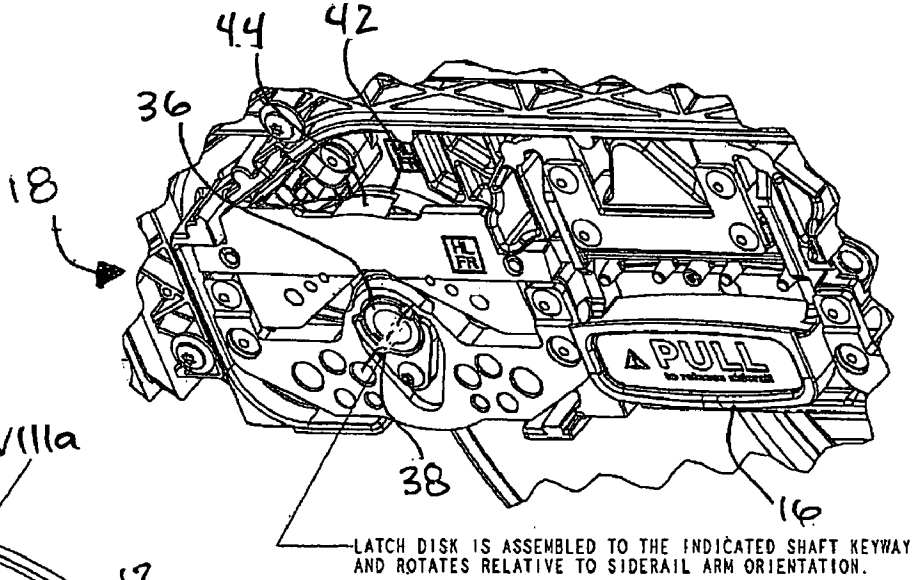
FIG. 8*a* is an enlarged view of detail VIIIa of FIG. 8 illustrating the internal components of the siderail of FIG. 8.
Figure 8:
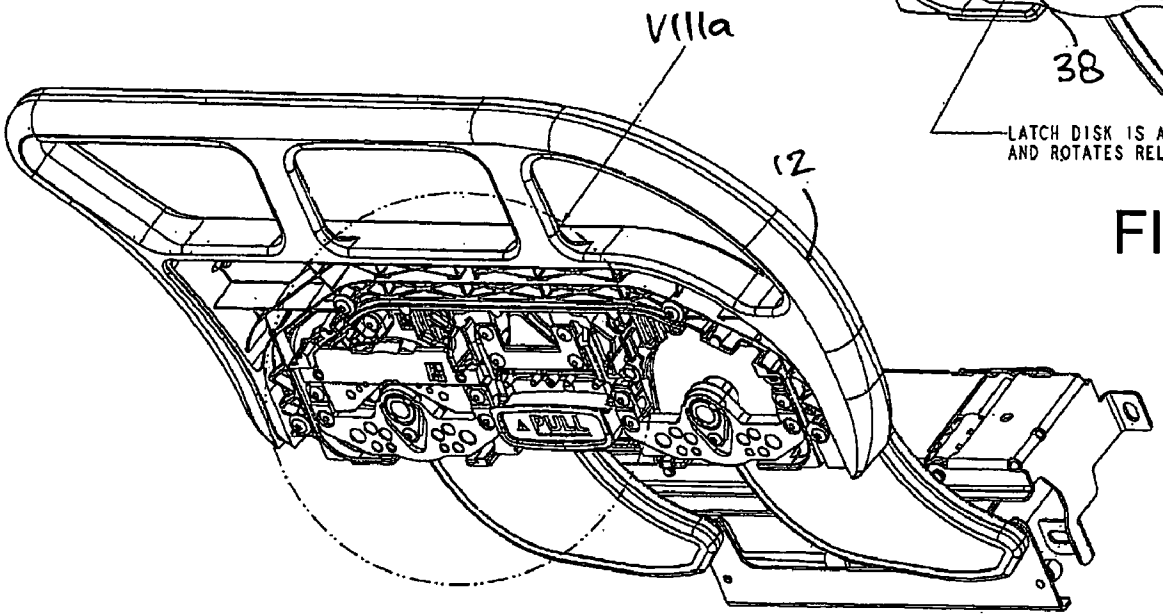
FIG. 8 is a similar view to FIG. 5 without the cover.
Figure 8C:
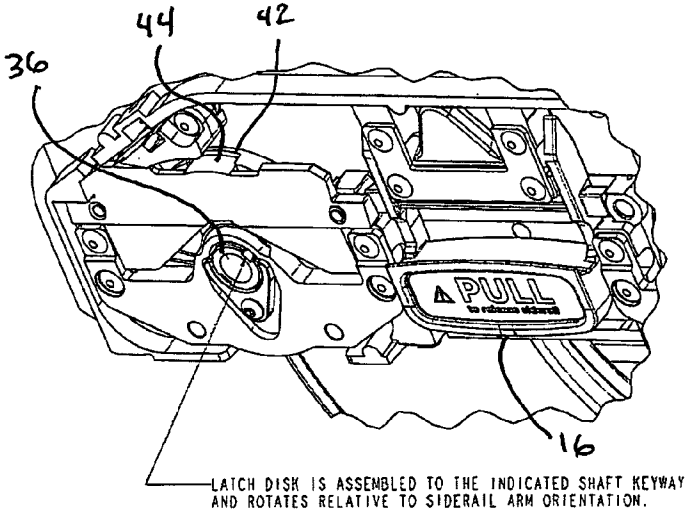
FIGS. 8*b* and 8*c* are similar views to FIGS. 8 and 8*a*, respectively, with some detail removed for clarity.
Figure 8B:
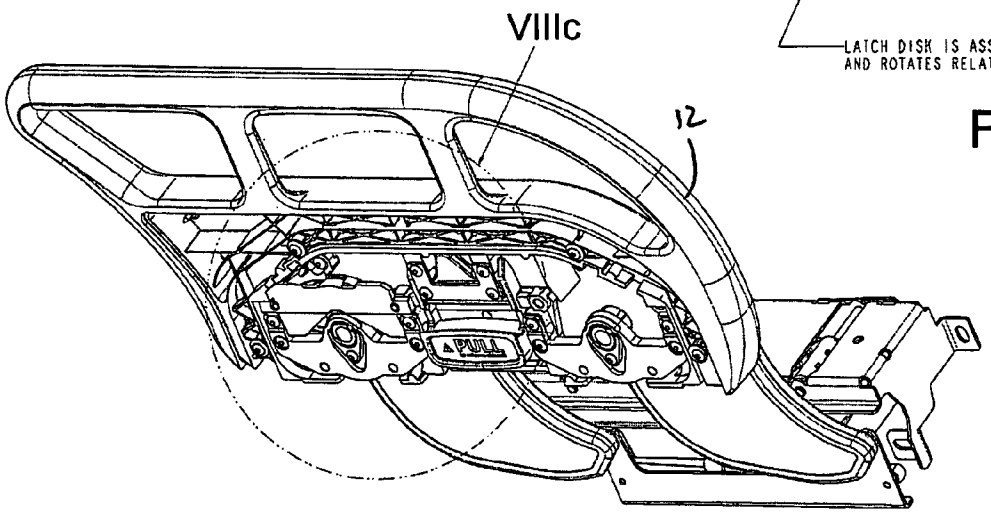
Figure 12A:
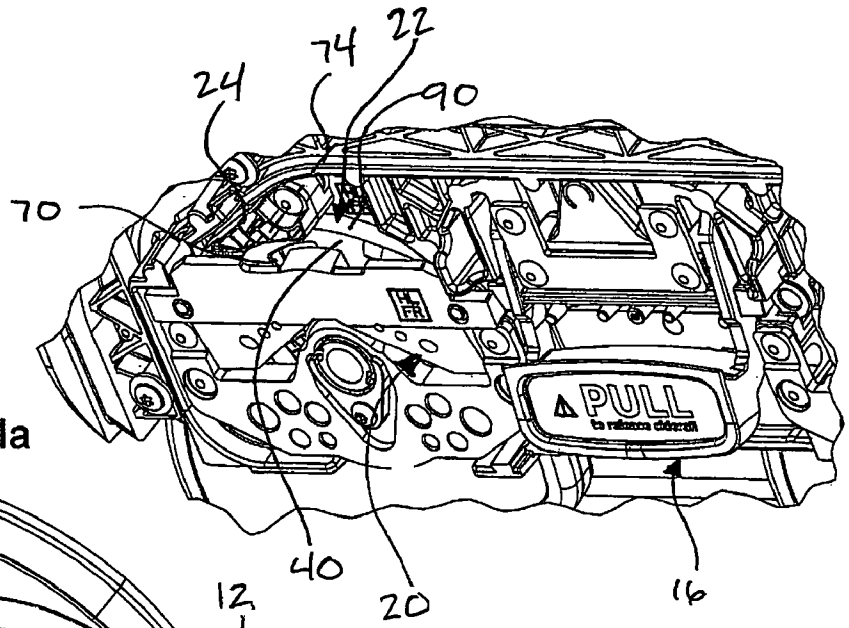
FIG. 12*a* is an enlarged view of detail XIIa of FIG. 12 illustrating the internal components of the siderail of FIG. 12.
Figure 21A:
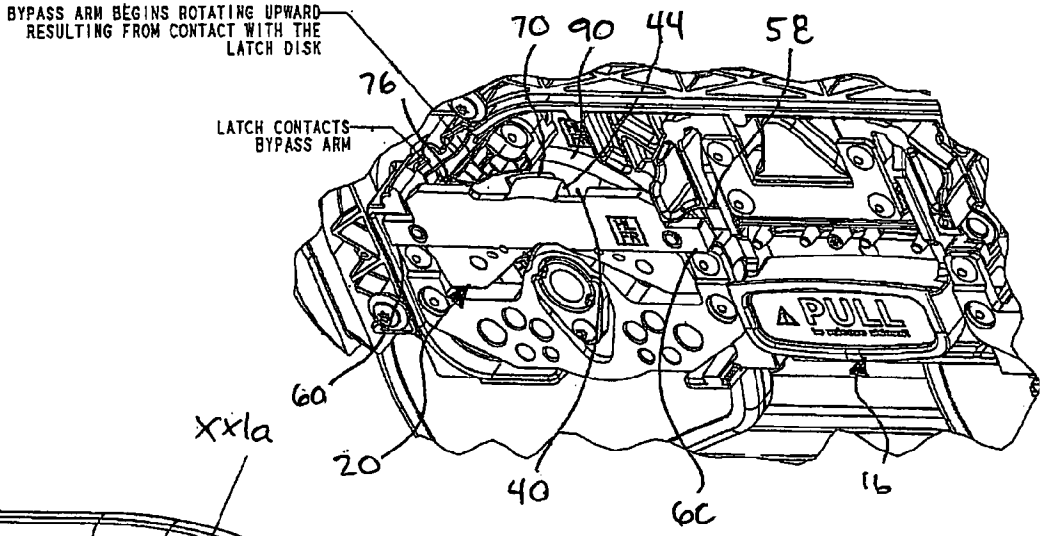
FIG. 21*a* is an enlarged view of detail XXIa of FIG. 21 illustrating the internal components of the siderail of FIG. 21.

In the illustrated embodiment, cam disk 22 is a generally circular member with a substantially flat cam disk face 40 (FIGS. 7, 12*a*, 21*a*). The perimeter of cam disk 22 may vary in radius (as measured from central rotational axis 38) and may include steps or ramps in its profile for interaction with adjacent parts to define stop positions and to control a bypass arm 24 more fully described below. As noted above, cam disk 22 is mounted about shaft 36 and may include a central aperture, which receives the distal end of the shaft and aligns with axis 38, and a keyway for rotatably coupling cam disk 22 to shaft 36. Thus, when siderail body 12 is moved between the lowered position and the raised position cam disk 22 rotates about central rotational axis 38.

Figure 6:
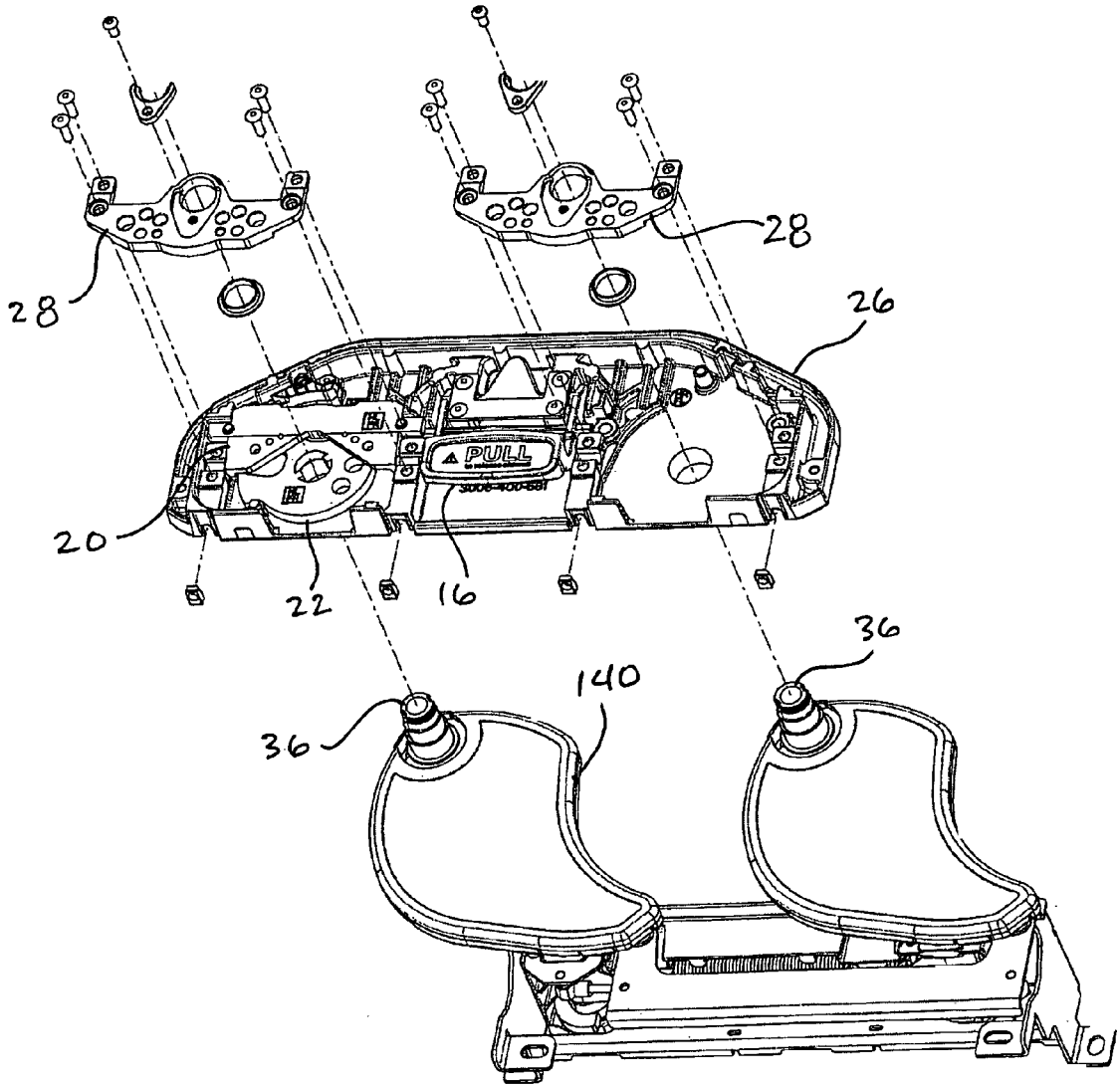
FIG. 6 is an exploded view of a portion of the siderail of FIG. 1, illustrating internal components of a siderail body.

Referring to FIGS. 6 and 7, as noted, cam disk face 40 includes one or more locking or latching or cooperating structures for cooperation with a corresponding cooperating structure formed or otherwise provided on latch plate 20 to lock siderail body 12 in a predetermined position. For example, cam disk 22 may include a void 42 (see e.g. FIGS. 8*a* and 9*a*) that is configured to releasably mesh or engage or interleave with a locking protrusion 44 (see e.g. FIGS. 8*a* and 9*a*) on latch plate 20, thereby preventing cam disk 22 from rotating. As will be more fully described below, cam disk 22 and latch plate 20 are adapted to cooperate to lock siderail body 12 in one or more predetermined positions. In the illustrated embodiment, void 42 is adapted to correspond with the raised position of siderail body 12 and cooperate with locking protrusion 44 to lock siderail body 12 in the raised position.

Figure 14A:
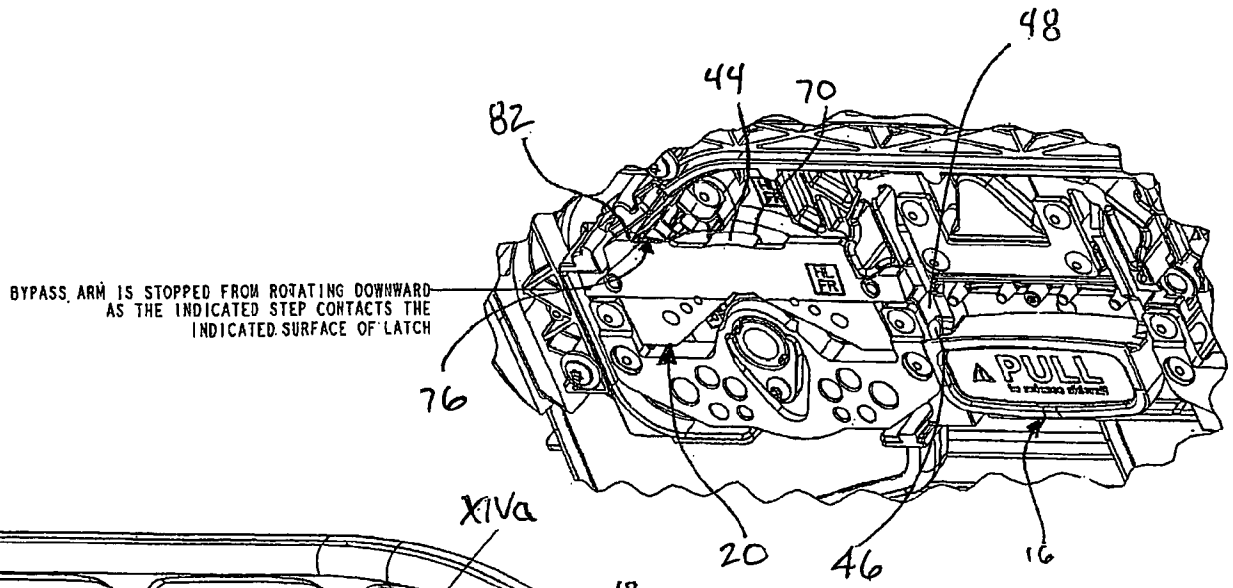
FIG. 14*a* is an enlarged view of detail XIVa of FIG. 14 illustrating the internal components of the siderail of FIG. 14.

As best seen in FIG. 7, latch plate 20 comprises a plate with a lateral extent or width that is sufficient to laterally extend across cam disk face 40 and with locking protrusion 44 projecting outwardly toward cam disk 22 for selective engagement with void 42. To control the engagement and disengagement of protrusion 44 with void 42, latch plate 20 is pivotally mounted to siderail body 12 at or near its lower edge by a pair of pivot posts 46 (FIGS. 7 and 14*a*). Posts 46 extend into and are received in a pair of bearing blocks or supports 48 (FIGS. 7 and 14*a*) formed or otherwise provided on siderail body 12 to thereby form a latch pivot axis 50, which is orthogonal to the rotational axis 38 of cam disk 22. In this manner, when latch plate 20 is pivoted about latch pivot axis 50 toward cam disk 22 and protrusion 44 is aligned with void 42, protrusion 44 can extend into void 42 and thereby couple latch plate 20 to cam disk 22 and arrest the rotation of cam disk 22 about rotational axis 38, in which arrangement the latch mechanism exhibits a locking configuration.

Figure 9A:
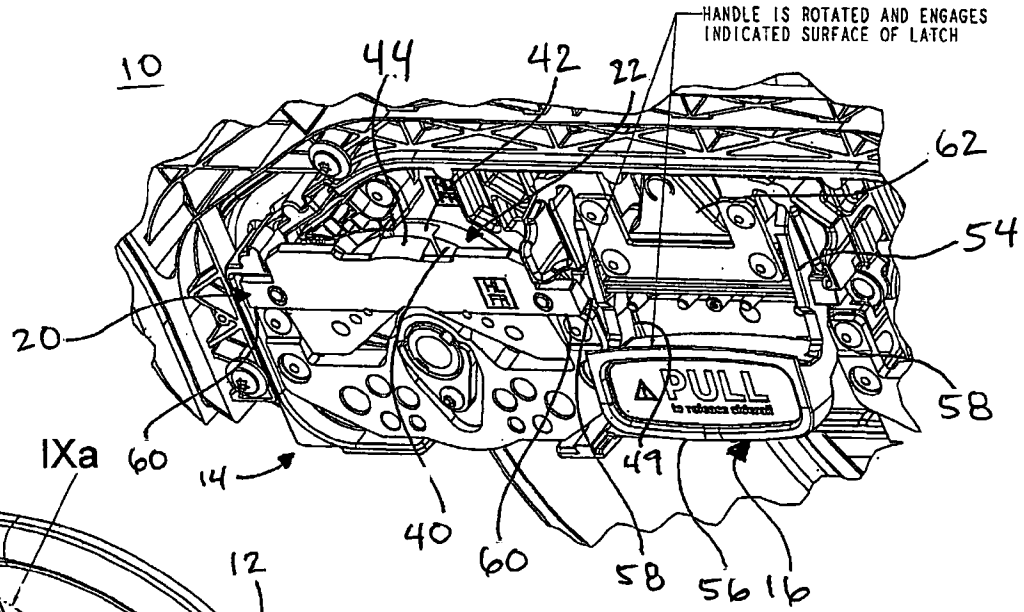
FIG. 9*a* is an enlarged view of detail IXa of FIG. 8 illustrating the internal components of the siderail of FIG. 9.
Figure 9:
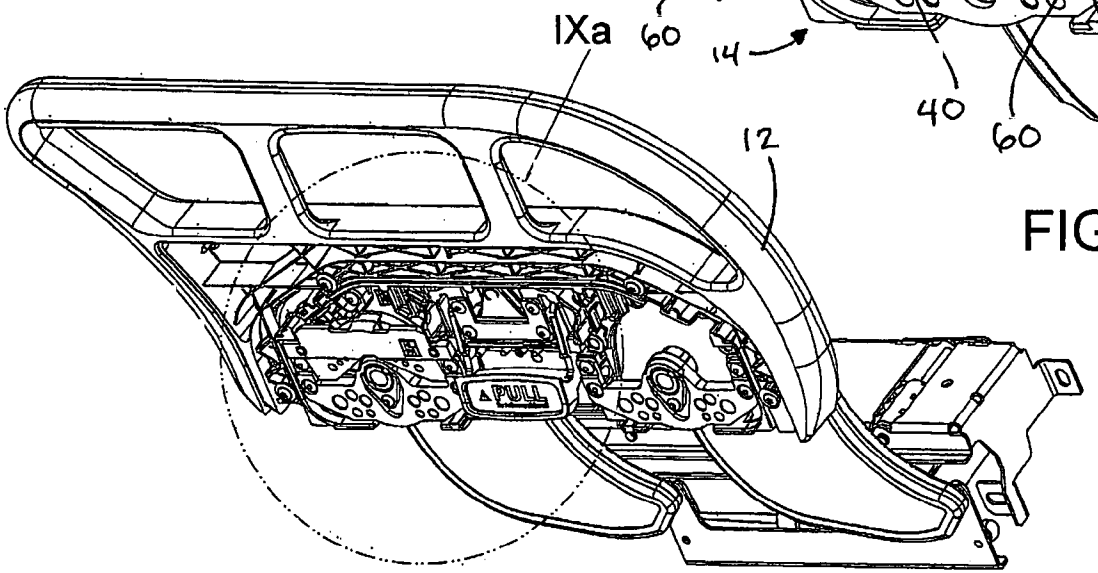
FIG. 9 is a similar view to FIG. 6 with the siderail shown in the raised and unlatched position.
Figure 9C:
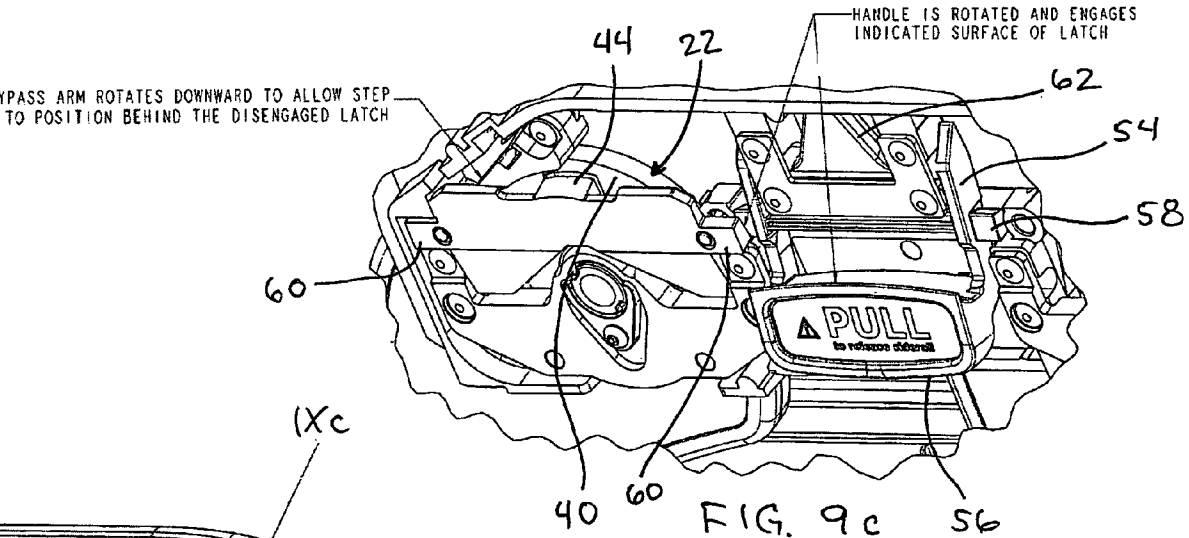
FIGS. 9*b* and 9*c* are similar views to FIGS. 9 and 9*a*, respectively, with some detail removed for clarity.
Figure 9B:
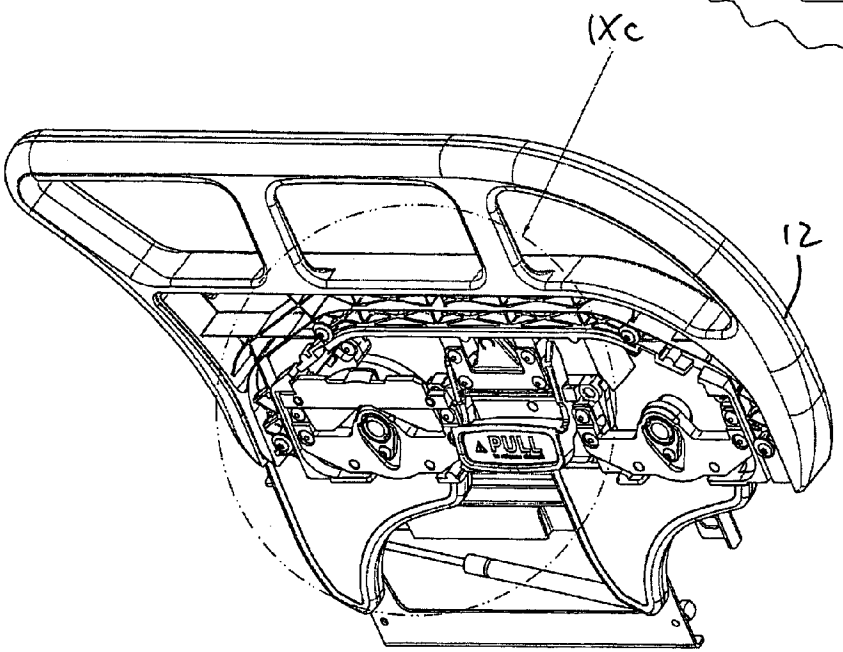

Referring now to FIGS. 9 and 9*a*, locking protrusion 44 is released from void 42 by pivoting handle 16 about a handle pivot axis 52 (FIG. 13*a*), thereby unlocking latching mechanism 14. As best seen in FIG. 7, handle 16 includes two handle arms 54 and a transverse member 56, forming a user portion, with the handle arms 54 mounted to mounting plate 26 in a pair of bearing block or supports 64 by a transverse pivot bar 55 (about pivot axis 52) and secured thereto by a bracket 66. In addition, handle 16 includes one or more handle protrusions 58 that extend laterally outward from arms 54 in a position between user portion 56 and pivot axis 52, which move in an arcuate path simultaneously with user portion 56 when handle 16 is pivoted about pivot axis 52. Handle protrusions 58 are provided to engage latch plate 20 and further to pivot latch plate 20 about its latch pivot axis 50.

In the illustrated embodiment, latch plate 20 includes a pair of laterally extending protrusions 60, in the form of flanges, which are engage able with protrusions 58 of handle 16. In this manner, when handle 16 is pivoted about axis 52, latch plate 20 is similarly pivoted about its pivot axis 50 and thereby moves latch plate 20 away from cam disk 22 and in turn moves protrusion 44 out of void 42. Optionally, handle 16 may include a handle stop 62, located opposite user portion 56 with respect to pivot axis 52, which is adapted to limit the range of pivotal motion of handle 16. As user portion 56 is moved distally from siderail body 12, handle stop 62 moves towards siderail body 12 so that when handle stop 62 contacts post 62*a* of mounting plate 26, user portion 56 cannot be further rotated. Optionally, user portion 56 of handle 16 may be biased towards mounting plate 26 by a handle biasing element 68 acting on handle stop 62 (FIG. 7).

As would be understood, therefore, pivot axis 52 of handle 16 is either substantially coaxial with or substantially parallel to latch pivot axis 50. When a user pulls on user portion 56, handle 16 pivots about pivot axis 52 and handle protrusion 58 moves distally or outwardly from siderail body 12 into contact with latch protrusion 60 to pivot latch plate 20 about latch pivot axis 50, thereby withdrawing or disengaging locking protrusion 44 from void 42 and thereby reconfiguring latch mechanism to a non-locking configuration. As noted, handle stop 62 may be provided to arrest further rotation of handle 16 after locking protrusion 44 is sufficiently clear of void 42.

Figure 10A:
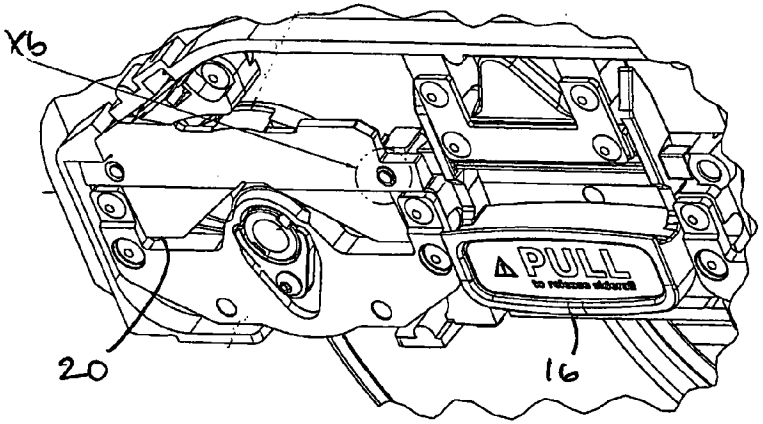
FIG. 10*a* is an enlarged view of detail Xa of FIG. 10.
Figure 10B:
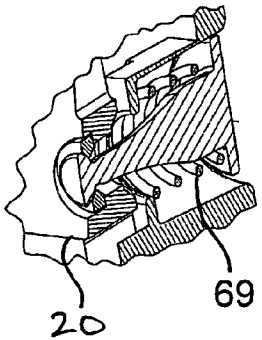
FIG. 10*b* is an enlarged cutaway view of detail Xb of FIG. 10*a*, illustrating the latch biasing element.
Figure 10:
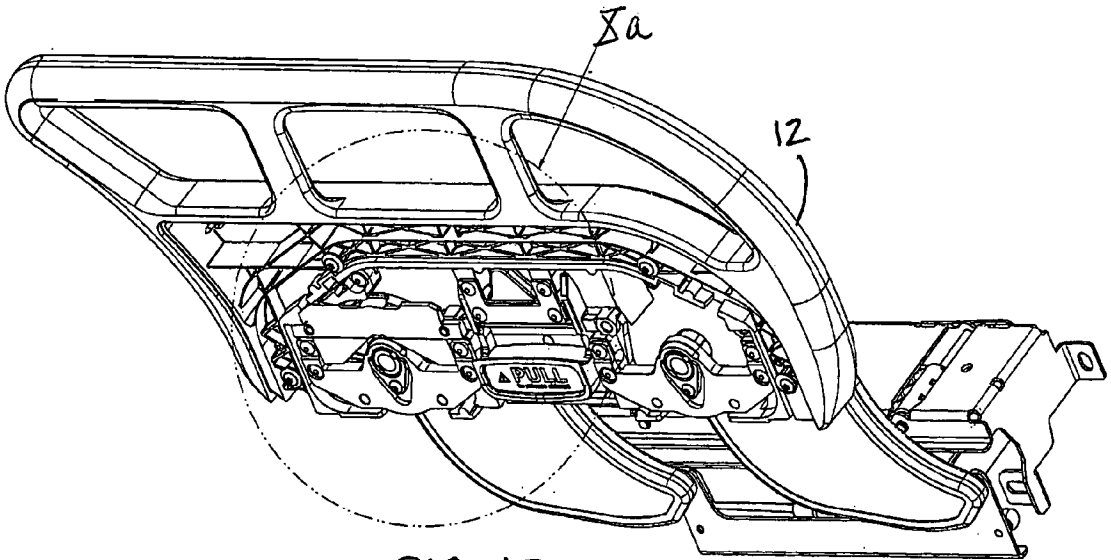
FIG. 10 is a similar view to FIG. 9 with the siderail moved to its full upright and locked position.

In order to urge latch plate 20 into engagement with cam disk 22, latch plate 20 is biased toward cam disk face 40 by at least one latch biasing member 69 (FIG. 10*b*) that urges latch plate 20 in the direction of cam disk face 40. Biasing member 68 continuously urges latch plate 20 towards cam disk 22, with latch plate 20 being restrained from contacting or coupling with cam disk 22 by intervening structures, such as handle 16 when it is held in its extended and disengaging position or by bypass arm 24. In the illustrated embodiment, two latch biasing elements 69 are used, each located substantially adjacent to latch protrusions 60. The use of two latch biasing elements 69 provides redundancy, ensuring that latching mechanism 14 will function properly even if one latch biasing element 14 fails. Further, because latch plate 20 operates independently of other components in latch mechanism 14 (such as cam disk 22 and bypass arm 24), misalignment or other malfunctioning of one component may not affect the function of latch plate 20 and biasing elements 69. Latch biasing element 69 may, for example, comprise a compression spring, an extension spring, a torsion spring, an elastic member, or the like.

Figure 11A:
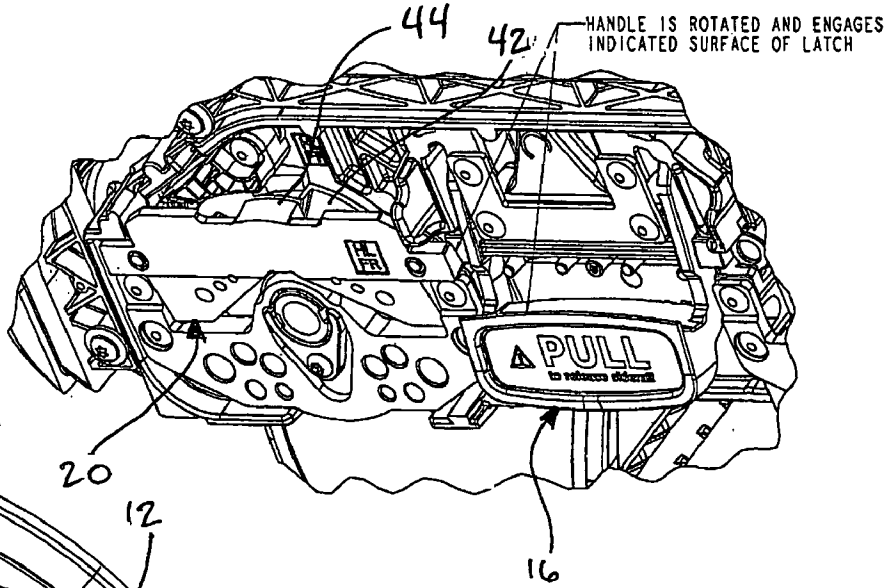
FIG. 11*a* is an enlarged view of detail XIa of FIG. 11 illustrating the internal components of the siderail of FIG. 11.
Figure 11:
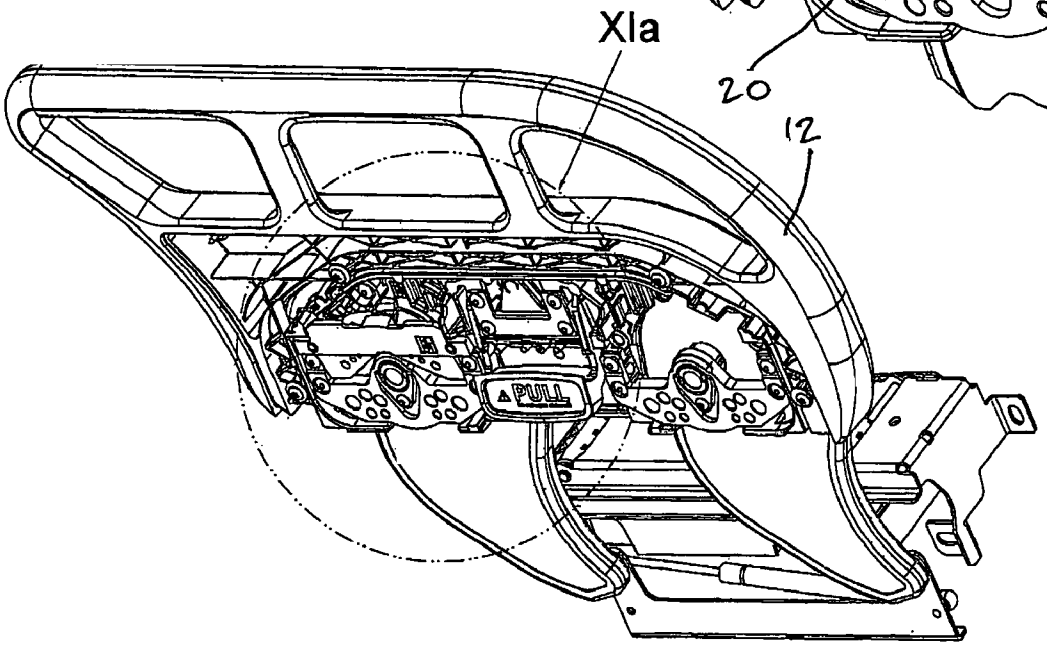
FIG. 11 is a similar view to FIG. 8, with the siderail shown in a position between the raised position and the intermediate position.
Figure 11C:
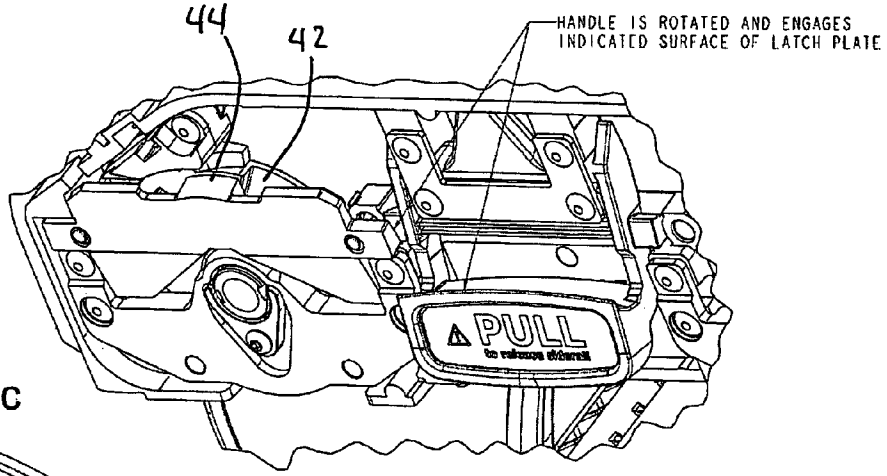
FIGS. 11*b* and 11*c* are similar views to FIGS. 11 and 11*a*, respectively, with some detail removed for clarity.
Figure 11B:
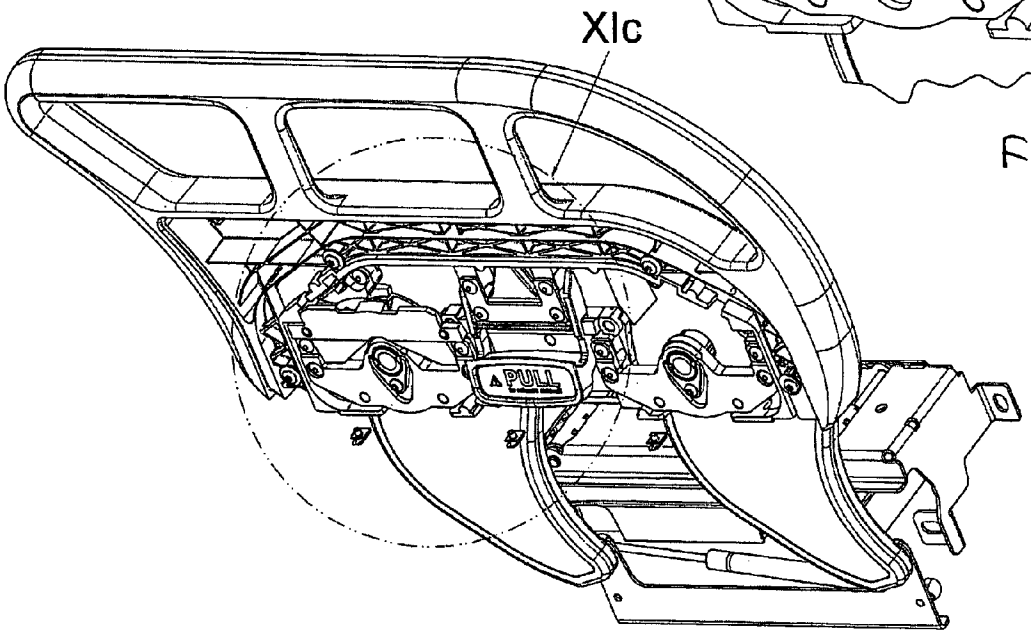

Referring now to FIGS. 11 and 11*a*, once locking protrusion 44 and void 42 are no longer meshed, cam disk 22 may rotate as siderail body 12 is moved away from the raised position toward the intermediate and lower positions. Rotation of cam disk 22 moves void 42 out of alignment with locking protrusion 44. Once locking protrusion 44 and void 42 are out of substantial alignment, user portion 56 of handle 16 can be released to allow latch biasing element 69 to move latch plate 20 into contact with cam disk 22, with locking protrusion 44 sliding on the face 40 of cam disk 22 as cam disk 22 rotates.

Figure 12:
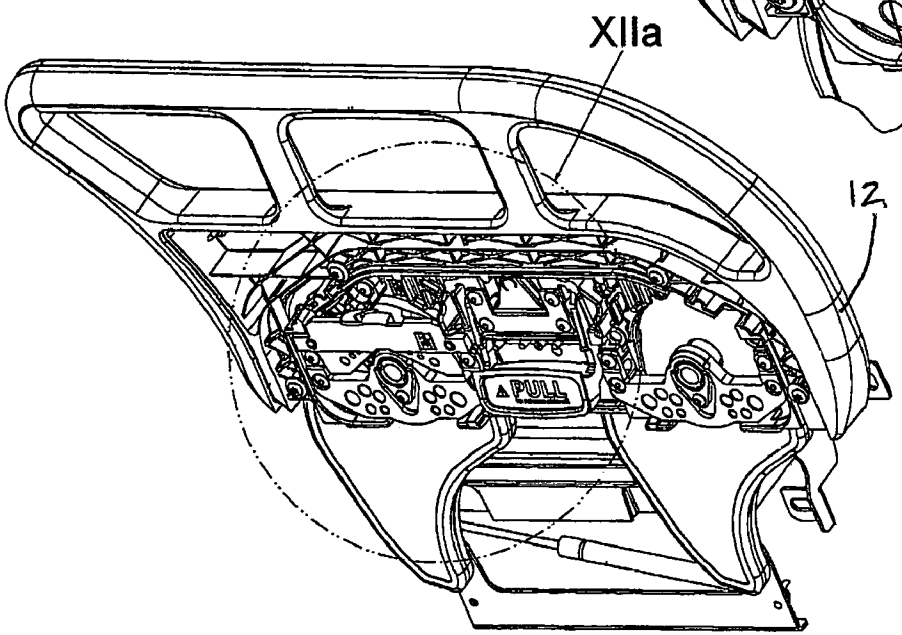
FIG. 12 is a similar view to FIG. 8, with the siderail shown closer to the intermediate position.
Figure 12C:
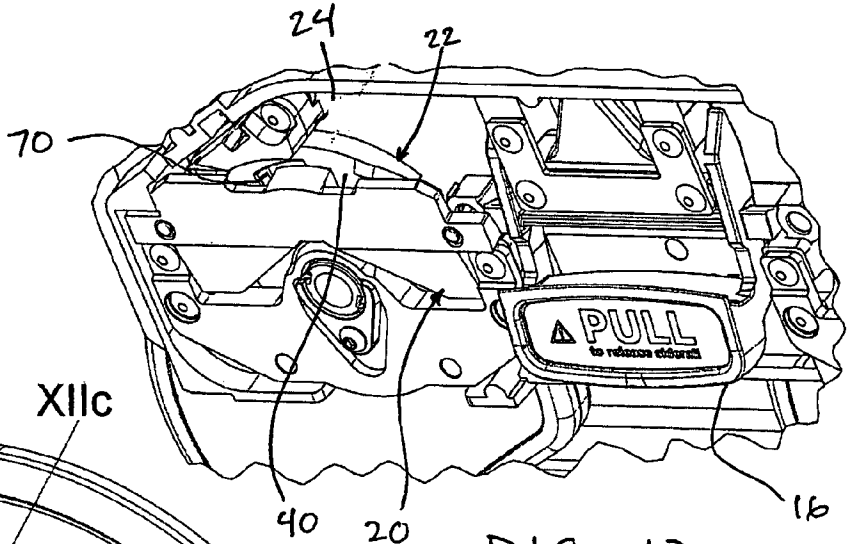
FIGS. 12*b* and 12*c* are similar views to FIGS. 12 and 12*a*, respectively, with some detail removed for clarity.
Figure 12B:
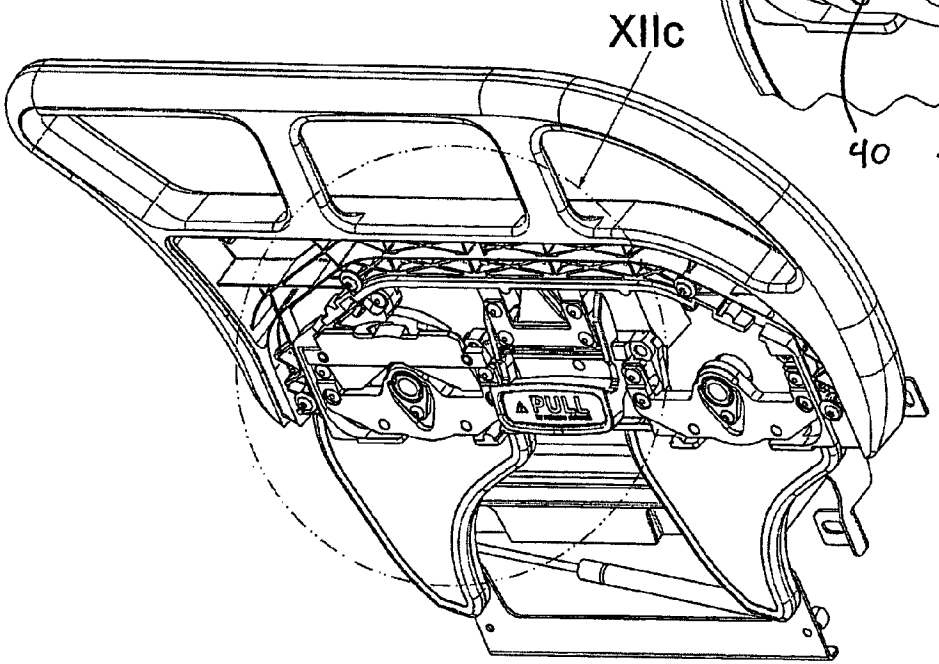

Referring now to FIGS. 12 and 12*a*, as siderail body 12 moves further towards the intermediate position (and hence cam disk 22 rotates), locking protrusion 44 approaches alignment with another void 70. Void 70 is positioned on cam disk 22 to substantially correspond with the intermediate position of siderail body 12. It should be understood that additional voids in cam disk 22 may optionally be positioned to allow locking of siderail body 12 in other positions. Similar to void 44, void 70 is located radially outward of axis 38, for example, in a range of ½ to 2 inches so that for a given force on siderail body 12, which results in a torque applied to shaft 36 when siderail body is in a locked position, the amount of force transmitted to the respective void and locking protrusion 44 can be reduced over prior art designs. Further, for a cam disk 22 with a sufficiently large diameter (and cam disk face 40 has a sufficiently large area) to allow location of the voids sufficiently far from axis 38 (for example in the described range), slop or play in siderail body 12 may be reduced.

In order to prevent locking protrusion 44 from extending into void 70 when siderail body 12 is raised from its lowered position (as described in detail below), locking mechanism 14 employs bypass arm 24. In the illustrated embodiment, bypass arm 24 is configured to block latch plate 20 from engaging cam disk 22 over a predetermined range of motion, such as the range corresponding to the intermediate position of siderail body 12. Although the intermediate position is described as optionally providing user ingress and/or egress while also remaining above the patient support surface, it should be understood that the intermediate position as used herein may be any position between the lowered and raised positions. Such range is controlled by the interaction between bypass arm 24 and cam disk 22.

Figure 25:
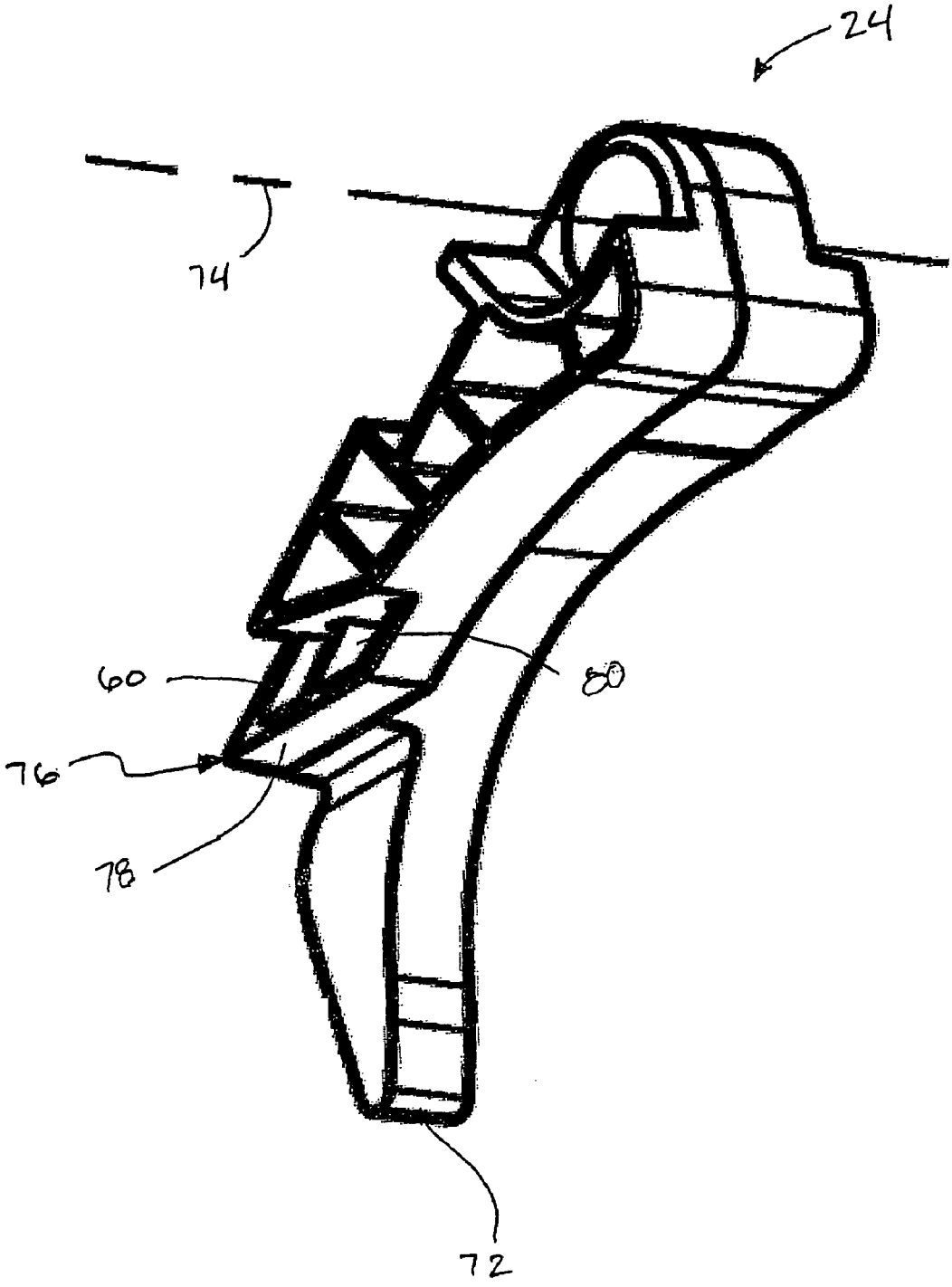
FIG. 25 is a perspective view of a bypass arm.

As best seen in FIG. 25, bypass arm 24 comprises an elongated member, which is pivotally mounted about a pivot axis 74 and includes a cam follower portion 72 at its distal end. Bypass arm 24 also includes a first stepped portion 76 with a first stop surface 78 and a second stop surface 80 to provide a stop for latch plate 20 and for the bypass arm more fully described below. The elongated member of the bypass arm 24 may be unitary with the stepped portion 76 formed during molding or by machining. Alternately, bypass arm 24 may be formed from two elongate members joined together with the stepped portion formed at the juncture of the two members. Bypass arm 24 may further include an arm biasing element 84 (FIGS. 7, 13*a*, and 13*b*) operable to bias cam follower 72 in the direction of cam disk 22. Arm biasing element 84 may, for example, be a compression spring, an extension spring, a torsion spring, an elastic member, or the like or a combination thereof.

Figure 13A:
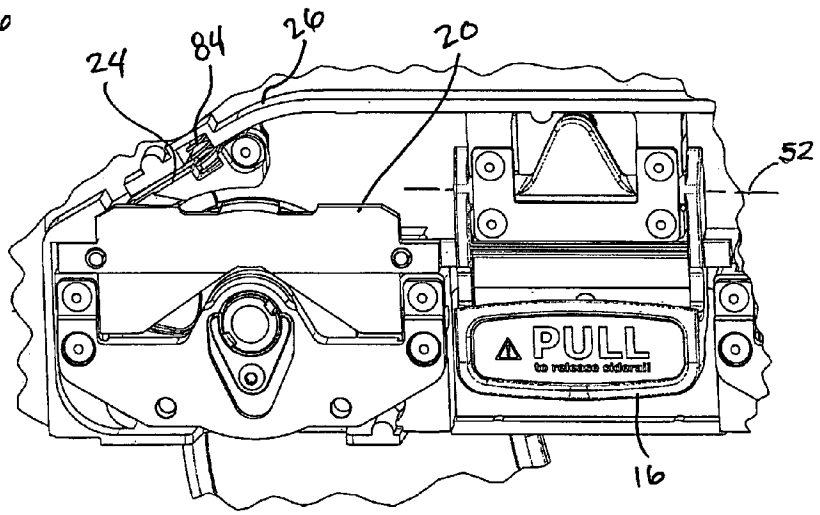
FIG. 13*a* is an enlarged view of detail XIIIa of FIG. 13 illustrating the internal components of the siderail of FIG. 13, taken from an angle closer to a side elevation.
Figure 13B:
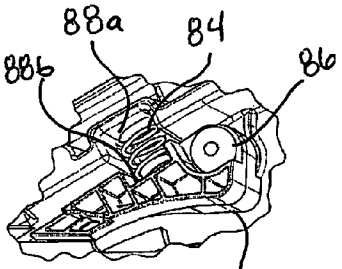
FIG. 13*b* is an enlarged view of detail XIIIb of FIG. 13*a*, illustrating a biasing element.
Figure 13:
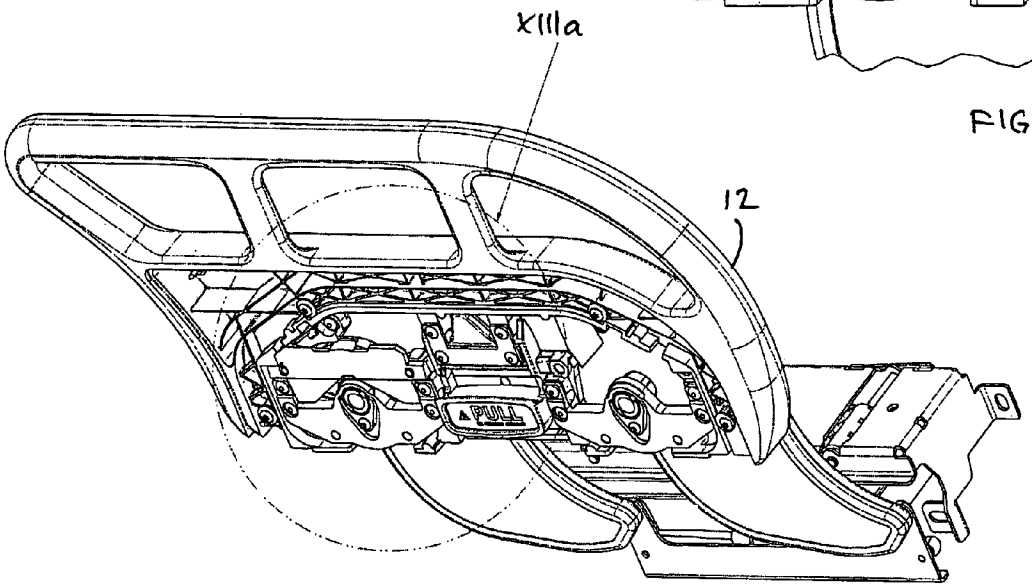
FIG. 13 is a similar view as FIG. 9 illustrating the arm biasing element.

As best seen in FIGS. 13*a* and 13*b*, bypass arm 24 pivotally mounts to mounting plate 26 above cam disk 22 at a predetermined attachment point on mounting plate 26. Such attachment point may comprise a threaded attachment adapted to receive a bolt or other axle 86. Accordingly, axle 86 pivotably attaches bypass arm 24 to mounting plate 26. Further, because bypass arm 24 is cantilevered from its pivot axis, gravity will also urge or bias arm 24 in the direction of cam disk 22. In addition, according to the illustrated embodiment, arm biasing element 84 is a conventional coil spring positioned to span a recess 88*a* formed in mounting plate 26 on one end and a recess 88*b* formed in bypass arm 24 on the other end (FIGS. 13-13*b*). In this manner, the biasing element is laterally restrained at both its ends in plate 26 and bypass arm 24.

As best understood from FIGS. 2 and 3*a*-3*c*, cam follower 72 interacts with cam disk 22 as cam disk 22 rotates. More specifically, cam follower 72 follows a cam lobe 90 located substantially about the perimeter of cam disk 22, which is configured to cause bypass arm 24 to pivot about bypass arm axis 74. Further, as siderail body 12 is moved from the raised position to a position between the raised position and the intermediate position (illustrated, for example, in FIG. 12), cam follower 72 remains in substantial contact with cam lobe 90, which is configured to keep biasing arm 24 positioned so that stop surface 78 of arm 24 no longer blocks latch plate 22 from being urged into engagement with cam plate 24.

Figure 14:
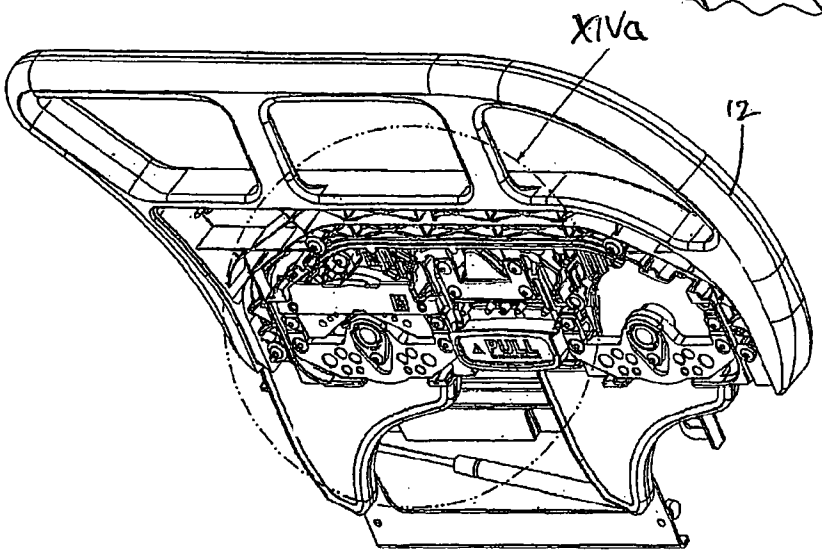
FIG. 14 is a similar view to FIG. 8 with the siderail shown in the intermediate and latched position.
Figure 14C:
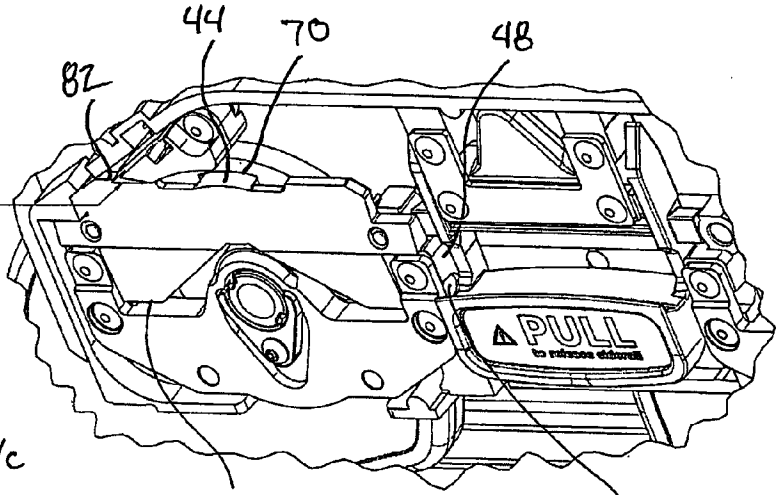
FIGS. 14*b* and 14*c* are similar views to FIGS. 14 and 14*a*, respectively, with some detail removed for clarity.
Figure 14S:
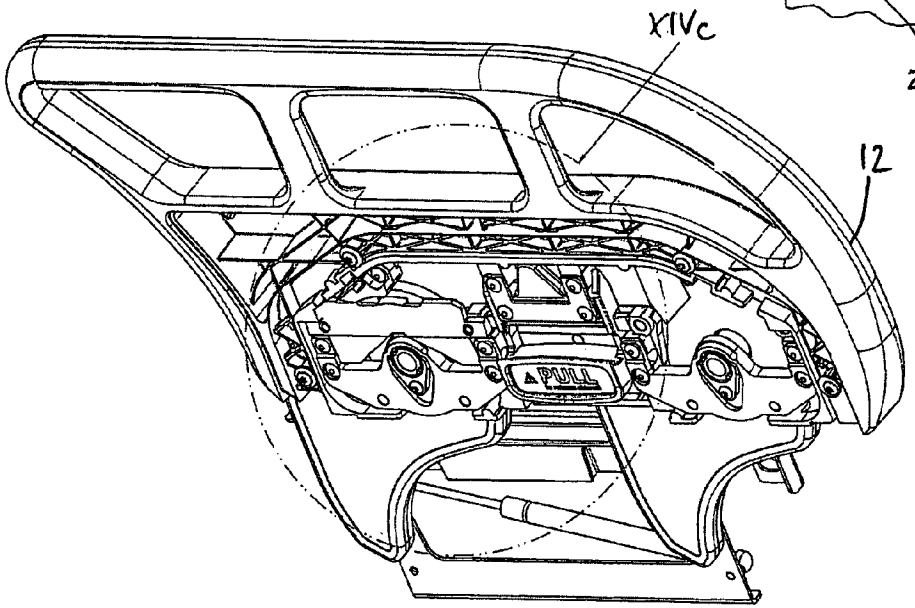

Referring now to FIGS. 14 and 14*a*, as siderail body 12 is moved into the intermediate position (and cam disk 22 rotates further) from the direction of the raised position, cam follower 72 guided by cam lobe 90 pivots bypass arm 24 to move first stop surface 78 of stepped portion 76 into contact with an upper edge 82 of latch plate 20, thereby maintaining bypass arm 24 in position so that with continued rotation of cam disk 22 disengages the contact between cam follower 72 and cam lobe 90 and cam follower 72 is no longer follows cam lobe 90. As siderail body 12 moves into the intermediate position, latch plate 20, which is biased toward cam plate, is then free to move toward cam disk 22 so that protrusion 44 can move into void 70. Thus, when locking protrusion 44 is in substantial alignment with void 70 as siderail body 12 and cam disk 22 continue to rotate further along the path from the raised position to the lowered position, latch biasing element 69 urges locking protrusion 44 to mesh with void 70, thereby coupling latch plate 20 and cam disk 22 and locking siderail body 12 in the corresponding intermediate position. Thus, as siderail body 12 is moved from the raised position to the intermediate position, latching plate 20 is no longer blocked by bypass arm 24, which allows latching mechanism 14 to automatically lock siderail body 12 in the intermediate position. It should be noted that this reconfiguration of the bypass arm 24 from a blocking position (where the bypass arm prevents the latch plate from interlocking with the cam disk) to a non-blocking position (where the latch plate is free to move into engagement and interlock with the cam disk) occurs once the siderail is moved past the intermediate position. However, this locking in the intermediate position occurs only if handle 16 is not in its unlocking or releasing position and has been returned to its normally non-releasing position. Should handle 16 continue to be held in its unlocking position, latching mechanism 14 will not lock at the intermediate position regardless of the direction of travel of siderail body 12.

Figure 15A:
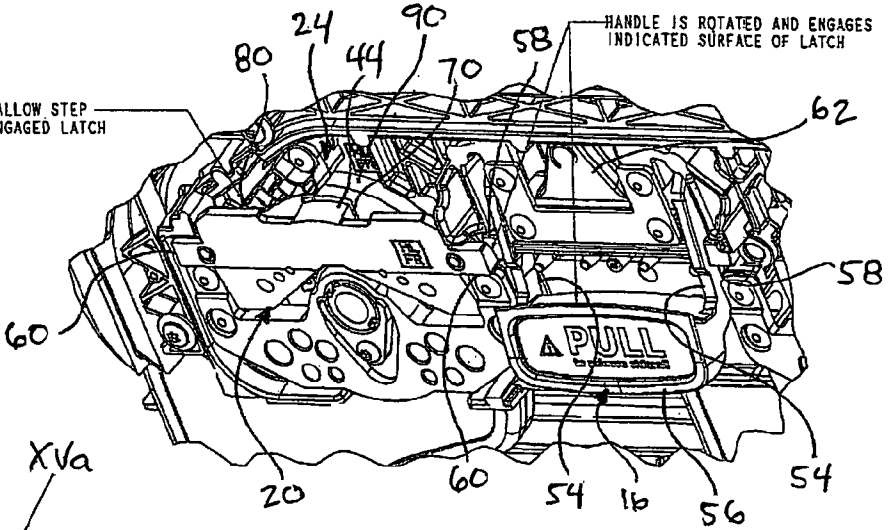
FIG. 15*a* is an enlarged view of detail XVa of FIG. 15 illustrating the internal components of the siderail of FIG. 15.
Figure 15:
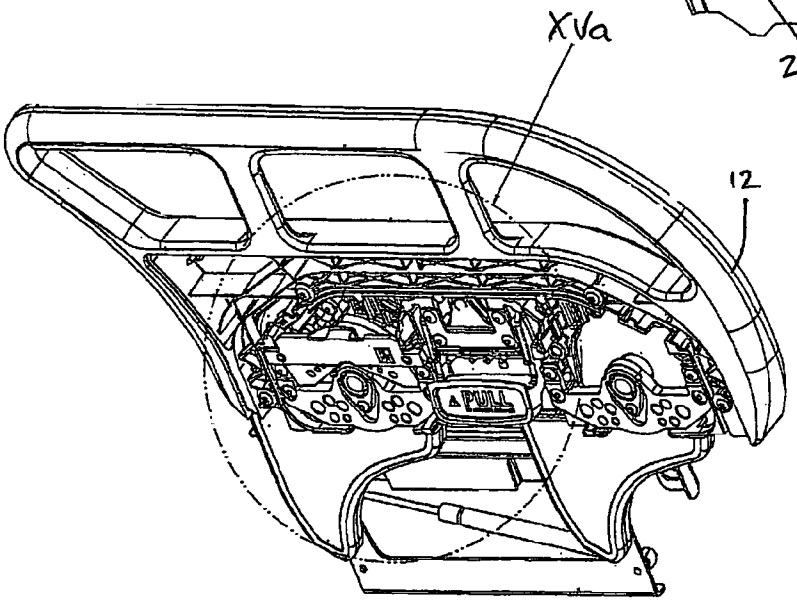
FIG. 15 is a similar view to FIG. 8 with the siderail shown in the intermediate and unlatched position.
Figure 15C:
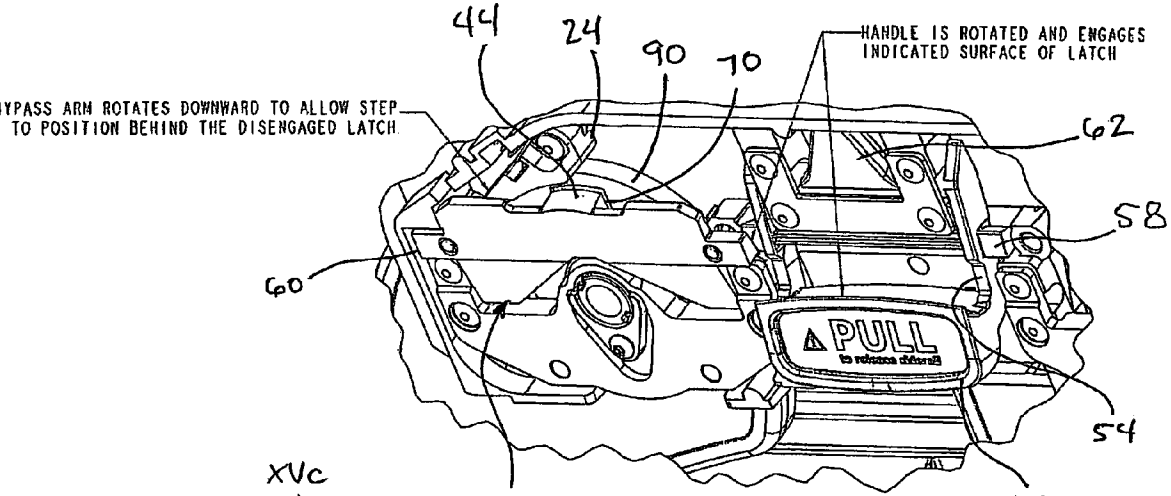
FIGS. 15*b* and 15*c* are similar views to FIGS. 15 and 15*a*, respectively, with some detail removed for clarity.
Figure 15B:
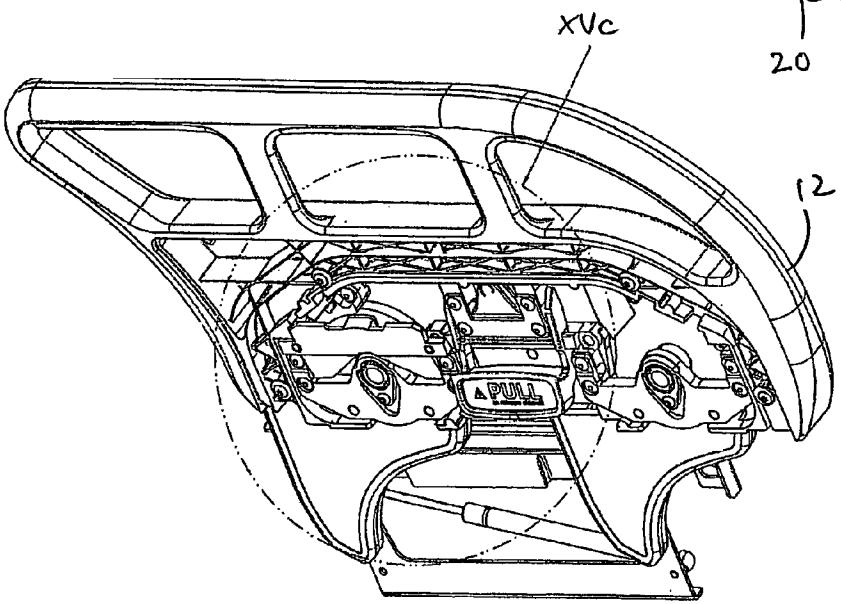

Referring now to FIGS. 15 and 15*a*, when latch plate 20 is disengaged from void 70 using handle 16 and latch plate 20 pivots away from cam disk face 40 (as described above), first stop surface 78 of stepped portion 76 is disengaged from edge 82 and spring 84 again biases bypass arm 24 toward cam disk 22. Free of the restraint against movement posed by such engagement, bypass arm 24 rotates about bypass arm axis 74 (urged by arm biasing element 84 and/or gravity) so that cam follower 72 comes back in to contact with cam lobe 90 and second stop surface 80 is positioned to block latch plate 20 from moving toward cam disk face 40 and further engage a latch surface 92 (FIG. 24) provided on plate 20.

Second stop surface 80 and latch surface 92 are substantially planar surfaces, substantially parallel to the plane of cam disk face 40. As latch plate 20 pivots, latch plate 20 is guided by a projection 94, which rides on the surface of cam disk 22, so that when the plane of second surface 80 comes into alignment with the plane of second latch surface 92, bypass arm 24 is pivoted toward cam disk 22, and the two surfaces contact. Thus, in this configuration of latching mechanism 14, stepped portion 76 of bypass arm 24 once again blocks the movement of latch plate 20 and prevents locking protrusion 44 from meshing with void 70, even if locking protrusion 44 and void 70 are substantially aligned. Bypass arm 24 thus poses a physical barrier to movement of latch plate 20, securely preventing rotation of latch plate 20 towards cam disk face 40.

As noted above, latch plate 20 may further include a protrusion 94 operable to engage cam lobe 90 at a position between the intermediate and lowered positions to ensure the desired engagement of second surface 80 and second latch surface 92, thereby providing redundancy for ensuring proper engagement of bypass arm 24. For example, if latch plate 20 is sufficiently pivoted (via handle 16) about latch pivot axis 50 to disengage locking protrusion 44 from void 70, but latch plate 20 is not sufficiently pivoted to allow bypass arm 24 to pivot downwardly for engagement of second surface 80 of stepped portion 76 with second latch surface 92 (as described above), protrusion 94 engages cam lobe 90 as cam disk 22 is rotated away from the intermediate towards the lowered position, and cam lobe 90 pushes latch plate 20 via protrusion 94 to pivot latch plate 20 sufficiently far from cam disk face 40 to allow bypass arm 24 to pivot downwardly so that second surface 80 contacts and second latch surface 92. Further, in the illustrated embodiment protrusion 94 is positioned on latch plate 20 so that bypass arm 24 pivots downwardly soon after siderail body 12 is moved away from the intermediate position toward the lowered position, thereby activating the bypass feature of siderail 10 without fully lowering siderail body 12. As noted above, the bypass feature is disabled once the siderail body 12 is raised past its intermediate position.

Figure 16A:
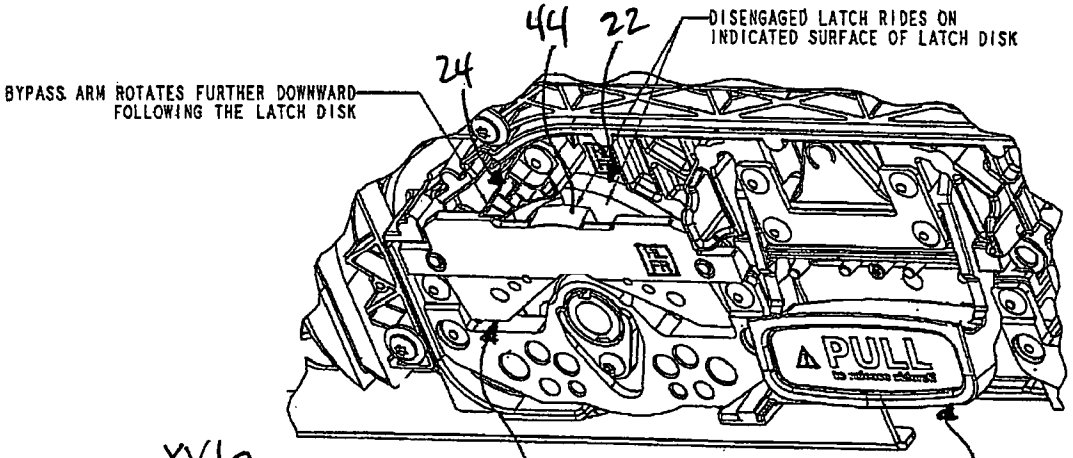
FIG. 16*a* is an enlarged view of detail XVIa of FIG. 16 illustrating the internal components of the siderail of FIG. 16.
Figure 16:
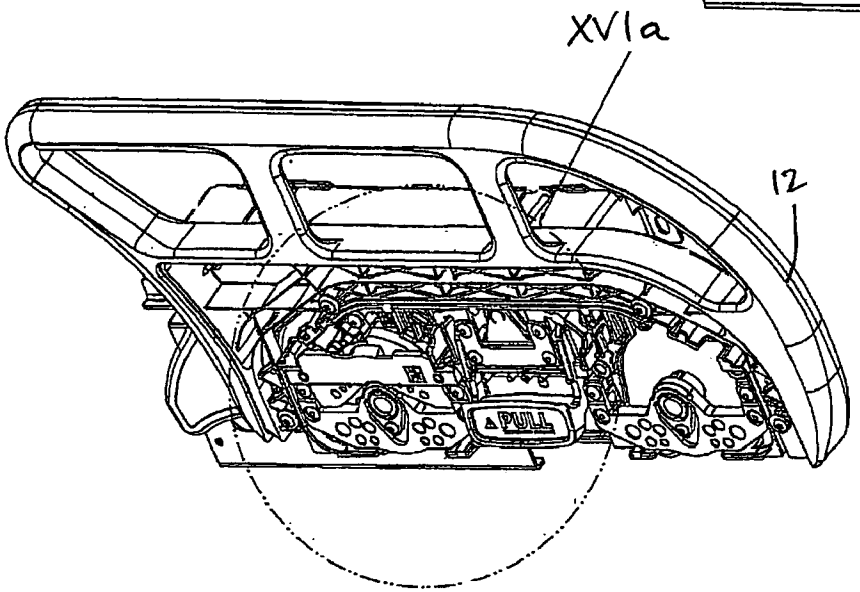
FIG. 16 is a similar view to FIG. 8, with the siderail shown in a position between the intermediate position and the lowered position.
Figure 16C:
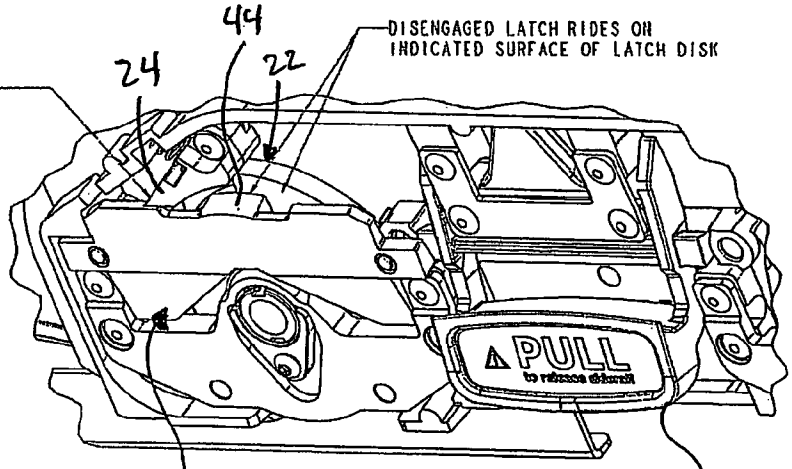
FIGS. 16*b* and 16*c* are similar views to FIGS. 16 and 16*a*, respectively, with some detail removed for clarity.
Figure 16B:
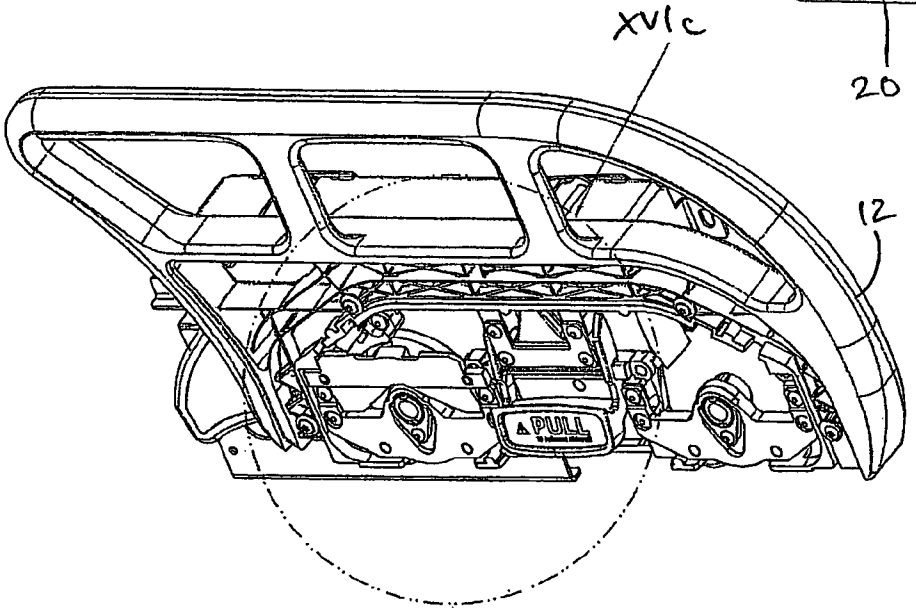

Referring now to FIGS. 16 and 16*a*, as siderail body 12 is further rotated from the intermediate position of FIG. 15 to the lowered position of FIG. 16, latching mechanism 14 remains in an unlocked configuration. Thus, siderail body 12 free-floats between the lowered position and the intermediate position, and no manipulation of handle 16 is required to raise or lower siderail body 12 in such range. Additionally, cam lobe 90 remains in substantial contact with cam follower 72 in this range.

Figure 17A:
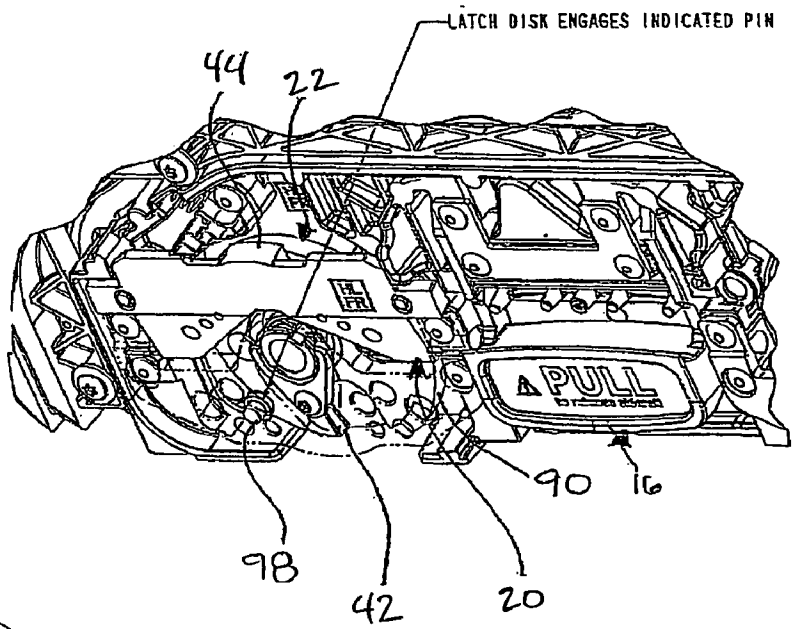
FIG. 17*a* is an enlarged view of detail XVIIa of FIG. 17 illustrating the internal components of the siderail of FIG. 17.
Figure 17:
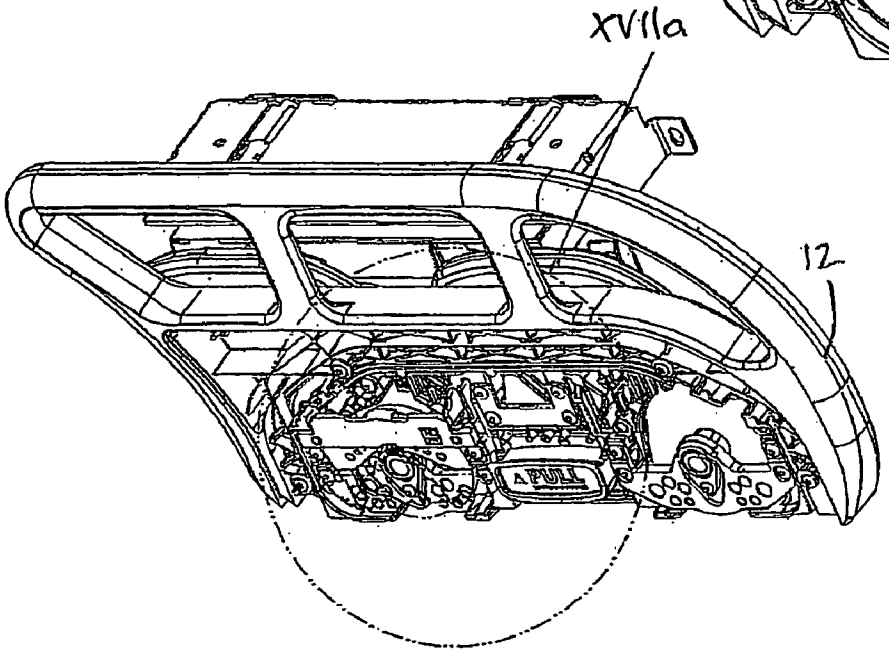
FIG. 17 is a similar view to FIG. 8, with the siderail shown in the lowered position.
Figure 18A:
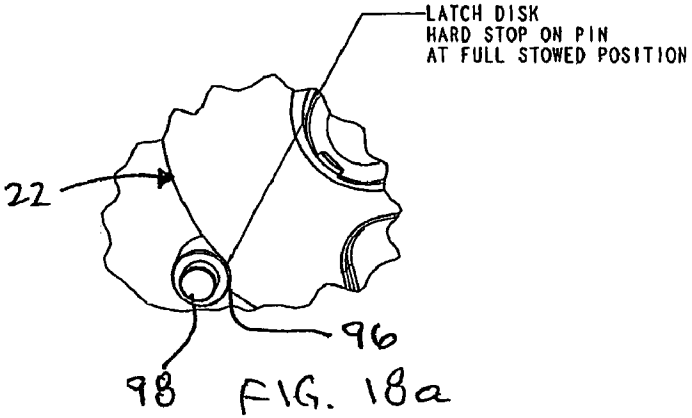
FIG. 18*a* is an enlarged view of detail XVIIIa of FIG. 18 illustrating the internal components of the siderail of FIG. 18.
Figure 18:
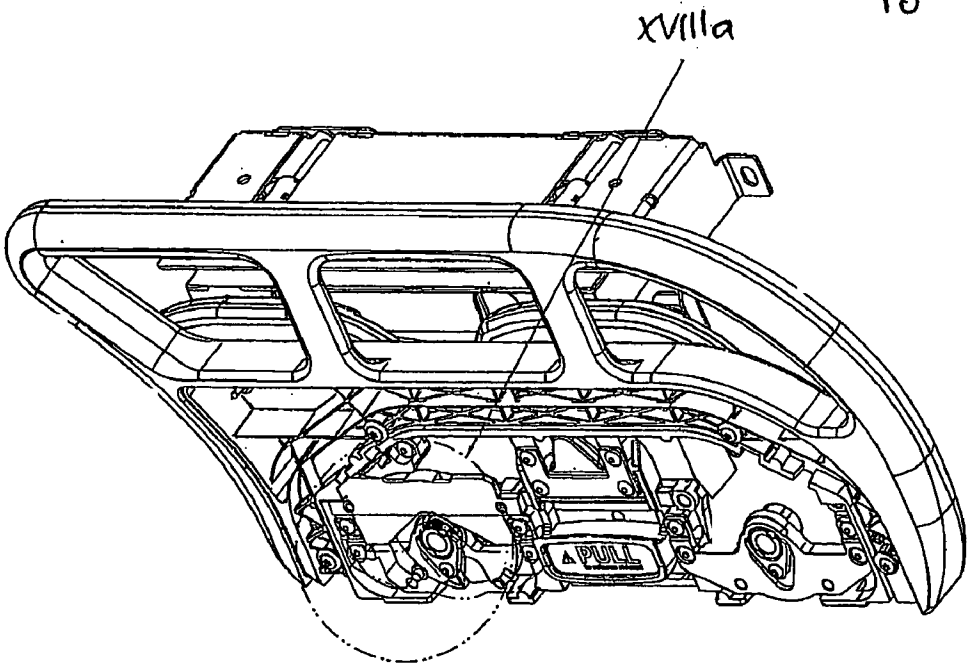
FIG. 18 is a similar view to FIG. 17.
Figure 19A:
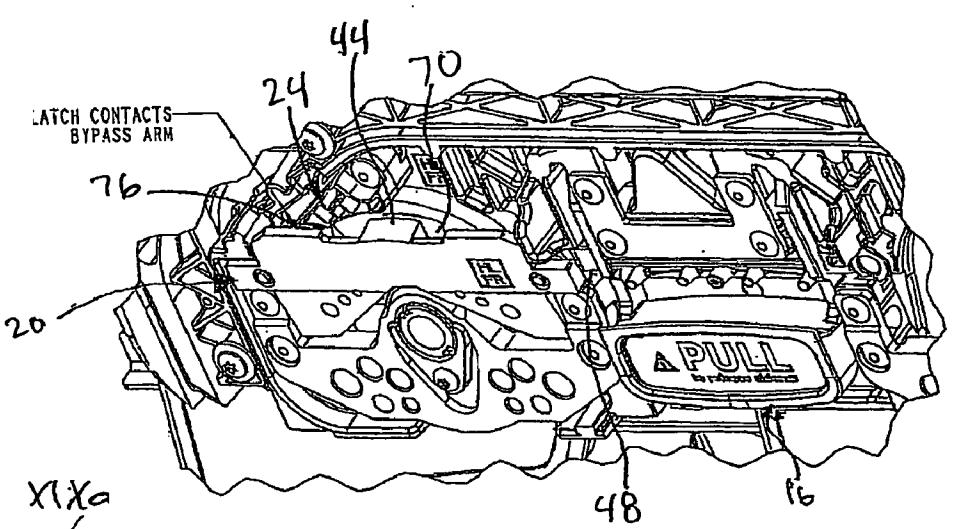
FIG. 19*a* is an enlarged view of detail XIXa of FIG. 19 illustrating the internal components of the siderail of FIG. 19.
Figure 19:
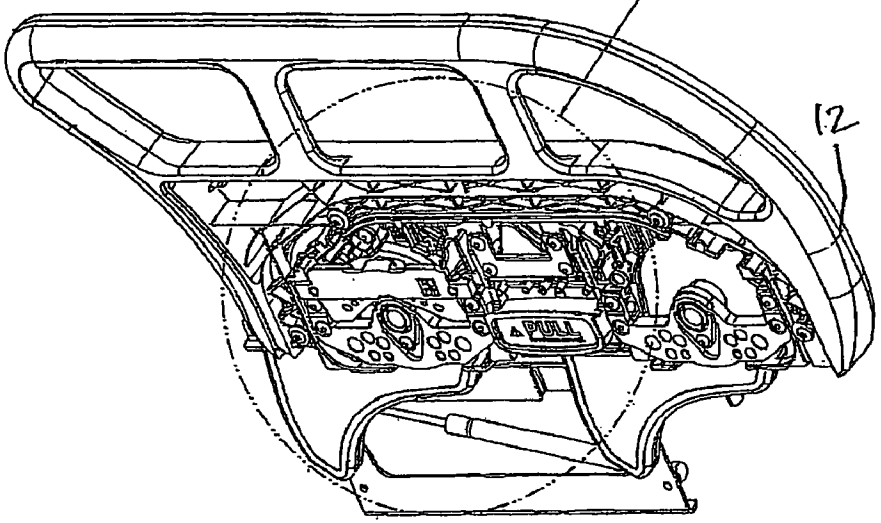
FIG. 19 is a similar view to FIG. 8 with the siderail shown approaching the intermediate position from the stowed position.
Figure 19C:
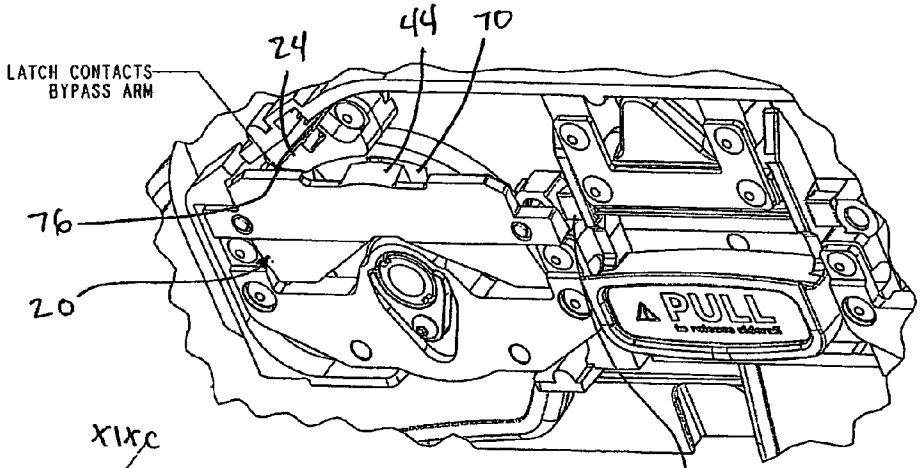
FIGS. 19*b* and 19*c* are similar views to FIGS. 19 and 19*a*, respectively, with some detail removed for clarity.
Figure 19B:
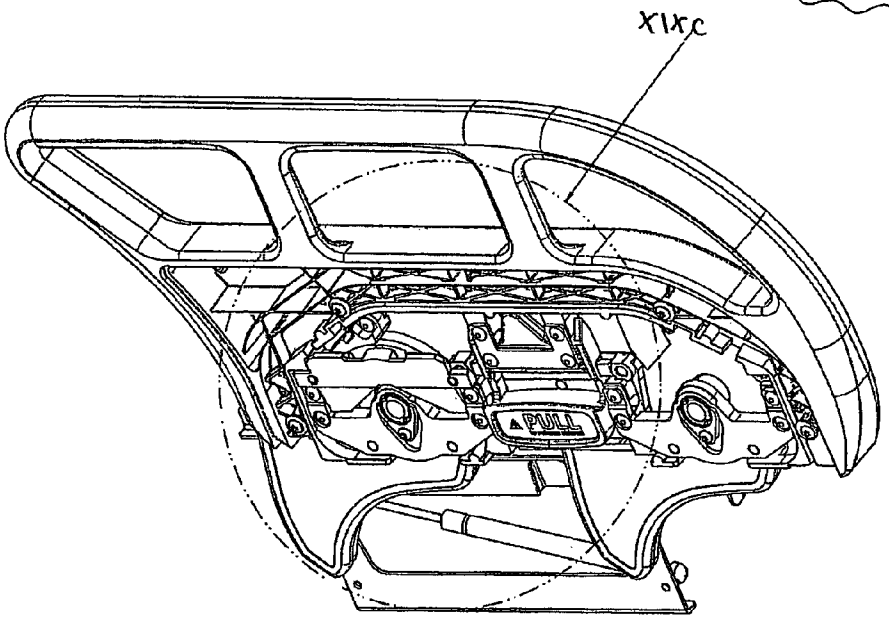
Figure 20A:
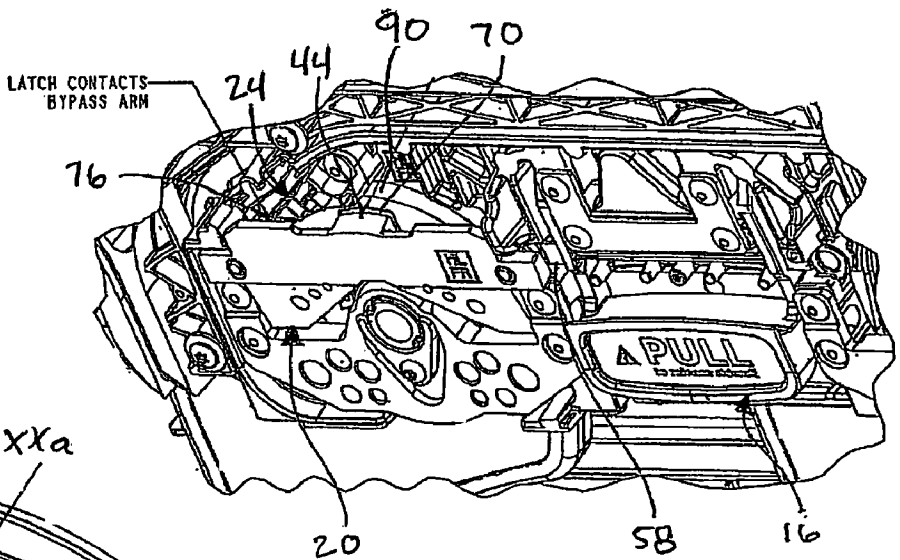
FIG. 20*a* is an enlarged view of detail XXa of FIG. 20 illustrating the internal components of the siderail of FIG. 20.
Figure 20:
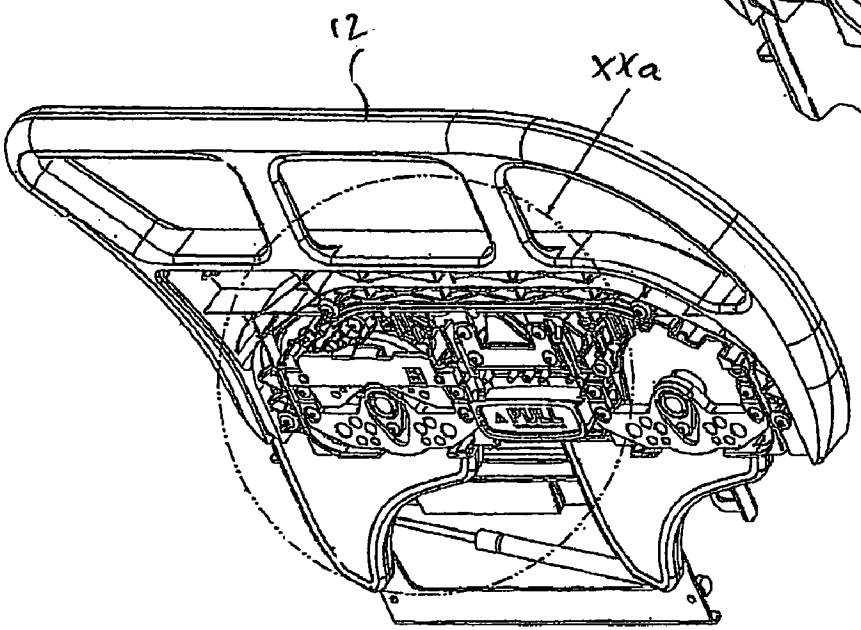
FIG. 20 is a similar view to FIG. 8, with the siderail shown in the intermediate position with the bypass arm engaged.
Figure 20C:
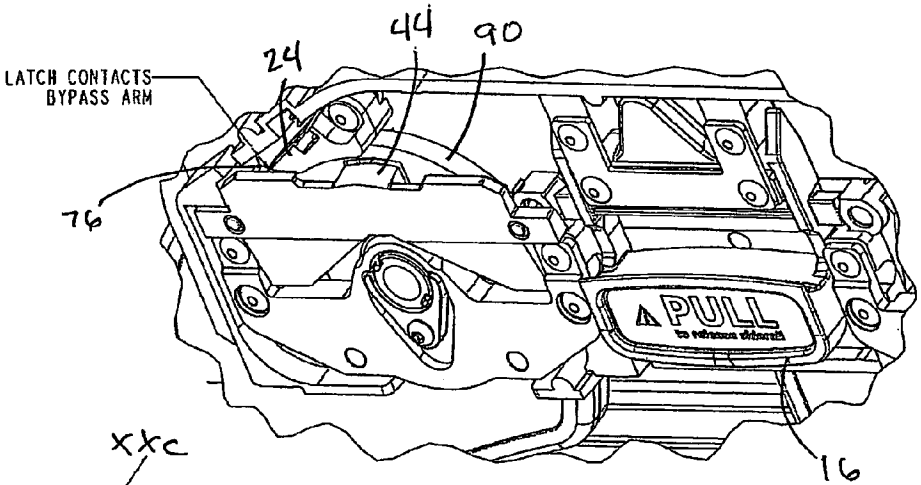
FIGS. 20*b* and 20*c* are similar views to FIGS. 20 and 20*a*, respectively, with some detail removed for clarity.
Figure 20B:
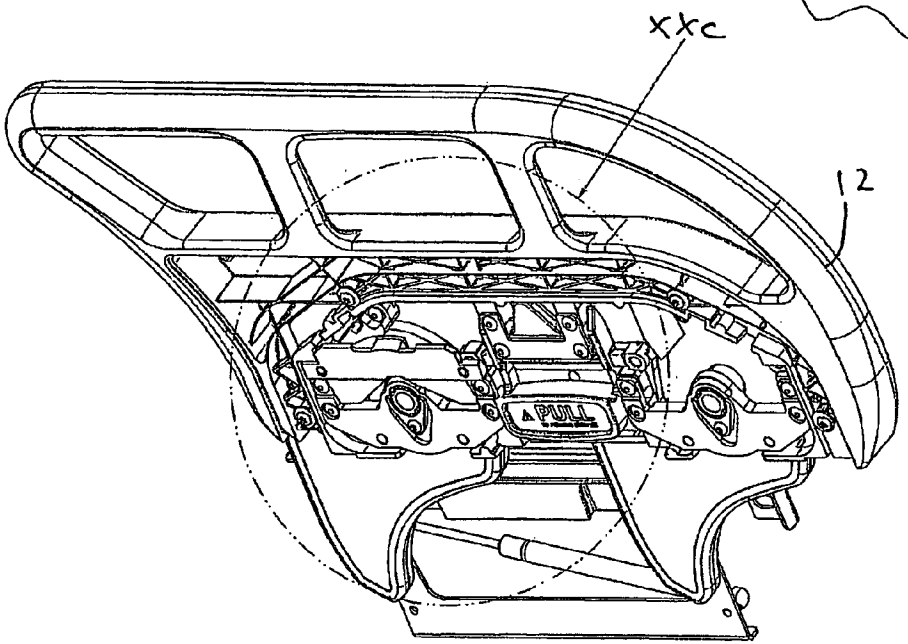

Referring now to FIGS. 17 and 17*a*, siderail body 12 reaches the lowered position when cam disk 22 reaches a lowered stop position. Cam disk 22 may include a lower step 96 (FIGS. 7, 18*a*) operable to engage a pin or protrusion or other protuberance 98, which is mounted to mounting plate 26, to arrest further rotation of cam disk 22. Thus, the positions of lower step 96 on cam disk 22 and pin 98 define the lowered position of siderail body 12 and prevent movement of cam disk 22 beyond the lowered stop position. In the illustrated embodiment, lower step 96 is located on the perimeter of cam disk 22 and comprises a portion of cam lobe 90. It will be apparent to the skilled artisan, lower step 96 may take a variety of other forms without departing from the principles of the present invention, such as features on a face of cam disk 22 or features attached to siderail body 12.

Figure 21:
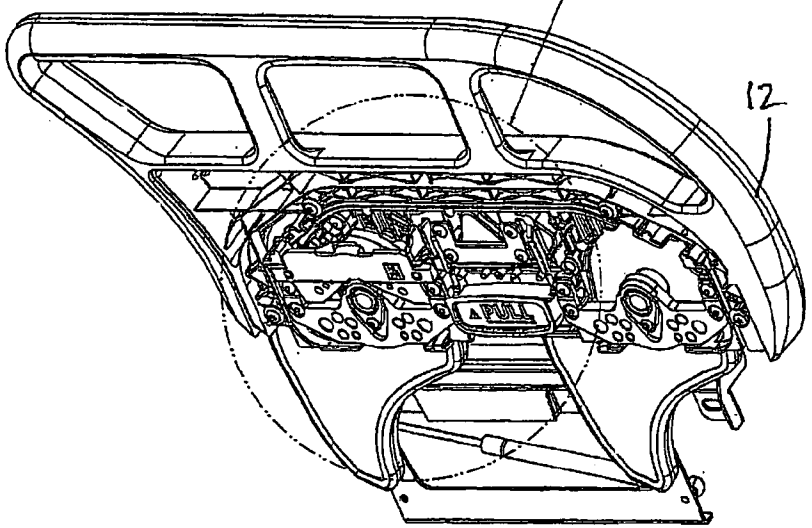
FIG. 21 is a similar view to FIG. 8, with the siderail shown in a position past the intermediate position.
Figure 21C:
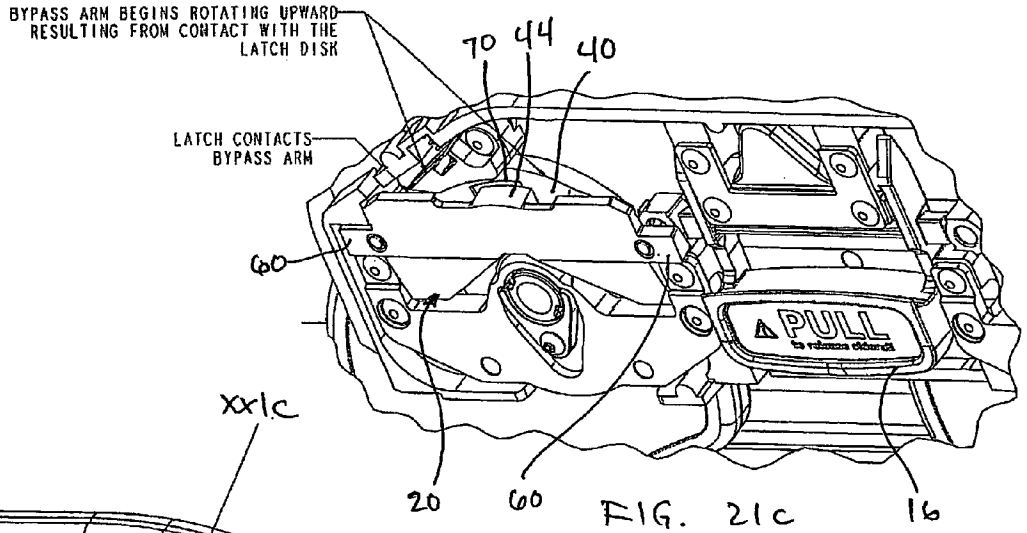
FIGS. 21*b* and 21*c* are similar views to FIGS. 21 and 21*a*, respectively, with some detail removed for clarity.
Figure 21B:
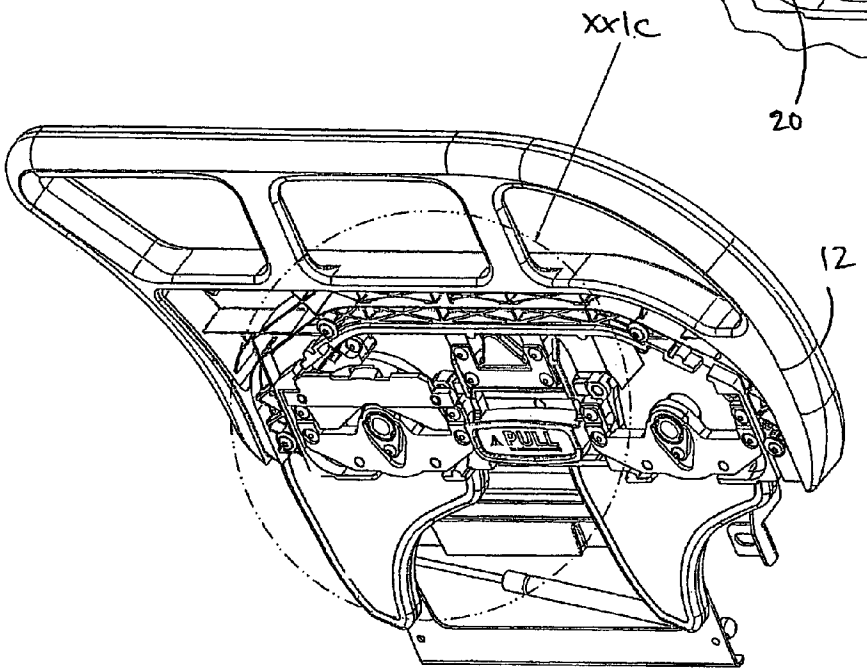

Referring now to FIGS. 19-21*a*, as siderail body 12 is moved from the lowered position through the intermediate position, latch plate 20 engages or is blocked by bypass arm 24. The engagement occurs through a range of motion of siderail body 12 that includes positions: i) just prior to the intermediate position (FIG. 19); ii) at the intermediate position (FIG. 20); and iii) just past the intermediate position (FIG. 21). The interaction between latch plate 20 and bypass arm 24 restrains locking protrusion 44 from meshing with void 70. Specifically, when second stop surface 80 of stepped portion 76 blocks latch plate 20, the physical barrier posed by second surface 80 prevents latch plate 20 from moving towards cam disk 22. Thus, as siderail body 12 is moved from the lowered position through the intermediate position towards the raised position, latching mechanism 14 bypasses the locked configuration in the intermediate position.

Figure 22A:
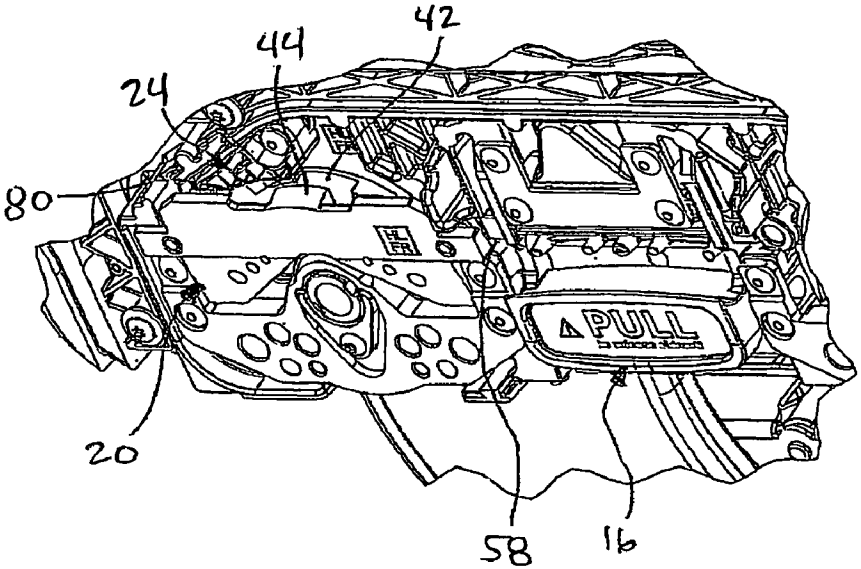
FIG. 22*a* is an enlarged view of detail XXIIa of FIG. 22 illustrating the internal components of the siderail of FIG. 22.
Figure 22:
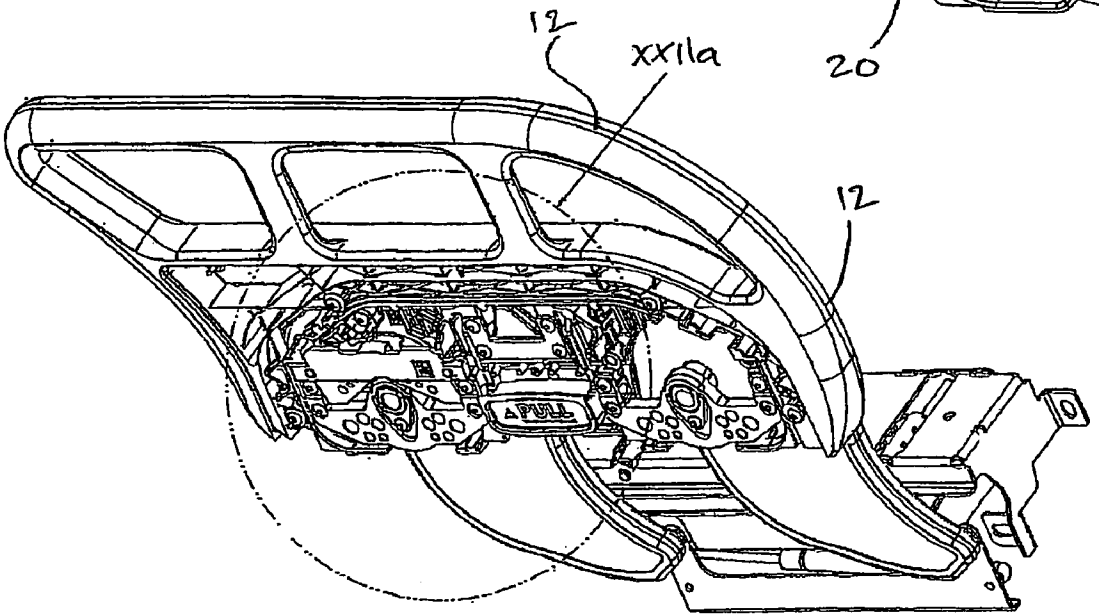
FIG. 22 is a similar view to FIG. 8, with the siderail shown in a position approaching the raised position from the intermediate position with the bypass arm disengaged.
Figure 22C:
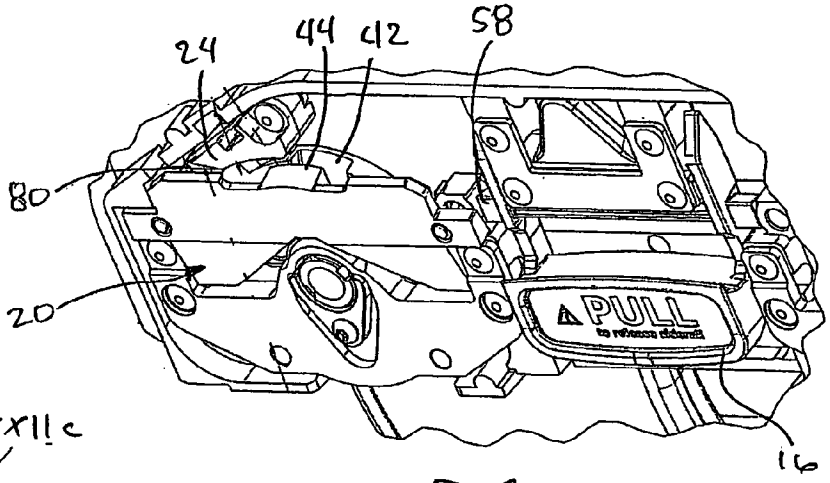
FIGS. 22*b* and 22*c* are similar views to FIGS. 22 and 22*a*, respectively, with some detail removed for clarity.
Figure 22B:
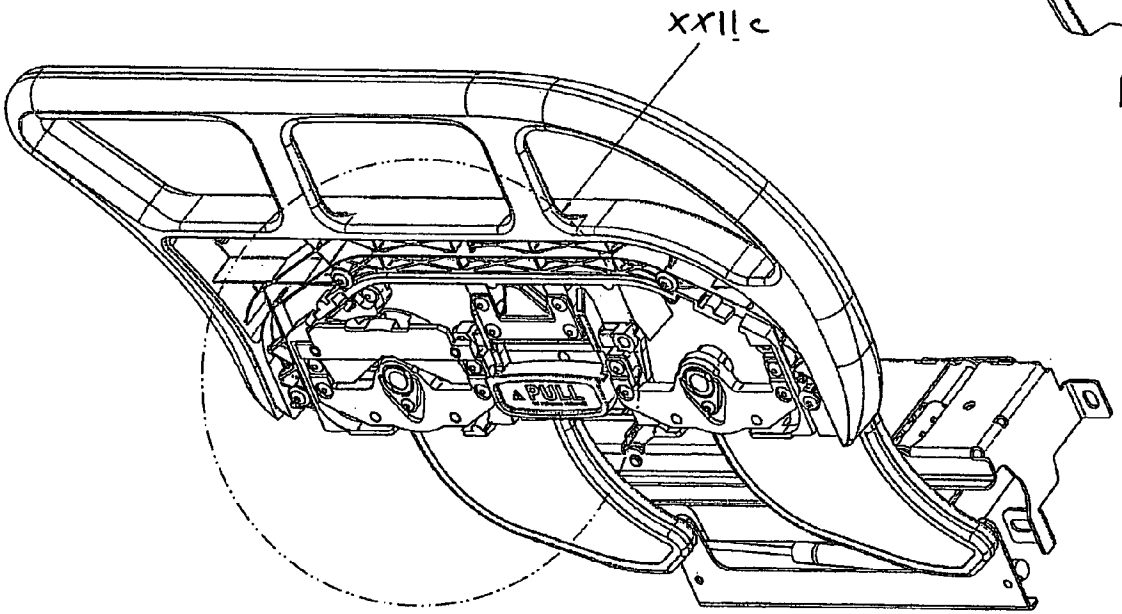

Referring now to FIGS. 22 and 22*a*, as siderail body 12 moves past intermediate position toward the raised position, bypass arm 24 is pivoted upwardly as previously noted, by cam lobe 90, thereby disengaging stepped portion 76 from latch plate 20 and allowing latch plate 20 to pivot towards cam disk 22. Specifically, as cam disk 22 rotates from the intermediate position to the raised position, cam follower 72 follows cam lobe 90 and pivots bypass arm 24 about bypass arm axis 74. Bypass arm 24 pivots sufficiently to disengage second stop surface 80 of stepped portion 76 from latch surface 92, thereby allowing latch biasing element 69 to urge latch plate 20 into contact with cam disk 22. In the illustrated embodiment, such contact occurs soon after siderail body 12 is past the intermediate position toward the raised position, and before siderail body 12 reaches the raised position. Accordingly, siderail body 12 may be locked in the intermediate position by moving siderail body 12 slightly past the intermediate position, allowing bypass arm 24 to re-engage cam disk 22 as described, and moving siderail body 12 back to the intermediate position where latching mechanism 14 will automatically lock siderail body 12 in the manner described above.

In addition, when latch plate 20 is no longer blocked by bypass arm, biasing members 69 urge latch plate 20 toward cam disk 22 with sufficient force so that the impact of protrusions 44 on cam disk 22 results in audible feedback, such as a "click." The audible feedback allows a user to confirm that latch mechanism 14 has been reset or reconfigured from its bypass configuration to its locking configuration. However, although the illustrated embodiment utilizes sound for such feedback, it will be apparent to one skilled in the art that another method can be used to provide feedback perceptible to the human senses without departing from the principles of the invention. For example, such feedback may be a different sound, or tactile or visual feedback, or some combination thereof.

As siderail body 12 moves further into the raised position, void 42 and locking protrusion 44 substantially align and mesh, thereby coupling latch plate 20 and cam disk 22 and locking latching mechanism 14 in the raised position (as described above).

Figure 23A:
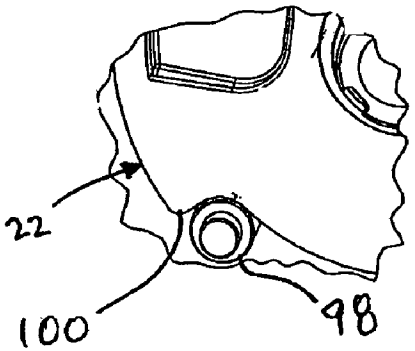
FIG. 23*a* is an enlarged view of detail XXIIIa of FIG. 23 illustrating the internal components of the siderail of FIG. 23.
Figure 23:
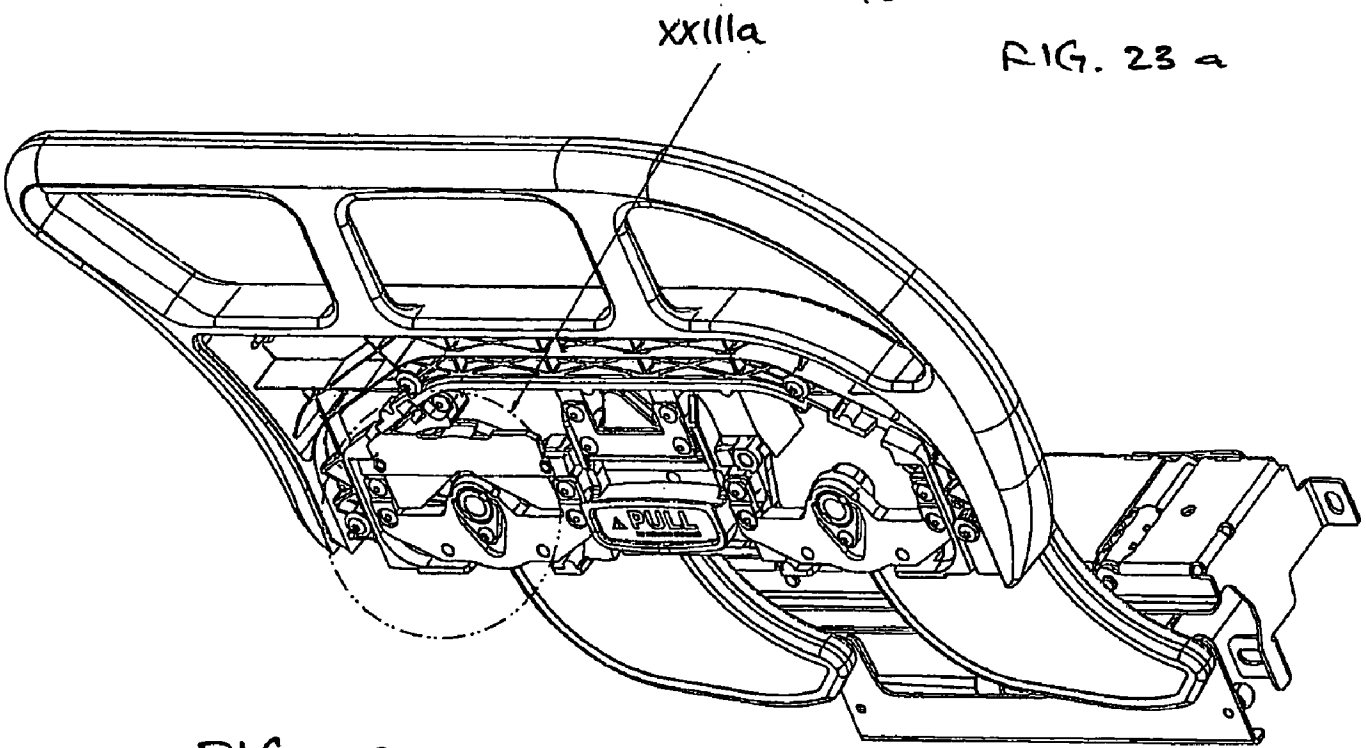
FIG. 23 is a similar view to FIG. 22 illustrating a pin.
Figure 24:
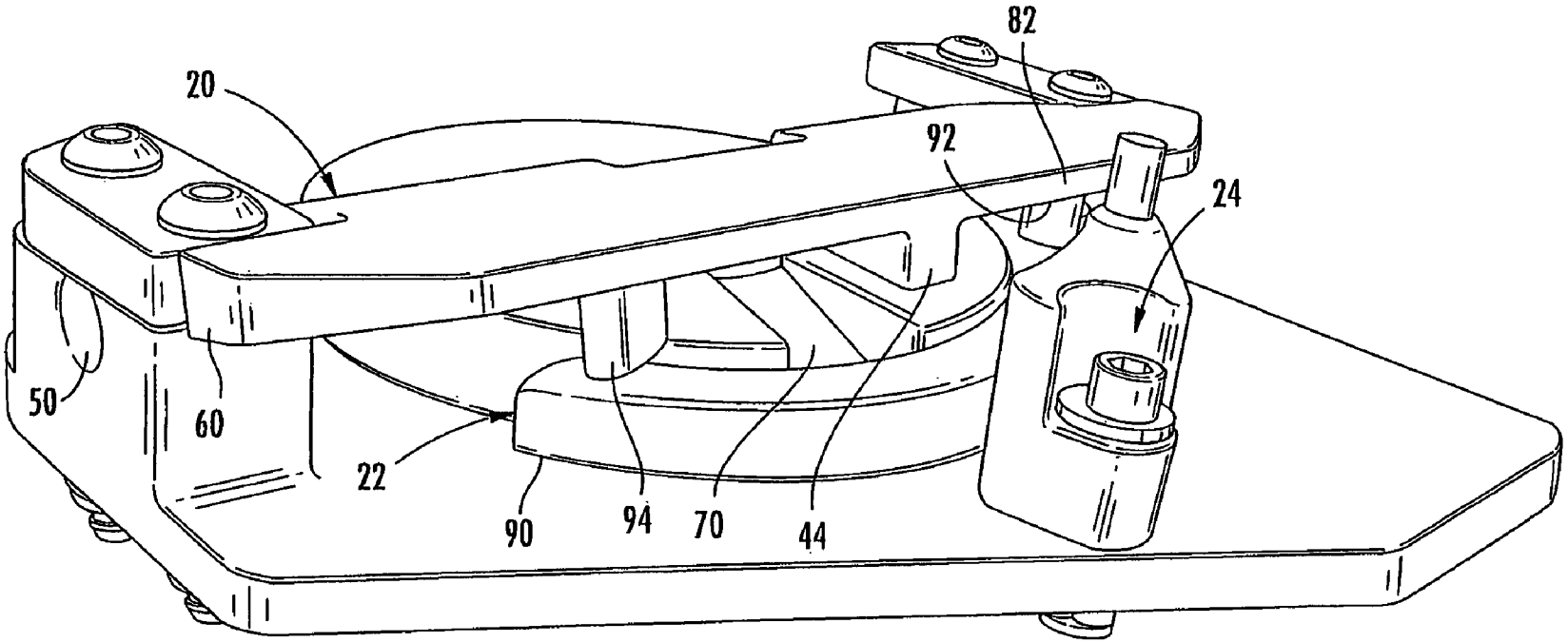
FIG. 24 is a view of a latching mechanism taken from the above right.

Cam disk 22 may further include a raised stop position operable in the raised position of the siderail arm (FIGS. 8 and 22). Cam disk 22 includes a raised step 100 operable to engage pin 98 (FIGS. 7 and 23*a*) thereby arresting further rotation of cam disk 22. Thus, the positions of raised step 100 on cam disk 22 and pin 98 may define the raised position of siderail body 12 and/or prevent movement of cam disk 22 beyond the raised stop position. In the illustrated embodiment, raised step 100 is located on the perimeter of cam disk 22 and comprises a portion of cam lobe 90, thereby facilitating common control by cam disk 22 of both the stop positions and the locking positions. Such common control allows the relationship between the raised and lowered stop positions and the locking positions of siderail body 12 to be easily and precisely controlled by modifying the configuration of cam disk 22. It will be apparent to the skilled artisan, however, that raised step 100 may take a variety of other forms without departing from the principles of the present invention, such as features on a face of cam disk 22 or features attached to siderail body 12. Further, the illustrated embodiment uses a single pin 98 for engaging both the lower step 96 and raised step 100. However, separate pins could be used for each step.

Thus, in operation, when the siderail body 12 is in its lowered position an operator may lift the siderail using handle 16 or by using a hand-hold. If the operator would like to raise the siderail to the intermediate position and lock the siderail in the intermediate position, the operator need only raise the siderail just beyond the intermediate position and then lower the siderail body to the intermediate position where the latching mechanism automatically locks the siderail body in the intermediate position. If starting from the raised position, the operator will need to pull on handle 16 and cause it to pivot outwardly from siderail body 12 to release the latch mechanism (14) from its locked raised position. Once released, the operator may release their pulling force on the handle and, thereafter, just use the handle as a gripping member to hold the siderail and lower the siderail to either the intermediate position, where the latch mechanism will automatically lock the siderail. If the operator wishes to lower the siderail to the lowered position, the operator must once again pull on the handle, which again releases the latch mechanism so that the siderail can be lowered to its lowered position. Alternately, the operator may simply keep pulling on the handle while lowering the siderail.

If the siderail is allowed to automatically lock in the intermediate position, the operator will again have to pull on the handle and pivot it outwardly from the siderail body to disengage the latch mechanism from its intermediate locked configuration so that the siderail can be raised or lowered. One of the benefits that the handle and latch mechanism of the present invention provide is the ability of an operator to quickly move the siderail, using one hand, from the lowered position to the raised position while providing an intermediate locked position that can be passed by but then can be available just after passing the intermediate position.

Another aspect of siderail 10 includes biasing elements for minimizing the exertion required to raise or lower the siderail body and mitigating the physical impact of manipulating siderail body 12 on the user. In the illustrated embodiment, the weight of siderail body 12 urges siderail body 12 away from the intermediate position. Accordingly, biasing elements are provided to urge siderail body 12 from the raised and lowered positions toward the intermediate position. The biasing elements may also include damping to facilitate smooth, quiet and safe operation.

Referring now to FIGS. 26-34, siderail 10 includes a first biasing element 102 for urging siderail body 12 in a first direction through a first range of motion. Siderail 10 further includes a second biasing element 104 for urging siderail body 12 in a second direction through a second range of motion. More particularly, first biasing element 102 urges siderail body 12 from the raised position toward the intermediate position and second biasing element 104 urges siderail body 12 from the lowered position towards the intermediate position.

Figure 26A:
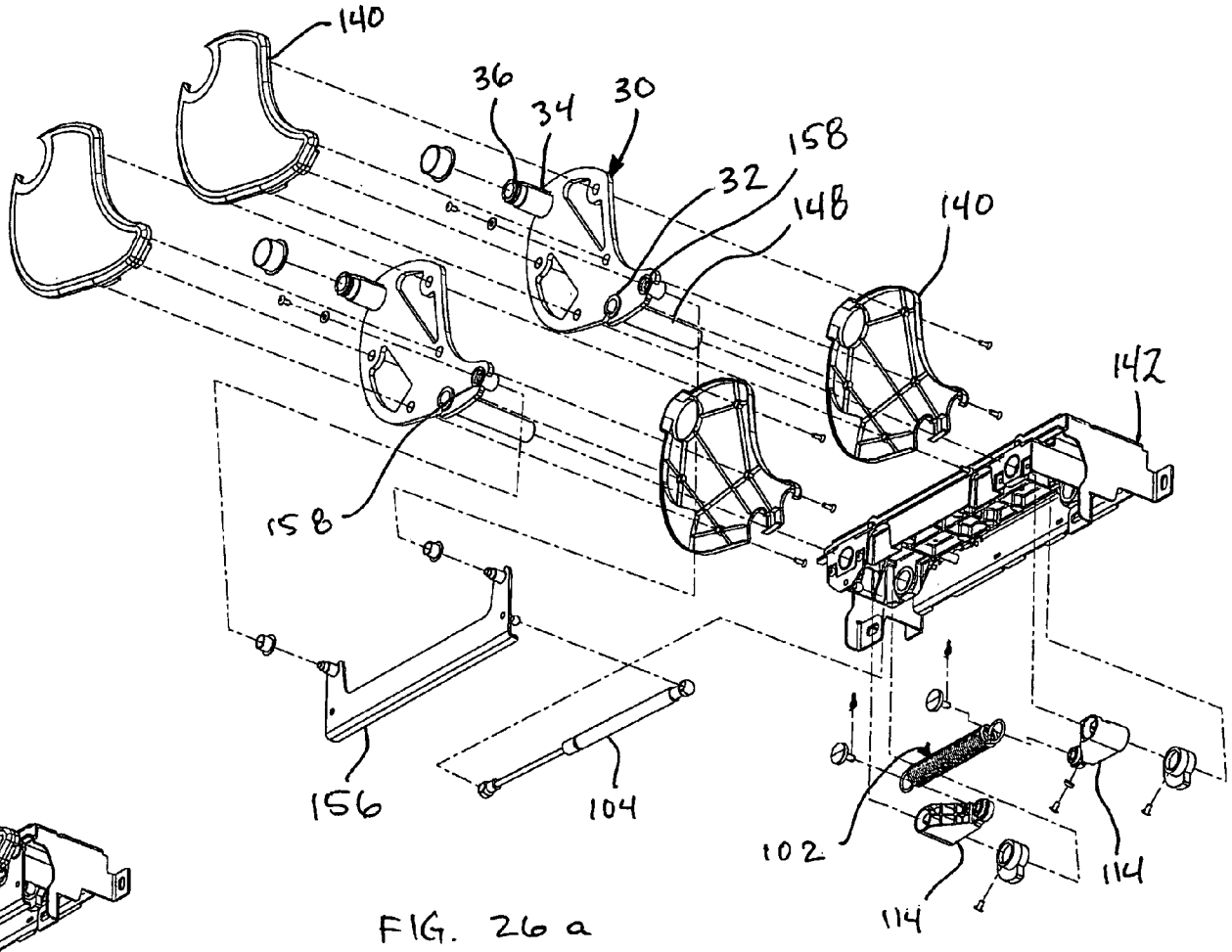
FIG. 26*a* is an exploded view of the internal components of the siderail of FIG. 26.

As best seen in FIG. 26*a*, first biasing element 102 comprises an extension spring and second biasing element 104 comprises a gas spring. However, depending on the needs of the user, biasing elements of varying properties may be chosen. For example, a typical gas spring provides a damping effect when it is compressed that prevents siderail body 12 from "falling" or quickly descending from the intermediate position to the lowered position. An extension spring has the advantage of being inexpensive and easy to maintain, and is therefore an appropriate choice for influencing siderail body 12 over the short vertical distance between the illustrated raised and intermediate positions. Moreover, it will be apparent to the skilled artisan that either biasing element of the illustrated embodiment may be, for example, a compression spring or an extension spring, a gas spring, or an elastic member or the like without departing from the principles of the invention as disclosed herein.

Biasing elements 102, 104 are positioned substantially under and behind siderail body 12 and away from the easy view or reach of a user of siderail 10. A first proximal portion 106 of first biasing element 102 is pivotally connectable to a patient support, to a portion of siderail arm 30, or to other framework. A first distal portion 108 of first biasing element 102 is pivotally connected to siderail body 12. Similarly, a second proximal portion 110 of second biasing element 104 is pivotally connectable to a patient support or to a portion of siderail arm 30 or other framework, and a second distal portion 112 of second biasing element 104 is pivotally connected to siderail body 12 or a second siderail arm 30. The mounting of biasing elements 102, 104 is discussed in more detail below.

Figure 33:
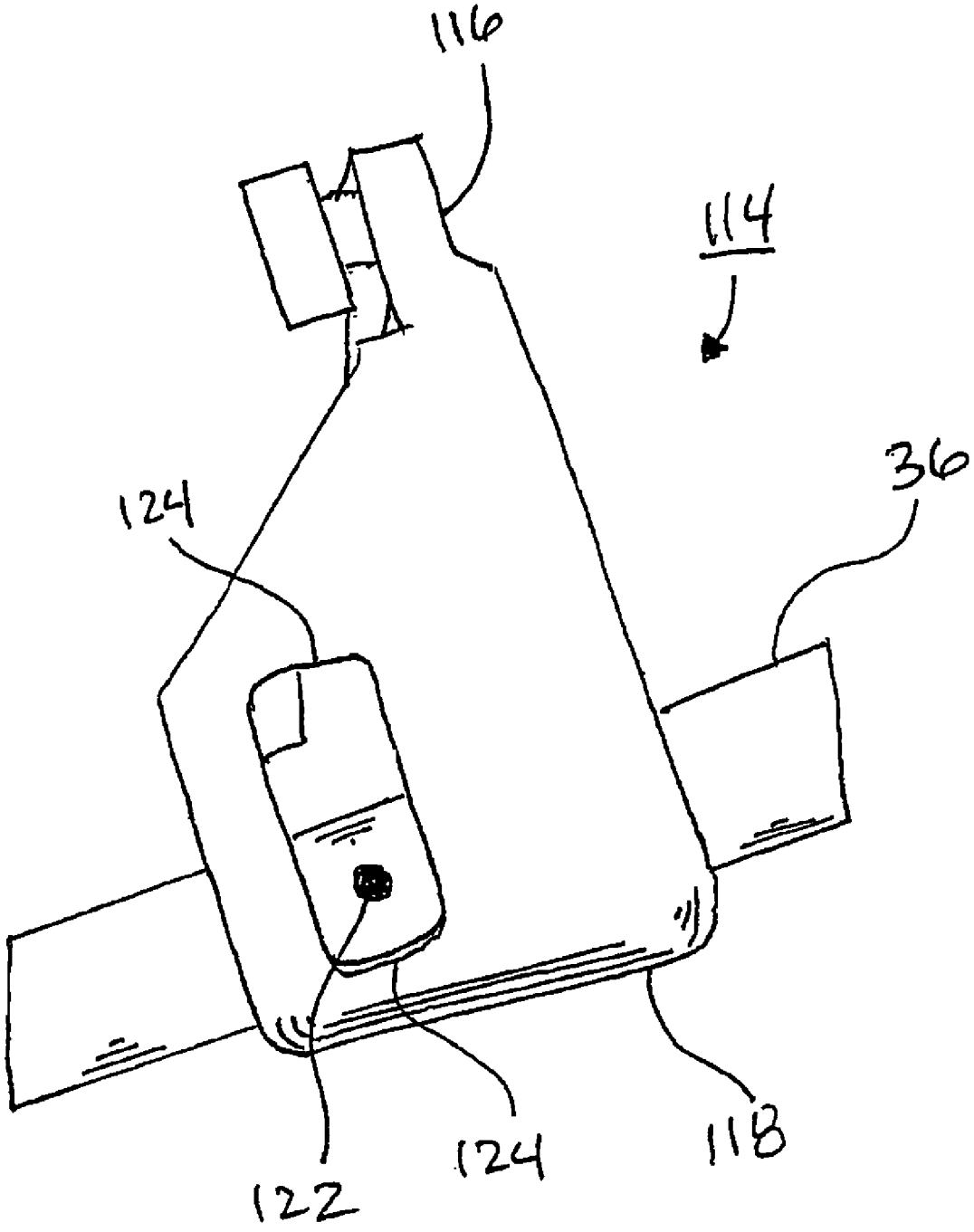
FIG. 33 is a perspective view of a pivot arm mounted to a shaft.

The pivotal connection of first distal portion 108 to siderail body 12 may be through a pivot arm 114 (FIGS. 7, 26*a* and 33). First portion 116 of pivot arm 114 pivotally attaches to first distal portion 108 of first biasing element 102. Second portion 118 of pivot arm 114 fixedly attaches to shaft 36 through siderail arm 30 (as will be described in more detail below) to couple pivot arm 114 with cam disk 22 at rotational axis 38. Pivot arm 114 transmits a biasing force created by first biasing element 102 to siderail body 12 when it is between the raised and intermediate positions, allowing first biasing element 102 to urge siderail body 12 from the raised position toward the intermediate position as discussed above. Conversely, between the lowered and intermediate positions, pivot arm 114 decouples the biasing force to preclude first biasing element 102 from urging siderail body 12 in any direction. Although pivot arm 114 is used on only one portion of one biasing element in the illustrated embodiment, it will be apparent to the skilled artisan that pivot arm 114 may also be used with other biasing elements, such as second biasing element 104.

Pivot arm 114 decouples first biasing element 102 from siderail body 12 using an arcuate slot 120 located substantially about second portion 118. Arcuate slot 120 cooperates with a protrusion or pintle or other protuberance 122 fixedly attached to shaft 36 (FIG. 7) to which pivot arm 114 is pivotally coupled (as discussed below). Shaft 36, in turn, is fixedly coupled to cam disk 22 or siderail arm 30. As siderail body 12 is moved between the lowered and intermediate positions (as expressed through rotation of cam disk 22), protrusion 122 rotates through arcuate slot 120 and engages an end 124 of arcuate slot 120 when siderail body 12 reaches the intermediate position. As siderail body 12 is moved further towards the raised position, protrusion 122 rotates pivot arm 114 in unison with the movement of cam disk 22 to extend first biasing element 102. Accordingly, when protrusion 122 is engaged at an end 124 of arcuate slot 120, the biasing force of first biasing element 102 is coupled with siderail body 12.

Figure 28A:
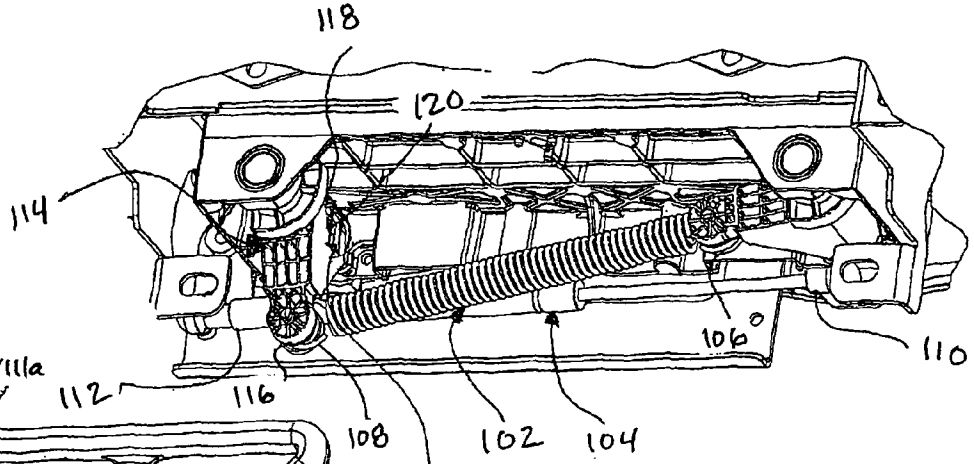
FIG. 28*a* is an enlarged view of detail XXVIIIa of FIG. 28 illustrating the internal components of the siderail of FIG. 28.
Figure 28:
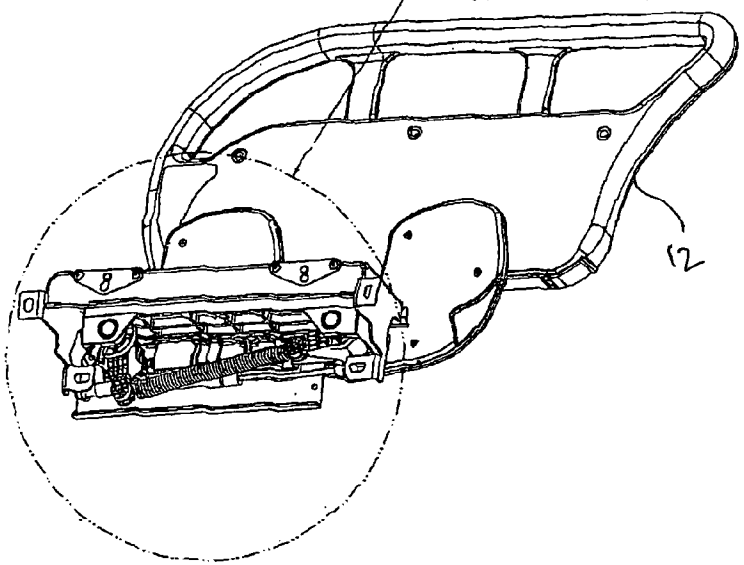
FIG. 28 is an elevation view of the siderail shown from the patient support underside facing the siderail in the raised position illustrating biasing elements.

Referring now to FIGS. 28 and 28*a*, the raised position of siderail body 12 corresponds with an extended first biasing element 102. Pivot arm 114 is out of alignment with first biasing element 102 (and protrusion 122 is in contact with an end 124 of arcuate slot 120), allowing force exerted by first biasing element 102 to urge siderail body 12 towards the intermediate position. Second biasing element 104 is in a substantially fully extended position, and therefore exerts a minimal opposing force to that of the first biasing element (urging siderail body 12 in to the raised position).

Figure 29A:
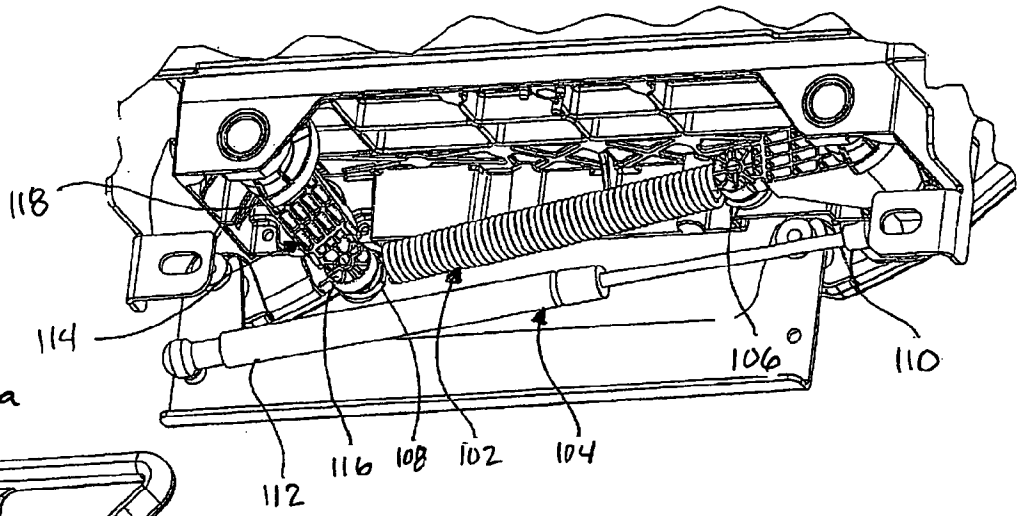
FIG. 29*a* is an enlarged view of detail XXIXa of FIG. 29 illustrating the internal components of the siderail of FIG. 29.
Figure 29:
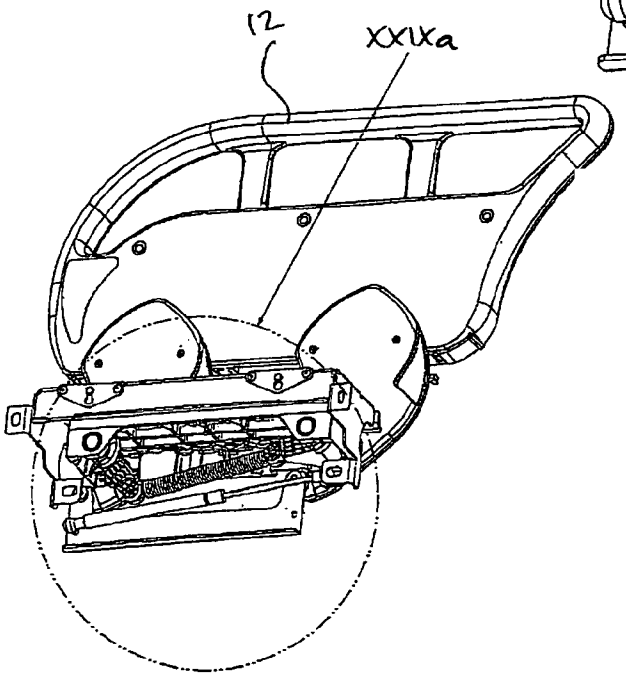
FIG. 29 is a similar view to FIG. 28, with the siderail shown in a position between the raised position and the intermediate position.

As best seen in FIGS. 29 and 29*a*, as siderail body 12 moves towards in the intermediate position from the raised position, first biasing element 102 becomes less extended (as compared with the raised position). The rotational position of pivot arm 114, corresponding with the movement of siderail body 12, and the rotation of cam disk 22, moves toward alignment with first biasing element 102. The force exerted by first biasing element 102 is accordingly reduced. Second biasing element 104 is more compressed than in the raised position and exerts an increased force.

Figure 30A:
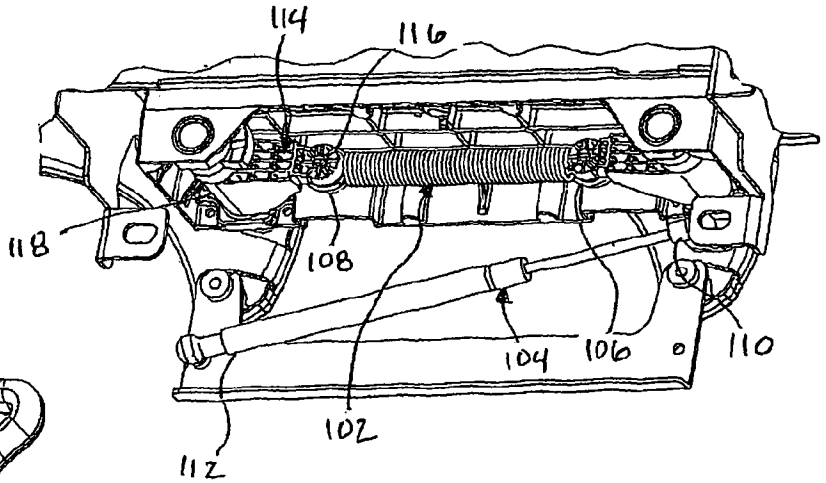
FIG. 30*a* is an enlarged view of detail XXXa of FIG. 30 illustrating the internal components of the siderail of FIG. 30.
Figure 30:
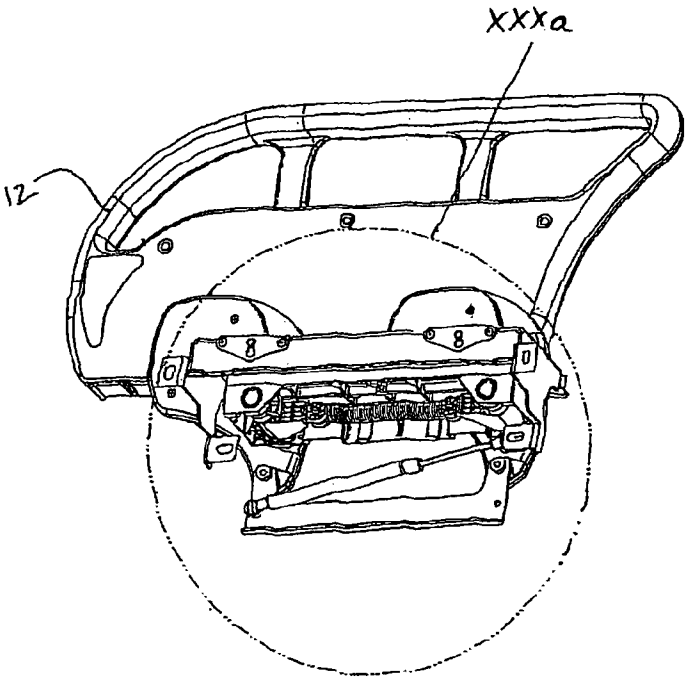
FIG. 30 is a similar view to FIG. 28, with the siderail shown in the intermediate position.

As siderail body 12 moves in to the intermediate position, pivot arm 114 rotates into substantial alignment with first biasing element 102 (see FIGS. 30 and 30*a*). In this configuration, first biasing element 102 is fully compressed and will therefore exert little or no force on siderail body 12. In this position, protrusion 122 is at an end 124 of arcuate slot 120. Second biasing element is further compressed, thereby exerting a further increased force urging siderail body 12 towards the raised position.

Figure 31A:
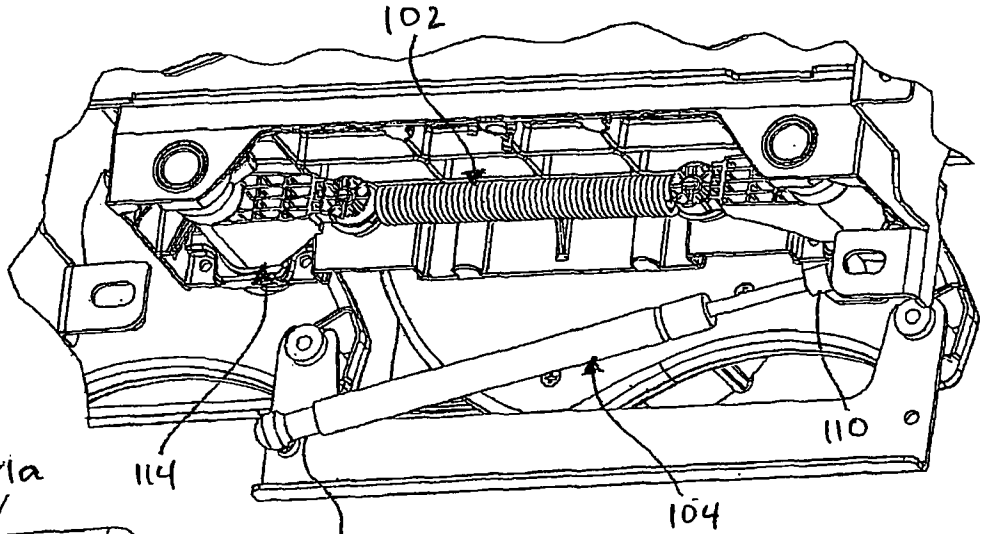
FIG. 31*a* is an enlarged view of detail XXXIa of FIG. 31 illustrating the internal components of the siderail of FIG. 31.
Figure 31:
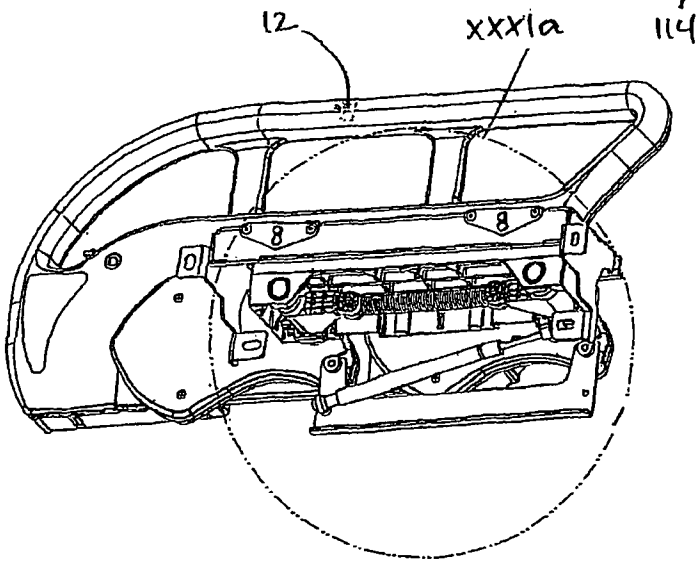
FIG. 31 is a similar view to FIG. 28, with the siderail shown in a position between the intermediate position and the lowered position.

Referring to FIGS. 31 and 31*a*, as siderail body 12 is moved past the intermediate position and approaches the lowered position, pivot arm 114 remains in alignment with first biasing element 102 and first biasing element 102 remains compressed and decoupled from siderail body 12. Second biasing element 104 compresses further and exerts greater force than in the positions of FIGS. 29-30*a*, thereby counteracting a greater portion of the weight placed on second biasing element 104 by siderail body 12 as it moves toward the lowered position.

Figure 32A:
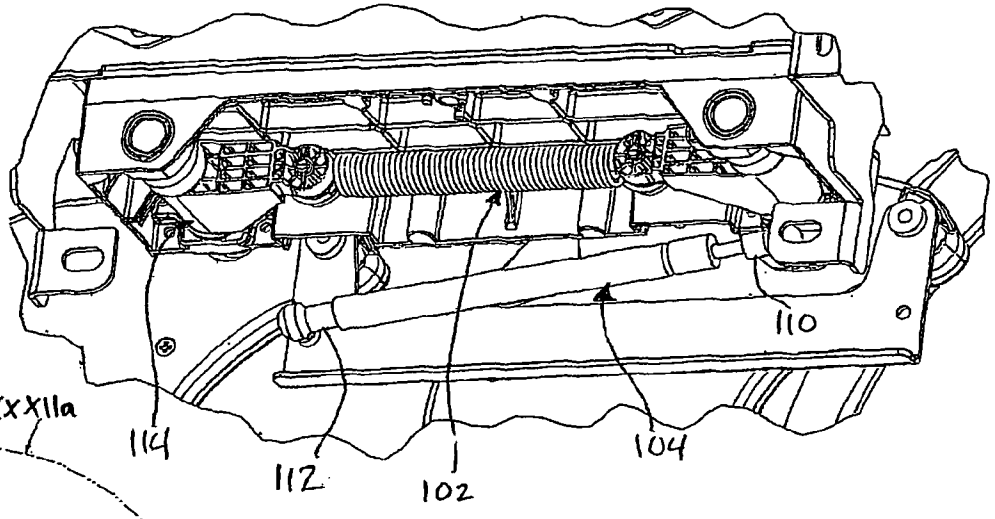
FIG. 32*a* is an enlarged view of detail XXXIIa of FIG. 32 illustrating the internal components of the siderail of FIG. 32.
Figure 32:
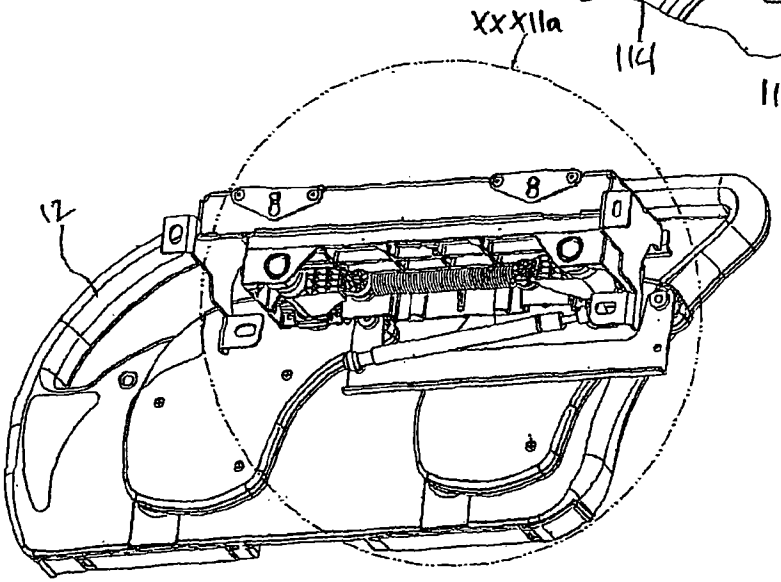
FIG. 32 is a similar view to FIG. 28, with the siderail shown in the lowered position.

When siderail body 12 is in the lowered position, second biasing element 104 is substantially fully compressed and exerts a maximum amount of force urging siderail body 12 back towards the intermediate and raised positions (see FIGS. 32 and 32*a*). Pivot arm 114 remains in alignment and first biasing element 102 remains compressed and decoupled from siderail body 12.

Figure 34:
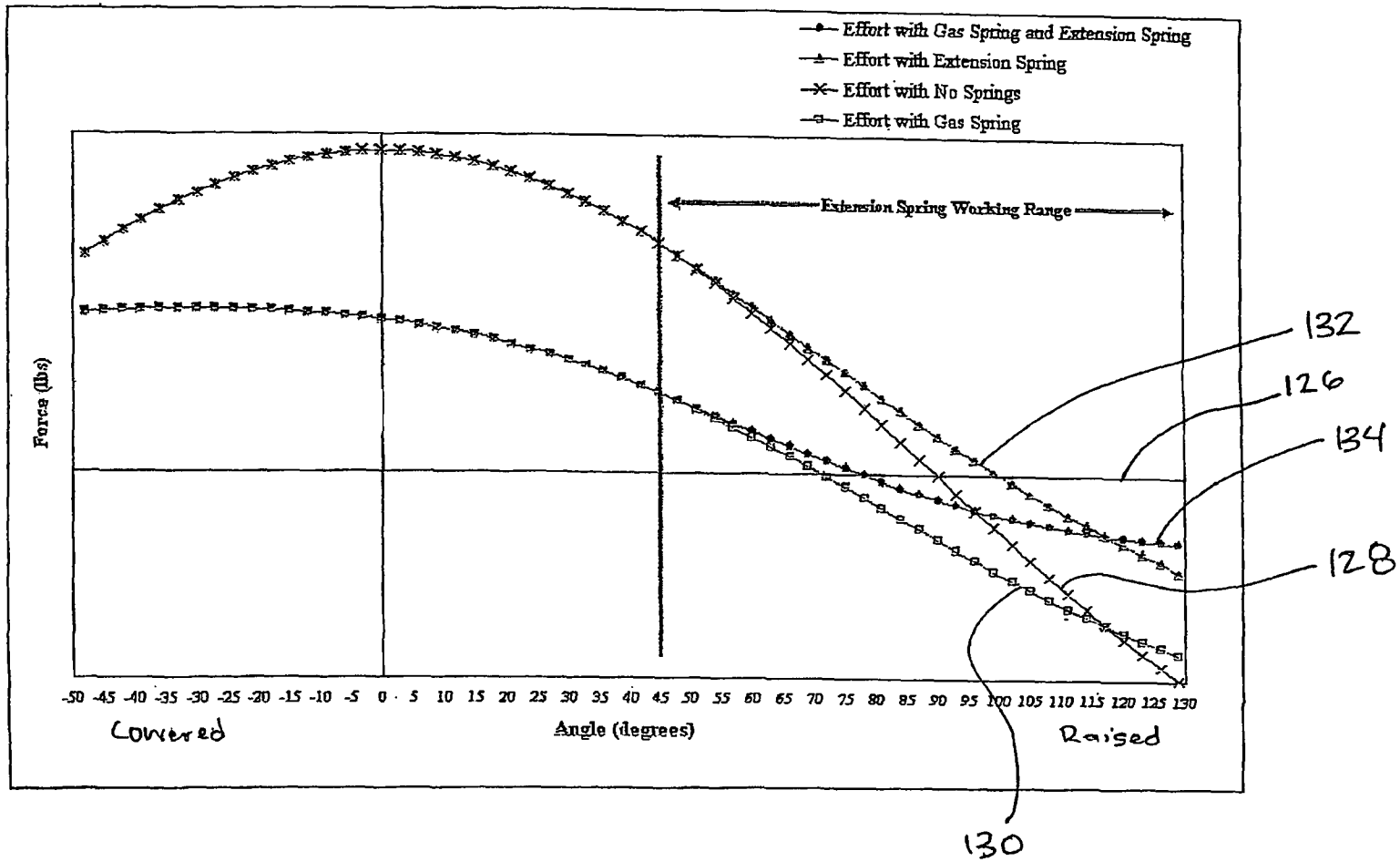
FIG. 34 is a graph illustrating force vs. siderail body position for a variety of siderail configurations.

Referring to FIG. 34, the configuration of the biasing elements in the illustrated embodiment (an example of which is disclosed above), eases operation of siderail 10 by reducing the amount of force required for an operator to move siderail body 12 between the raised and lowered positions. On the graph shown the force required to reposition siderail body 12 is shown as a function of siderail body 12 position along its range of motion. Accordingly, baseline 126 represents a zero force exertion to move siderail body 12 between lowered and raised positions. A siderail force profile following baseline 126 represents an ideal because no force would be required of an operator to reposition siderail body 12 between the raised and lowered positions.

Four actual force profiles are shown: i) a no-springs profile 128; ii) a gas-spring profile 130; iii) an extension-spring profile 132; and iv) a both-springs profile 134. Of the four profiles, no-springs profile 128 deviates from baseline 126 most and is thus the worst choice from an ease-of-use standpoint. This is because, without springs urging siderail body 12 in any direction, a user of siderail 10 must bear the entire weight of siderail body 12 and its associated components when adjusting or manipulating the position of siderail body 12.

Gas-spring profile 130, representative of a siderail 10 including second biasing element 104 but not first biasing element 102, shows substantial improvement in the range of movement of siderail body 12 between the lowered and intermediate positions but little or no improvement in the range between the raised and intermediate positions. Second biasing element 104, as noted above, is adapted to urge siderail body 12 from the lowered position to the intermediate position and such urging is reflected in gas-spring profile 130. For most of the range between the intermediate position and the raised position, second biasing element 104 is actually slightly urging siderail body 12 away from the intermediate position, increasing the user force needed to manipulate siderail body 12. However, as is described below, this effort is mitigated by first biasing element 102.

Conversely, extension-spring profile 132 shows substantial improvement in the range of movement of siderail body 12 between the raised and intermediate positions but little or no improvement in the range between the lowered and intermediate positions. Because first biasing element is decoupled in the range between the intermediate and lowered positions (as discussed above), it has virtually no effect on the force needed to manipulate siderail body 12 in that range. In its intended range of operation (between the intermediate and raised positions), however, it has the desired effect of urging the siderail toward the intermediate position and lowering the force necessary for manipulation of siderail body 12.

Of the four force profiles shown, both-springs profile 134 of the illustrated embodiment traces baseline 126 most closely and is therefore preferable to the other three force profiles. This is because an operator of siderail 10 with the benefit of both biasing elements 102, 104 will be required to exert a lesser force to manipulate the position of siderail body 12 as compared with the other profiles discussed above. Specifically, the favorable effect of second biasing element 104 between the lowered and intermediate positions is not affected by a decoupled first biasing element. The unfavorable effect of second biasing element 104 in the range between the intermediate and raised positions is more than mitigated by first biasing element 102, which substantially retains its favorable force profile as compared with no-springs profile 128.

Figure 26:
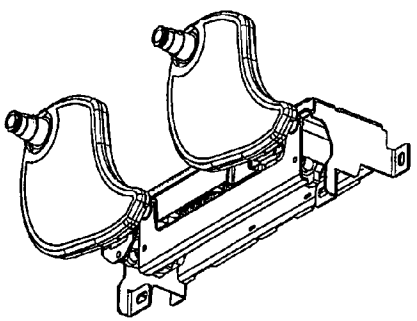
FIG. 26 is a perspective view of a siderail with some components removed.
Figure 27:
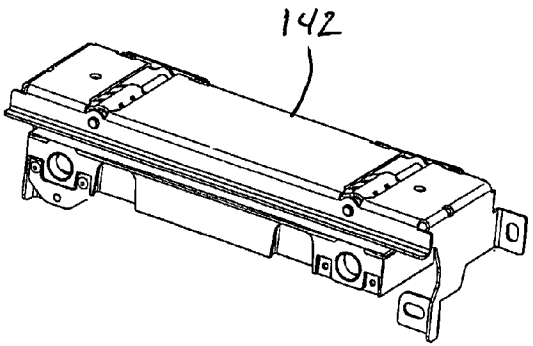
FIG. 27 is a perspective view of a siderail base.
Figure 27A:
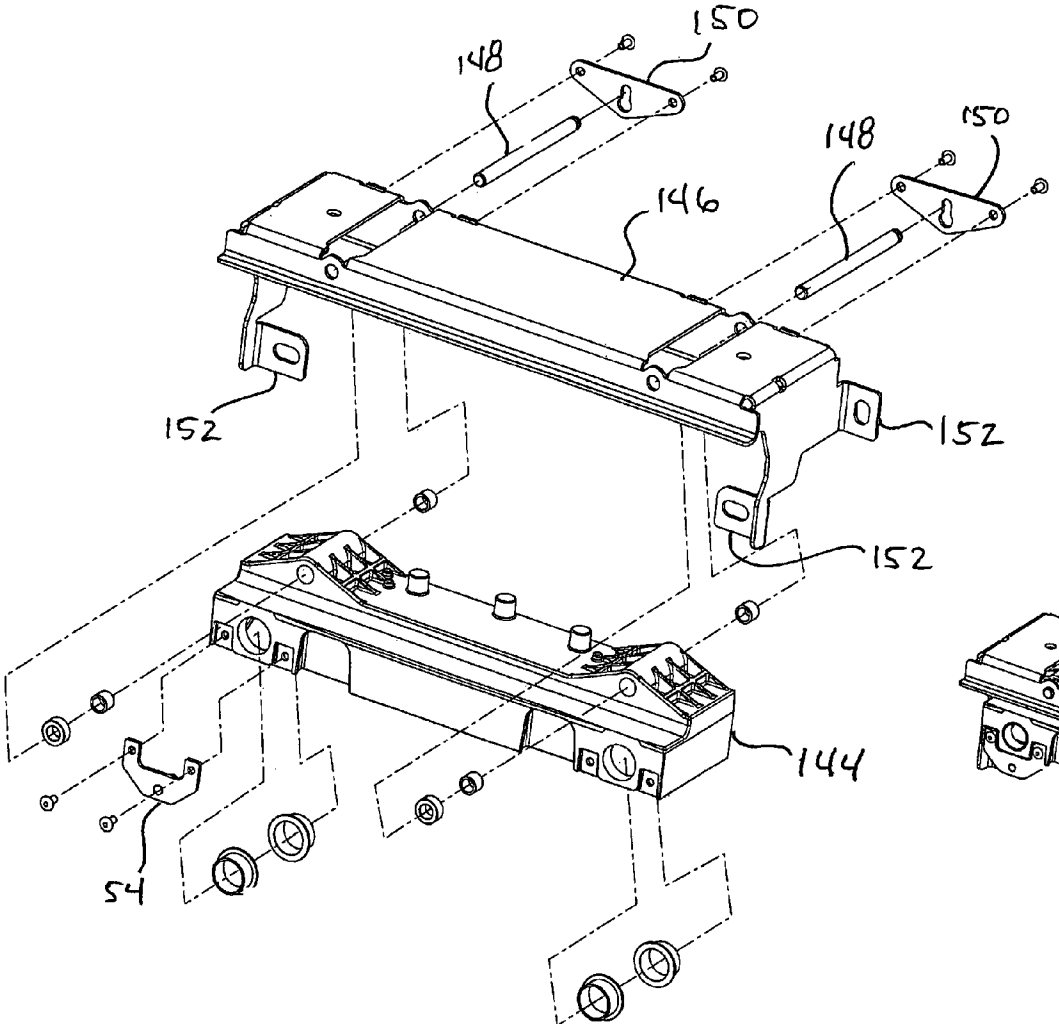
FIG. 27*a* is an exploded view of the internal components of the siderail of FIG. 27.

Referring now to FIGS. 26-27*a*, siderail 10 further comprises a base 142 (FIG. 27*a*) including a body 144 and a mounting bracket 146. A shaft 148 passes through apertures in body 144 to fixedly couple pivot arm 114 with siderail arm 30, thereby coupling pivot arm 114 with cam disk 22 through siderail 30 (as described above). Shaft 148 is attached to body 148 with a coupling plate 150, though it will be apparent to one skilled in the art that other methods of such coupling may be employed without departing from the principles of the present invention. Mounting bracket 146 includes flanges 152 for mounting base 142 (and hence, siderail 10) to a patient support.

In the illustrated embodiment, biasing elements 102, 104 mount to siderail 10 via base 142. First biasing element 102 attaches to body 142 via a pair of pivot arms 114, one of which responds to a protrusion 116 as detailed above. Each of pivot arms 114 is coupled with a shaft 148 (FIG. 26*a*) attached to a siderail arm 30. Second biasing element 104 attaches to mounting bracket 146 at proximal portion 110 via an extension bracket 154 (FIGS. 26*a*, 27). Distal portion 112 of the biasing element, on the other hand, attaches to a link 156 that is pivotably coupled with a third portion 158 of siderail arms 30 (FIG. 26*a*). Thus, biasing elements 102, 104 exert force on siderail body 12 through siderail arms 30 and cam disk 22.

Figure 35:
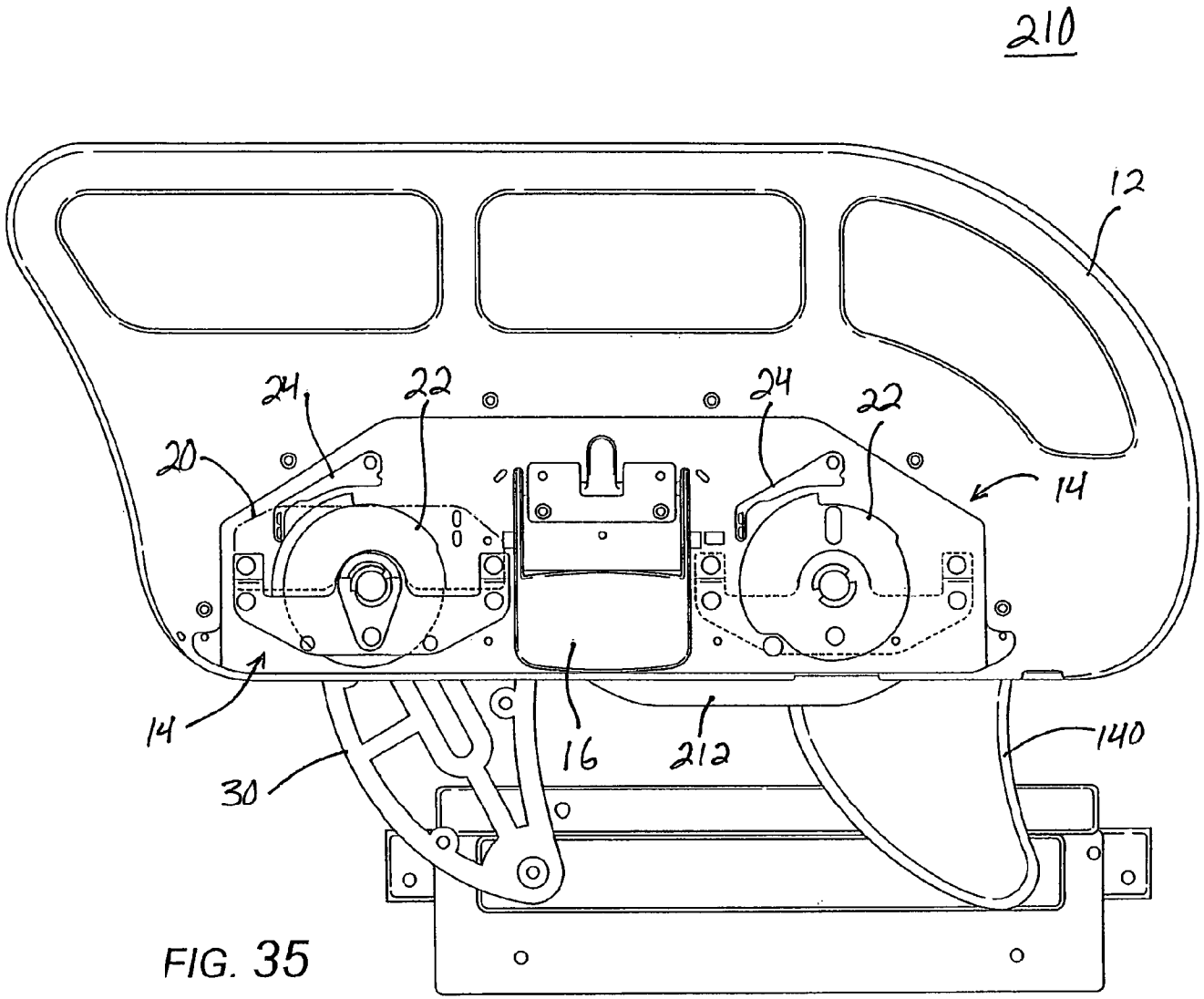
FIG. 35 is a side elevation of another embodiment of a siderail, illustrating internal components thereof.
Figure 36A:
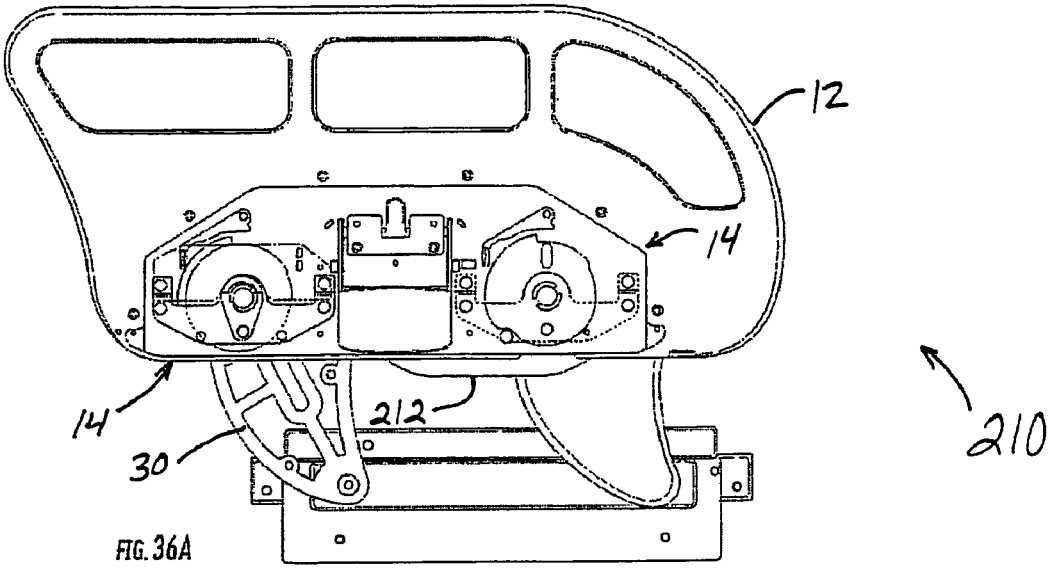
FIG. 36*a* is a similar view to FIG. 35, with the siderail shown in the raised position.

In an alternative embodiment (FIGS. 35-36*c*), siderail 210, which is of similar construction to siderail 10, includes two latching mechanisms 14. For further details of latching mechanism 14 reference is made to the first embodiment. In order to synchronize the latching mechanisms, siderail 210 optionally includes a timing link 212 that couples the two latching mechanisms 14, thereby ensuring that a position of a first latching mechanism 14 corresponds with the position of a subsequent latching mechanism 14 for a given position of siderail body 12.

Figure 36B:
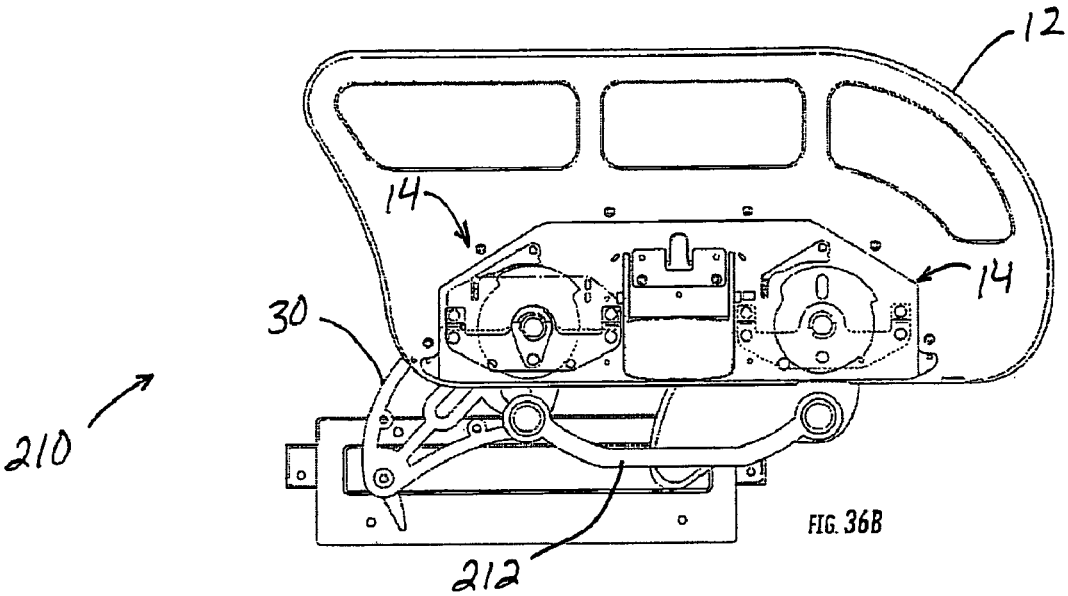
FIG. 36*b* is a similar view to FIG. 35, with the siderail shown in the intermediate position.
Figure 36C:
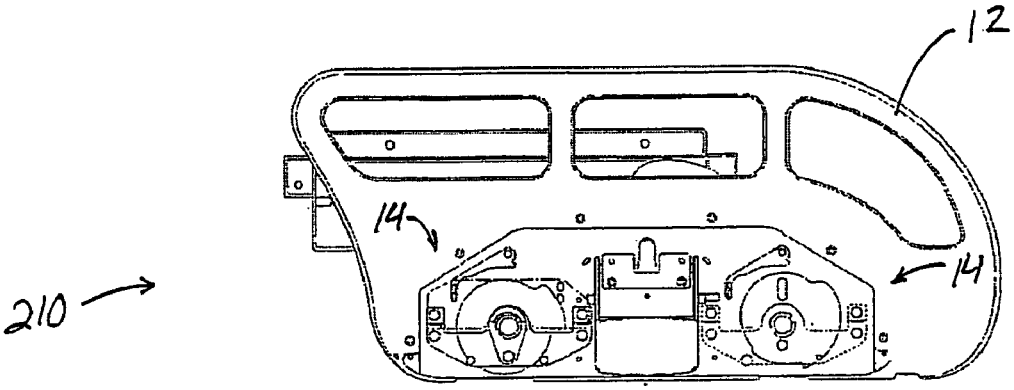
FIG. 36*c* is a similar view to FIG. 35 of the siderail shown in the lowered position.

Timing link 212, according to the present embodiment, is an substantially rigid elongated member with a first pivot 214 and a second pivot 216 located at substantially opposed ends of timing link 212 (FIG. 36*b*). Pivots 214, 216 attach to two siderail arms 30, thereby creating a four-bar linkage between siderail body 12, siderail arms 30, and timing link 212. Thus, as siderail body 12 is moved between the raised position and the lowered position, each of the two latching mechanisms 14 will operate unitarily to lock siderail body 12 in the intermediate or raised positions (as discussed above).

In the illustrated embodiment, handle 16 includes two handle protrusions 58 to operate both latching mechanisms 14 simultaneously when user portion 56 of handle 16 is moved distally from siderail body 12. Thus, a single handle 16 may unlock siderail body 12 from a locked position by rotating each of two latch plates 20 away from each of two corresponding cam disks 22 in accordance with the disclosure herein. Moreover, when the two latching mechanisms 14 are joined by a timing link 212, they may operate in a substantially identical manner to their singular counterparts in siderail 10.

Figure 4:
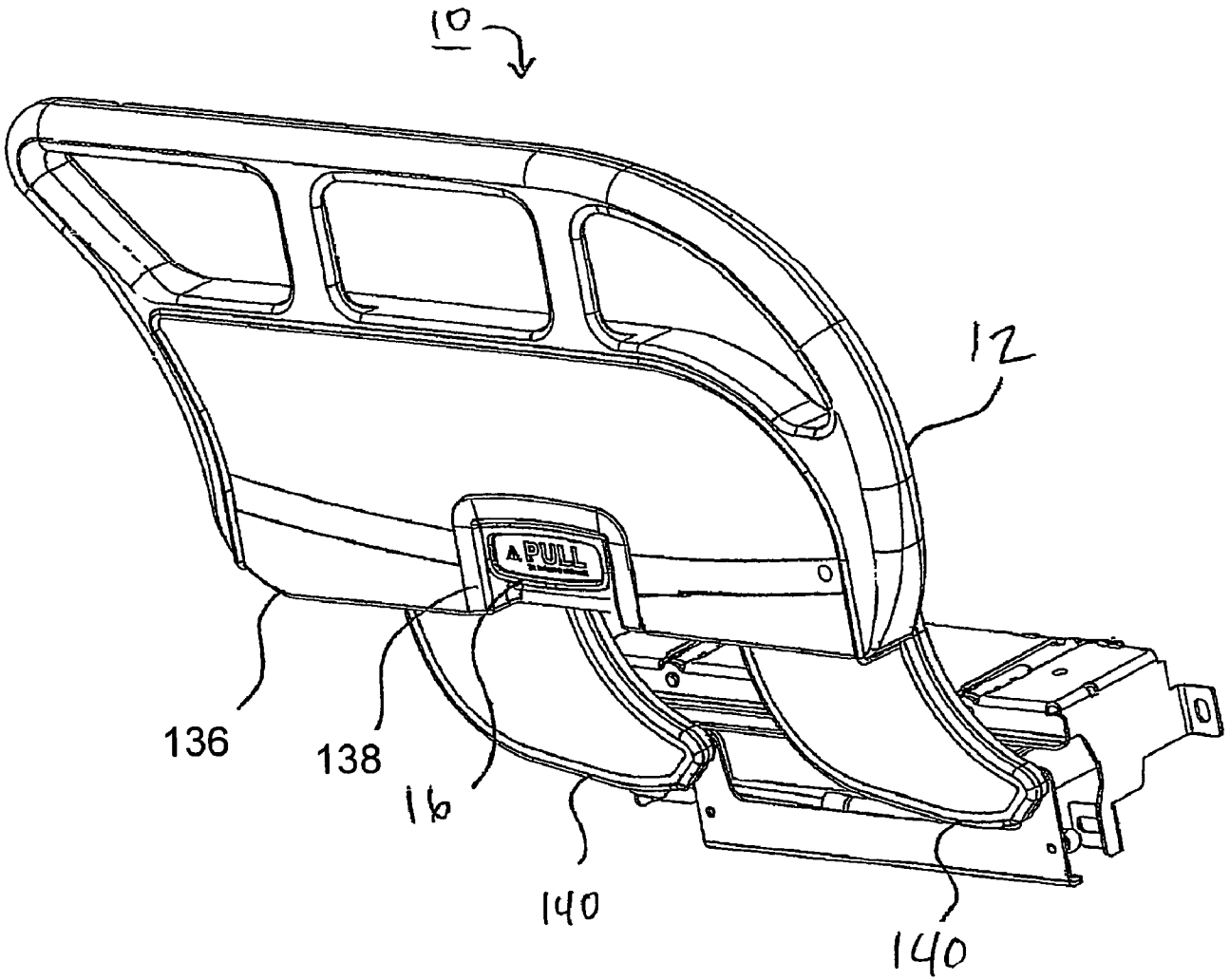
FIG. 4 is a perspective view of the siderail of FIG. 1.

Siderails 10 or 210 may include a mechanism cover 136 and handle cover 138. Because latching mechanism(s) 14 are located within siderail body 12 (as described above), covers 136, 138 provide protection for users of siderails 10, 210, a barrier against dirt and dust, and aesthetic enhancement (FIG. 4). Similarly, siderail arms 30 may be covered with siderail arm covers 140 to provide, for example, protection for users of siderail 10 from siderail arms 30, or a barrier against dirt and dust, or aesthetic enhancement (FIG. 4). Such siderail arm covers 140 may be applied to both sides of siderail arms 30 (FIG. 26*a*). When mechanism cover 136, handle cover 138 and siderail arm cover(s) 140 are attached, handle 16 and siderail body 12 remain accessible for user manipulation of siderail 10 or siderail 210. Mechanism cover 136 and handle cover 138 may be removed for access to constituent components, such as latching mechanism 14 (FIG. 5).

Figure 5:
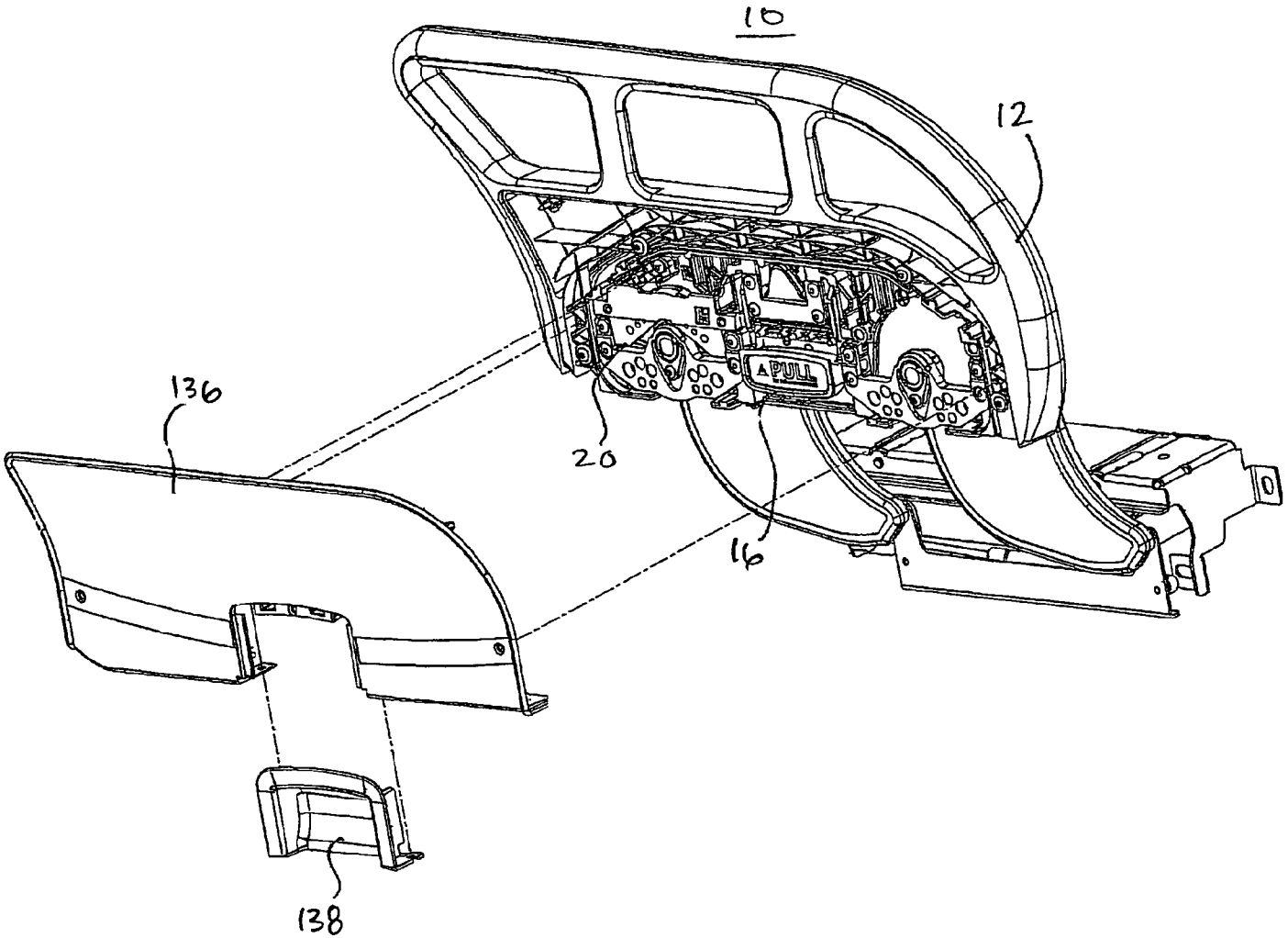
FIG. 5 is a similar view to FIG. 4 with the covers removed to illustrate the internal components thereof.

As best seen in FIG. 5, mechanism cover 136 and handle cover 138 fixedly attach to mounting plate 26. Mechanism cover is installed from the direction of the side of siderail body 12. Handle cover 138 is installed from the bottom to allow for installation or removal of handle cover 138 without removing handle 16.

Referring to FIGS. 37*a*-39*b*, a hospital bed 310 for supporting a patient on a lying surface 312 includes a plurality of movable siderails 314 arranged in pairs along the left and right sides of lying surface 312. Siderails 314 include head end siderails 316 and foot end siderails 318 corresponding to the head end 310*a* and foot end 310*b* of bed 310, and are substantially similar to siderails 10 described above such that a detailed description of their mechanisms need not be repeated. Additionally, hospital bed 310 includes a headboard 320, a footboard 322, and a support frame 324. Headboard 320 and footboard 22 are connected to bed 310 at support frame 324 at head end 310*a* and foot end 310*b*, respectively.

Bed 310 has a longitudinal axis that is parallel to the left and right sides of the bed, and which is centered between the left and right sides of the bed. Bed 310 also includes a lateral axis that is perpendicular to the longitudinal axis and centered between the head and foot ends of the bed. "Left" and "right" are used with respect to a patient's perspective when lying face-up on the bed, and "head end" and "foot end" refer to locations near a patient's head and feet when the patient is lying on the bed.

Each siderail 314 is movably connected to bed 310 at a side of support frame 324 via siderail arms 326. Each siderail arm 326 includes a first pivot 328 connected at support frame 324, a link 332 for synchronizing pairs of siderail arms 326 together, and another pivot (not shown) connected at the respective siderail 314. Link 332, siderail 314, and siderail arms 326 cooperate to form a linkage to ensure that siderail 314 remains in a substantially fixed orientation as it translates, and to ensure that siderail arms 326 associated with a given siderail 314 are synchronized to pivot substantially identically and simultaneously. Further, an actuatable lock device (not shown in FIGS. 37*a*-38*b*), including a release handle 334, is operable to lock each siderail 314 at the raised position and at the intermediate position.

When moved by a user, siderails 314 translate in vertically oriented planes at the respective right and left sides of bed 310. Head end siderails 316 remain generally between a vertical plane defined by headboard 320 and a vertical plane defined by the lateral axis of bed 10 throughout head end siderails' 316 range of motion. Foot end siderails 318 remain generally between a vertical plane defined by footboard 322 and the vertical plane defined by the lateral axis of bed 310 throughout foot end siderails' 318 range of motion.

Figure 37A:
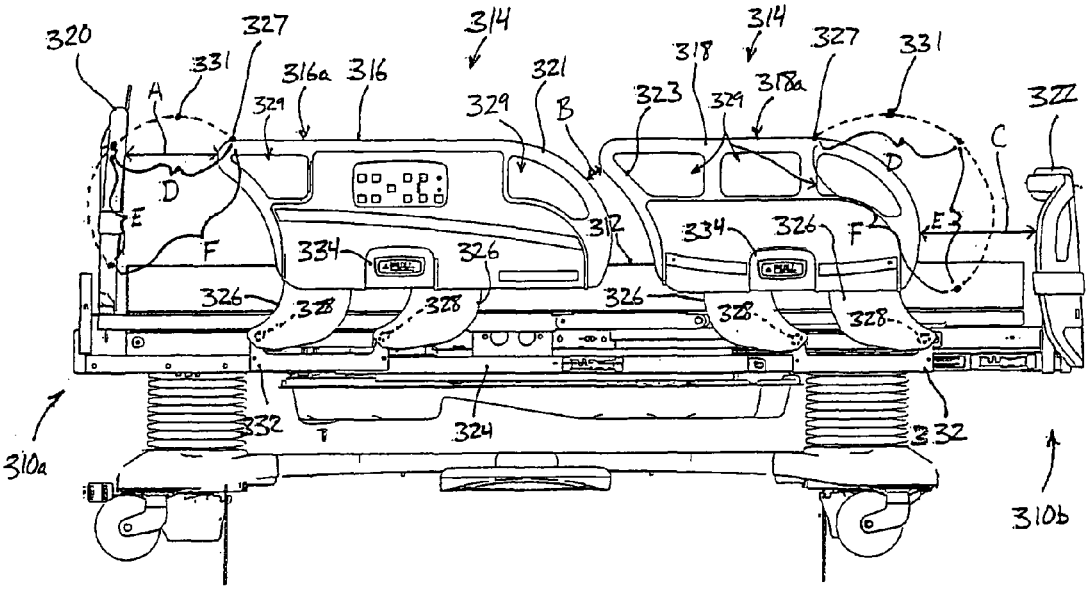
FIG. 37*a* is a side elevation of the right side of a hospital bed of the present invention with siderails in a raised position.
Figure 37B:
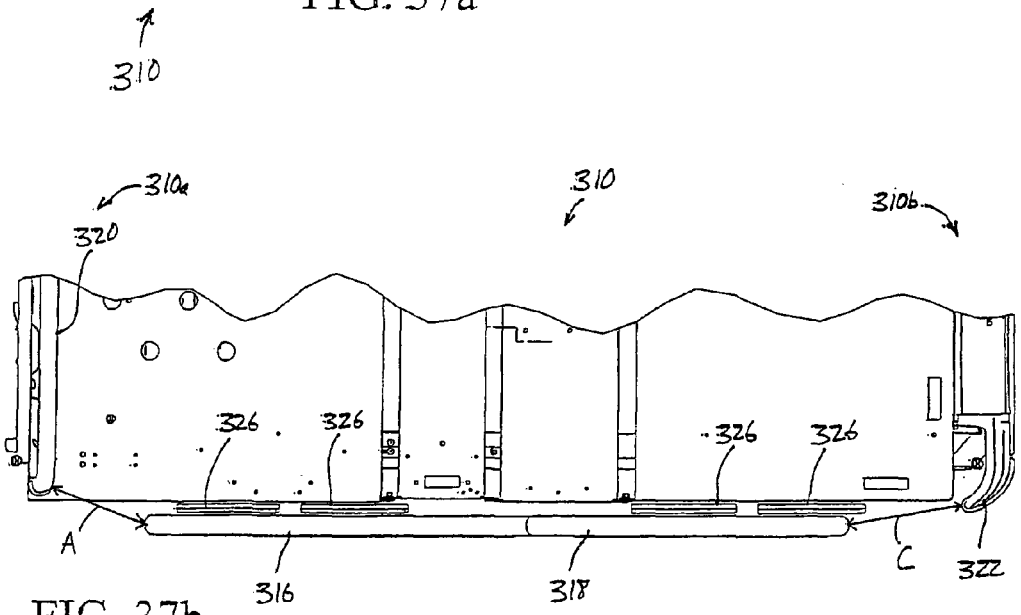
FIG. 37*b* is a top plan view of a portion of the right side of the hospital bed of FIG. 37*a;*
Figure 38A:
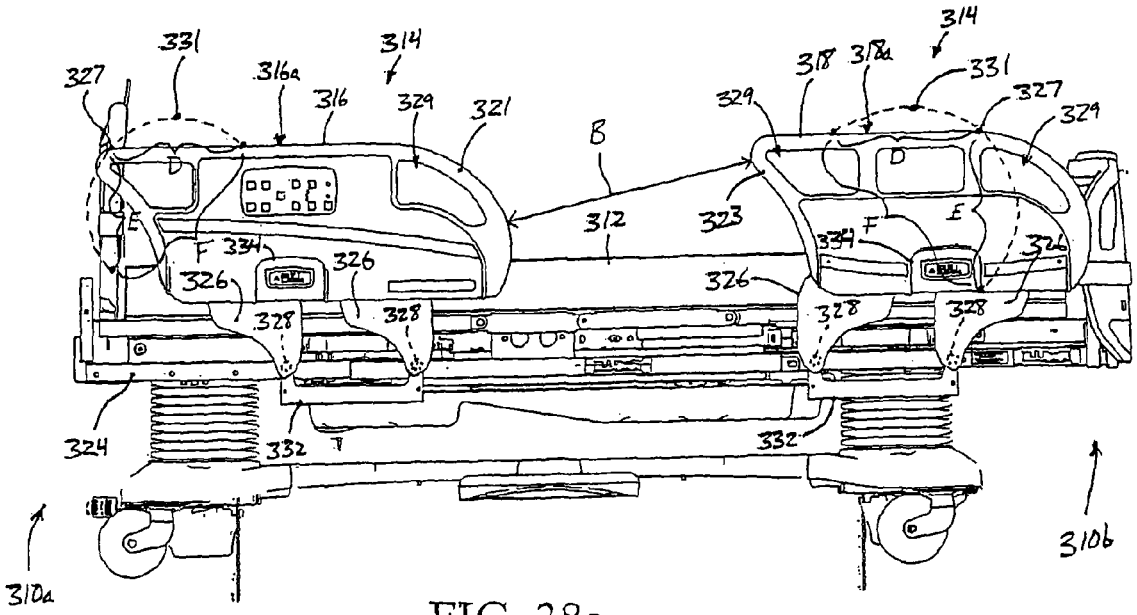
FIG. 38*a* is a side elevation of the right side of a hospital bed of the present invention with siderails in an intermediate position.
Figure 38B:
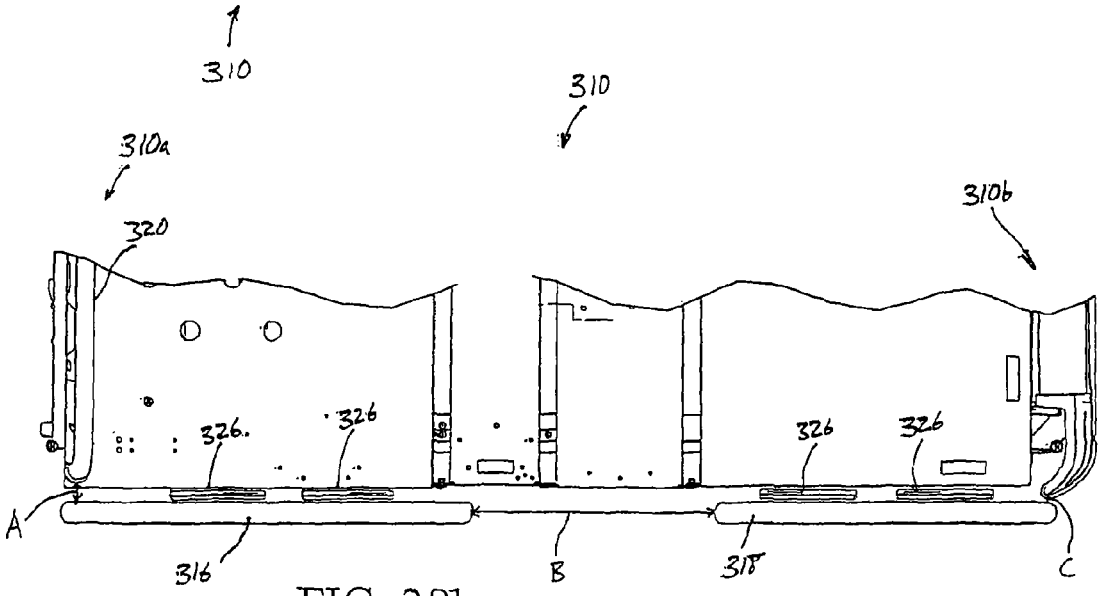
FIG. 38*b* is a top plan view of a portion of the right side of the hospital bed of FIG. 38*a;*

A first gap A is defined as the approximate distance between head end siderail 16 and headboard 320 (FIGS. 37*a*, 37*b*, and 38*b*). A second gap B is defined as the minimum absolute distance (as opposed to the longitudinal or lateral distance, for example) between head end siderail 316 and foot end siderail 318 (FIGS. 37*a*, 38*a*, and 38*b*). A third gap C is defined as the minimum absolute distance between foot end siderail 318 and footboard 322 (FIGS. 37*a*, 37*b*, and 38*b*). As best seen in FIGS. 37*a* and 38*a*, gaps A, B, C change as siderails 314 move from the raised position to the intermediate position to the lowered position.

In the raised position (FIGS. 37*a* and 37*b*), head end siderail 316 and foot end siderail 318 are raised such that top portions 316*a*, 318*a* of siderails 316, 318 are substantially above lying surface 312. When head end siderail 316 and foot end siderail 318 are both in the raised position, first gap A is about 235 millimeters (mm) or greater, second gap B is about 60 mm or less, and third gap C is about 235 mm or greater.

In the intermediate position (FIGS. 38*a* and 38*b*), head end siderail 316 is closer to headboard 320 and foot end siderail 318 is closer to footboard 322 than when head end siderail 316 and foot end siderail 318 are in their respective raised positions. In the intermediate position, first gap A is about 60 mm or less, second gap B is about 235 mm or greater, and third gap C is about 60 mm or less. Optionally, and as shown, second gap B is about 508 mm or greater when siderails 316, 318 are in the intermediate position to provide adequate space through which a patient may ingress or egress the bed 310 while using either or both siderails 316, 318 as hand-holds. Optionally, such as to provide even greater access to lying surface 312, either siderail 316, 318 may be positioned in the raised or intermediate position while the other siderail on the same side of bed 310 is positioned in the lowered position so that a patient's legs may be brought onto lying surface 312 by raising them only as high as lying surface 312.

Optionally, such as when second gap B is about 508 mm or greater and siderails 316, 318 are in the intermediate position, both siderails 316, 318 may be used as hand-holds for exercise or physical therapy purposes, for example, stand-up and sit-down repetitions. To facilitate the use of siderails 316, 318 as hand-holds, head end siderail 316 and foot end siderail 18 may have gripping members 321, 323 with diameter or thickness of approximately one to two inches, for example, or more or less.

Optionally, in the intermediate position, first gap A and/or third gap C may be approximately 0 mm, i.e. there is no gap defined between head end siderail 316 and headboard 320, or between foot end siderail 318 and footboard 322. Head end siderail 316 may overlap headboard 320, as viewed from the side (FIG. 38*a*), such that there is a 0 mm space therebetween when measured longitudinally, but greater than 0 mm and less than about 60 mm spacing when measured laterally (FIG. 38*b*), assuming head end siderail 316 is not touching headboard 320. Similarly, foot end siderail 318 may overlap footboard 322, as viewed from the side (FIG. 38*a*), such that there is a 0 mm space therebetween when measured longitudinally, but greater than 0 mm and less than about 60 mm spacing when measured laterally (FIG. 38*b*), assuming foot end siderail 318 is not touching headboard 320.

When foot end siderails 318 at left and right sides of bed 310 abut or overlap footboard 322 in their respective intermediate positions, a substantially contiguous or continuous fence is effected by virtue of the foot end siderails 318 and footboard 322 cooperating to fence or block or surround a substantial portion of the foot end of lying surface 312. Such a configuration would be achieved if both left and right side foot end siderails 318 were moved to their intermediate positions as in the right foot end siderail 318 of FIGS. 38*a* and 38*b*. A similar "fence" configuration may also be achieved at the head end of lying surface 312 by moving both head end siderails 316 to their respective intermediate positions.

In the lowered position (FIGS. 39*a* and 39*b*), head end siderail 316 has displaced downward and foot end siderail 318 has also displaced downward relative to head end siderail's 316 and foot end siderail's 318 respective intermediate positions. In the lowered position, top portions 316*a*, 318*a* of head end siderail 316 and foot end siderail 318 are located below lying surface 312 such that first gap A, second gap B, and third gap C are also located below lying surface 312. Optionally, and as shown, the entireties of head end siderail 316 and foot end siderail 318 are located below lying surface 312 when in the lowered position.

Siderails 314 further incorporate a plurality of apertures 329 (FIGS. 37*a*, 38*a*, and 39*a*) sized to substantially prevent a 120 mm diameter cylinder (not shown) from passing through apertures 329 to comply with Zone 1 recommendations in the FDA document. Apertures 329 may be used to facilitate gripping by a patient. Additionally, hospital bed 310 may comply with recommendations made in the FDA document pertaining to the sizing of Zones 2 through 4. Additionally, hospital bed 310 may comply with standards listed in International Standard IEC 60601-2-38.

Figure 39A:
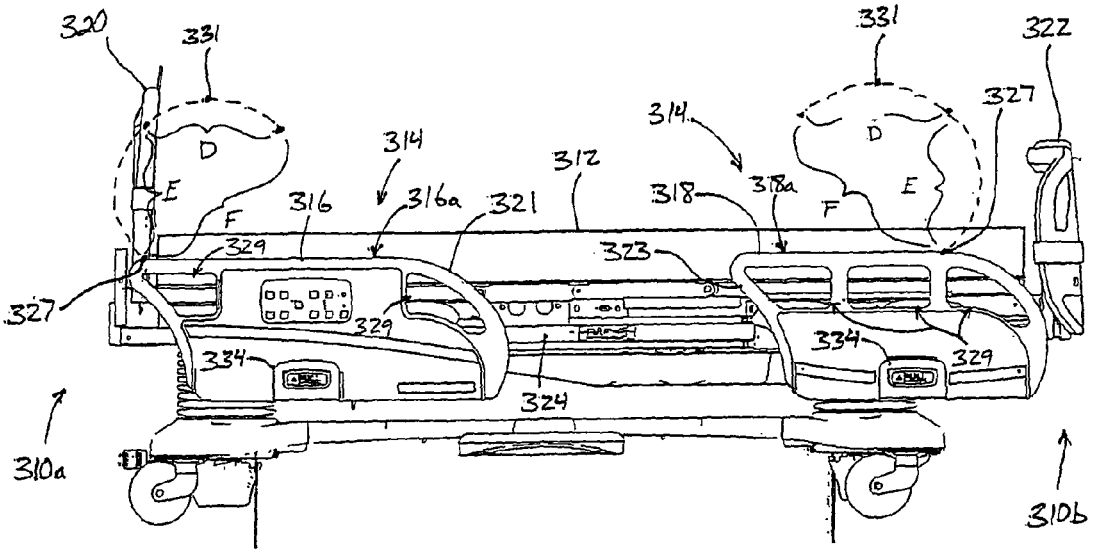
FIG. 39*a* is a side elevation of the right side of a hospital bed of the present invention with siderails in a lowered position.
Figure 39B:
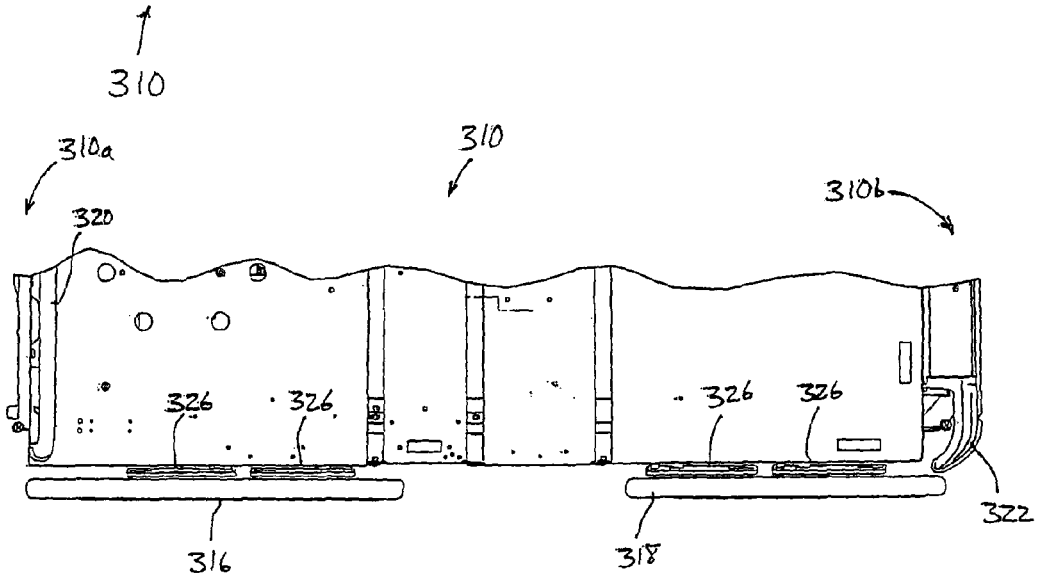
FIG. 39*b* is a top plan view of a portion of the right side of the hospital bed of FIG. 39*a*.

Accordingly, siderails 314 are movable along first arcuate paths D (FIGS. 37*a*, 38*a*, and 39*a*) from their respective raised positions to their respective intermediate positions, and along second arcuate paths E from their respective intermediate positions to their respective lowered positions. Siderails 314 are further movable along third arcuate paths F from their respective lowered positions to their respective raised positions, where paths F may simply retrace both of paths E and D. Note that FIGS. 37*a*, 38*a*, and 39*a* are not of identical scales, and the depictions of the arcuate paths D, E, F illustrate only the general shape of each path, as traced by a point 327 at the top portion 316*a* of head end siderail 316. Further, FIGS. 37*a*-39*b* are merely illustrative of the general locations of headboard 320 and footboard 322, and each siderail 316, 318 at the raised, intermediate, and lowered positions.

The third arcuate paths F generally retrace the second and first arcuate paths E, D, but in reverse direction and without siderails 314 pausing or stopping at their respective intermediate positions. As siderails 314 are moved from the lowered positions to the raised positions, a lower portion of the third arcuate path F generally retraces the second arcuate path E, and an upper portion of the third arcuate path F generally retraces the first arcuate path D. Because the paths of siderails 314 are constrained by siderail arms 326, which pivot about first pivot 328, the arcuate paths D, E, F of siderails 314 are of a constant radius of curvature, as in a portion of a circle. The raised position is such that the top portions 316*a*, 318*a* of siderails 314 are located below an apex 331 (FIGS. 37*a*, 38*a*, and 39*a*) of the first and/or third arcuate paths D, F, as will be described in greater detail below.

Optionally, the raised position of siderails 314 corresponds to the apex 331 of first arcuate path D or third arcuate path F. Alternatively, the raised position of siderails 314 corresponds to a position before or after (or left or right of, as viewed in FIGS. 37*a*, 38*a*, and 39*a*) apex 331 along first arcuate path D or third arcuate path F. Where the raised position is before apex 331, a given siderail 314 at its raised position has not reached apex 331 and top portions 316*a*, 318*a* therefore remain below apex 331 at all times. By comparison, in the illustrated embodiment, where the raised position is after apex 331 (FIG. 37*a*), a given siderail 314 at its raised position has reached and moved beyond apex 331 of third arcuate path F and therefore top portions 316*a*, 318*a* are below the apex 331.

Thus, where the raised position corresponds to apex 331, a given siderail 314 will move longitudinally and downward when it is moved from the raised position (FIGS. 37*a* and 37*b*) toward the intermediate position (FIGS. 38*a* and 38*b*) along the first arcuate path D. Where the raised position is before apex 331, a given siderail 314 will similarly move longitudinally and downward when it is moved from the raised position toward the intermediate position along the first arcuate path D. Where the raised position is after apex 331 (FIG. 37*a*), a given siderail 314 will move longitudinally while moving vertically upward and then downward as siderail 314 traces first arcuate path D as siderail 314 is moved from the raised position toward the intermediate position.

For example, in the illustrated embodiment, the raised position (FIGS. 37*a* and 37*b*) of siderails 316, 318 corresponds to a location after apex 331 along first arcuate path D. To reach the intermediate position (FIGS. 38*a* and 38*b*), head end siderail 316 moves toward headboard 320 and reaches a maximum height or apex 331 as it translates along first arcuate path D from the raised position to the intermediate position. Similarly, to reach the intermediate position from the raised position, foot end siderail 318 moves toward footboard 322 and reaches a maximum height or apex 331 as foot end siderail 318 translates along its first arcuate path (not shown) from the raised position to the intermediate position. Thus, in the illustrated embodiment, the raised position does not correspond to the maximum height achieved by siderails 314. Instead, the maximum height achieved by siderails 314 occurs between the first and intermediate positions. It will be understood by those skilled in the art that a siderail in the raised position may be higher, lower, or at substantially the same height relative to support frame 324 as the same siderail in the intermediate position.

In use, and as described in detail above, when a user desires to move siderail 314 from the raised position to the intermediate position, the user disengages the lock device with release handle 334 to allow siderail 314 to move along first arcuate path D and urges siderail 314 toward the intermediate position. When siderail 314 reaches the intermediate position, the lock device automatically engages to lock siderail 314 at the intermediate position. When the user desires to move siderail 314 from the intermediate position to the lowered position, the user once again disengages the lock device with release handle 334 to allow siderail 314 to move along second arcuate path E toward the lowered position. When siderail 314 reaches the lowered position, the lock device remains disengaged such that siderail 314 is free to be moved out of the lowered position without the use of release handle 334.

Optionally, siderail 314 may be moved from the raised position directly to the lowered position by disengaging the lock device with the release handle 334 and holding the release handle 334 such that the lock device remains disengaged as the siderail 314 is moved through and past the intermediate position from the raised position.

When the user desires to move siderail 314 from the lowered position to the raised position, the user urges siderail 314 along third arcuate path F, through the intermediate position, whereupon the lock device remains disengaged until siderail 314 reaches the raised position. In the raised position, the lock device automatically engages to fix siderail 314 in the raised position.

When the user desires to move siderail 314 from the lowered position to the intermediate position, the user urges siderail 314 along the lower portion of third arcuate path F until just past the intermediate position, then urges or allows siderail 314 to reverse course, whereupon the lock device automatically engages upon siderail 314 reaching the intermediate position.

When the user desires to move siderail 314 from the intermediate position to the raised position, the user disengages the lock device with release handle 334 and urges siderail 314 to move along the upper portion of third arcuate path F until reaching the raised position, whereupon the lock device automatically engages to fix siderail 314 in the raised position.

It will be appreciated by those skilled in the art that the motion and spacing of siderails described with reference to the illustrated embodiment of FIGS. 37*a*-39*b* may be accomplished with alternative embodiments of mechanisms. For example, the motion of individual siderails may be motorized and/or automated, and each siderail equipped with an electronically controlled latch, where the motion and latching of the siderails is controlled with an electronic controller such as a push button or a touch screen or the like.

Changes and modifications in the specifically described embodiments may be carried out without departing from the principals of the present invention, which is intended to be limited only by the scope of the appended claims, as interpreted according to the principles of patent law including the doctrine of equivalents.

The embodiments of the invention in which an exclusive property or privilege is claimed are defined as follows:

1. A siderail for a patient support, said siderail comprising:

a siderail body being movable between a first position, a second position, and a third position between said first position and said second position, one of said first position and said second position comprising a raised locked position and the other of said first and second positions comprising a lowered position; and a latching mechanism configured to allow said siderail body to bypass said third position when said siderail body is moved in a first direction from said first position toward said second position and reconfigured to releasably lock said siderail body at said third position when said siderail body is moved in a second direction from said second position toward said first position after said siderail body is moved past said third position but before reaching the second position.

2. The siderail of claim 1, wherein said latching mechanism comprises a cam.

3. The siderail of claim 2, further comprising a latch, said latch selectively engaging said cam to lock said siderail body at said third position.

4. The siderail of claim 3, wherein said cam comprises a cam disk, said cam disk having a rotational axis about which said cam disk rotates and a cam disk face lying in a plane generally perpendicular to said rotational axis, said latch defining an engagement structure for coupling to said cam disk at said cam disk face, and said engagement structure being adapted to releasably couple with said cam disk face when said siderail body is moved to said third position from said second direction after said siderail body has moved past said intermediate position to thereby releasably rotatably lock said cam disk and thereby lock said siderail body in said third position.

5. The siderail of claim 4, wherein said engagement structure comprises a locking protrusion, and said cam disk includes a void, said locking protrusion selectively engaging said cam disk face at said void.

6. The siderail of claim 5, further comprising a latch biasing element, said latch biasing element being adapted to urge said locking protrusion towards said void when said void is substantially aligned with said locking protrusion.

7. The siderail of claim 3 further comprising a bypass arm, said bypass arm being configured to restrain said latch from engaging said cam in said third position when said siderail body is moved in said first direction from said first position to said second position, and said bypass arm being configured to release said restraint of said latching mechanism after said siderail body is moved past said third position but before reaching said second position and when said siderail body is moved in said second direction from said second position toward said first position.

8. The siderail of claim 7, said bypass arm further including a stepped portion, said stepped portion being configured to restrain said latch from engaging said cam at said third position when said siderail body is moved in said first direction.

9. The siderail of claim 7, wherein said bypass arm further includes a cam follower, said cam follower being adapted to follow said cam when said siderail body is moved in said second direction from said second position to said first position, and said stepped portion being adapted to disengage said cam follower from following said cam for that portion of rotation substantially corresponding with said third position when said siderail body is moved in said second direction from said second position to said first position.

10. The siderail of claim 9, wherein said bypass arm is adapted to engage said latch with said stepped portion at that portion of rotation of said cam disk substantially corresponding to said third position when said siderail body is moved in said first direction from said first position to said second position to thereby prevent said latch from coupling with said cam.

11. The siderail of claim 1, wherein said first position corresponds to a lowered position, said second position corresponds to a raised position, and said third position corresponds to said intermediate locked position between said raised position and said lowered position.

12. The siderail of claim 1, further comprising a handle adapted to unlock said latching mechanism.

13. The siderail of claim 1, further in combination with a patient support.

14. A siderail for a patient support, said siderail comprising:

a siderail body being movable between a first position, a second position, and a third position between said first position and said second position; and a latching mechanism having a bypass configuration adapted to allow said siderail body to bypass said third position when said siderail body moves in a first direction from said first position toward said second position and having a locking configuration configured to releasably lock said siderail body in said second position, and said latching mechanism being configured to selectively lock said siderail body at said third position when said siderail body moves in a second direction from said second position toward said first position, and said latching mechanism being reconfigured between said bypass configuration and said locking configuration just after passing said third position and before said siderail reaches said second position.

15. The siderail of claim 14, said latching mechanism being adapted to provide a perceptible feedback when said latching mechanism is reconfigured between said bypass configuration and said locking configuration.

16. The siderail of claim 14, said siderail further comprising:

a siderail arm having a first portion and a second portion, said first portion for pivotally connecting to a patient support, and said second portion being pivotally connected to said siderail body; and said latching mechanism including a cam disk fixedly attached to said siderail arm, said cam disk being configured to releasably lock said siderail body in said second position and said third position.

17. The siderail of claim 16, further comprising a bypass arm, said bypass arm being adapted to restrain said cam disk from locking said siderail body in said third position when said siderail body is moved from said first position to said second position.

18. The siderail of claim 17, wherein said bypass arm includes a cam follower, said cam follower following said cam disk when said siderail body is moved from said first position through said third position to said second position, and said bypass arm configured to disengage said cam follower from following said cam disk for that portion of rotation substantially corresponding with said third position when said siderail body is moved in said second direction from said second position to said third position.

19. The siderail of claim 17, further comprising a latch member for engaging said cam disk, and said bypass arm being configured to stop said latch member from engaging said cam disk at said third position when said siderail body is moved in said first direction from said first position to said second position.

20. The siderail of claim 19, said bypass arm being movable between a non-blocking position and a blocking position between said latch member and said cam disk to thereby prevent said latch member from engaging said cam disk, and said bypass arm being urged toward said blocking position by a biasing member.

21. The siderail of claim 14, wherein said first position corresponds to a lowered position, said second position corresponds to a raised position, and said third position corresponds to said intermediate position between said raised position and said lowered position.

* * * * *